US011846490B2

(12) United States Patent
Campbell

(10) Patent No.: US 11,846,490 B2
(45) Date of Patent: Dec. 19, 2023

(54) ROTATIONALLY DEPLOYED NON-BLOCKING FIREARM MIRROR ACCESSORY

(71) Applicant: Robert Marshall Campbell, Miami, FL (US)

(72) Inventor: Robert Marshall Campbell, Miami, FL (US)

( * ) Notice: Subject to any disclaimer, the term of this patent is extended or adjusted under 35 U.S.C. 154(b) by 0 days.

(21) Appl. No.: 17/222,942

(22) Filed: Apr. 5, 2021

(65) Prior Publication Data

US 2022/0003521 A1 Jan. 6, 2022

Related U.S. Application Data

(63) Continuation of application No. 15/398,674, filed on Jan. 4, 2017, now Pat. No. 10,969,196.

(60) Provisional application No. 62/403,040, filed on Sep. 30, 2016, provisional application No. 62/358,099, filed on Jul. 4, 2016, provisional application No. 62/387,780, filed on Jan. 4, 2016.

(51) Int. Cl.
*F41G 1/30* (2006.01)

(52) U.S. Cl.
CPC ..... *F41G 1/30* (2013.01)

(58) Field of Classification Search
CPC ..... F41G 1/30; F41G 1/40; F41G 1/41; F41G 1/46
See application file for complete search history.

(56) References Cited

U.S. PATENT DOCUMENTS 40,256 A * 10/1863 Garretson ..... F41G 1/473 42/111
880,378 A * 2/1908 Geis ..... F41G 1/30 42/118
3,637,186 A * 1/1972 Greenfield ..... B60R 1/0617 248/478
3,784,149 A * 1/1974 Brudy ..... B60R 1/0617 248/478
4,072,397 A * 2/1978 Ross ..... A45D 42/00 4/597
5,442,860 A * 8/1995 Palmer ..... F41G 1/545 33/286
6,311,424 B1 * 11/2001 Burke ..... F41G 1/40 89/203

(Continued)

*Primary Examiner* — Jonathan C Weber
(74) *Attorney, Agent, or Firm* — Javier Sobrado; The Brickell IP Group, PLLC

(57) ABSTRACT

A firearm accessory is rotatable on two axes through the use of a sleeve mounted on a bearing comprising of a first part and a second part the second part being rotatable and coupled to the first part facilitating a central opening and a first rotational motion and protrusions with at least one hinge from the sleeve attaching to a mirror device acting as a second rotational motion. An alternative teaches digital control of a swinging mirror assembly having spring acting ball actuators providing the digital action between the actuators and a surface. In another alternative, two armatures also are taught that connect a reflective device to a bearing mounted sleeve in front of or behind a target viewing device. Any of these may be directly rail mounted with appropriate attachment devices or directly connected to or manufactured as an integral part of a reflex sight, night vision, scope or similar viewing system of a firearm.

20 Claims, 49 Drawing Sheets

(56) References Cited

U.S. PATENT DOCUMENTS

| | | | | |
|---|---|---|---|---|
| 6,643,969 | B1 * | 11/2003 | Avizonis, Jr. | F41G 1/46 42/118 |
| 7,257,920 | B1 * | 8/2007 | Shaffer | F41G 1/30 42/118 |
| 7,369,302 | B2 * | 5/2008 | Gaber | F41G 11/001 359/399 |
| 7,552,558 | B1 * | 6/2009 | Ballard | F41G 1/40 356/255 |
| 7,640,691 | B2 * | 1/2010 | Karcher | F41G 11/003 359/399 |
| 8,379,307 | B2 * | 2/2013 | Thomas | F41G 1/38 359/429 |
| 8,793,917 | B2 * | 8/2014 | Russell | F41G 3/165 42/111 |
| 2005/0241210 | A1 * | 11/2005 | Karcher | F41G 1/40 42/119 |
| 2006/0005448 | A1 * | 1/2006 | Ballard | F41G 1/01 42/111 |
| 2009/0071056 | A1 * | 3/2009 | Storch | F41G 1/08 42/137 |
| 2016/0102941 | A1 * | 4/2016 | Brucker | F41G 1/033 42/148 |
| 2017/0030679 | A1 * | 2/2017 | Campbell | F41G 1/40 |

* cited by examiner

FIG-1-B
FIG-1-C
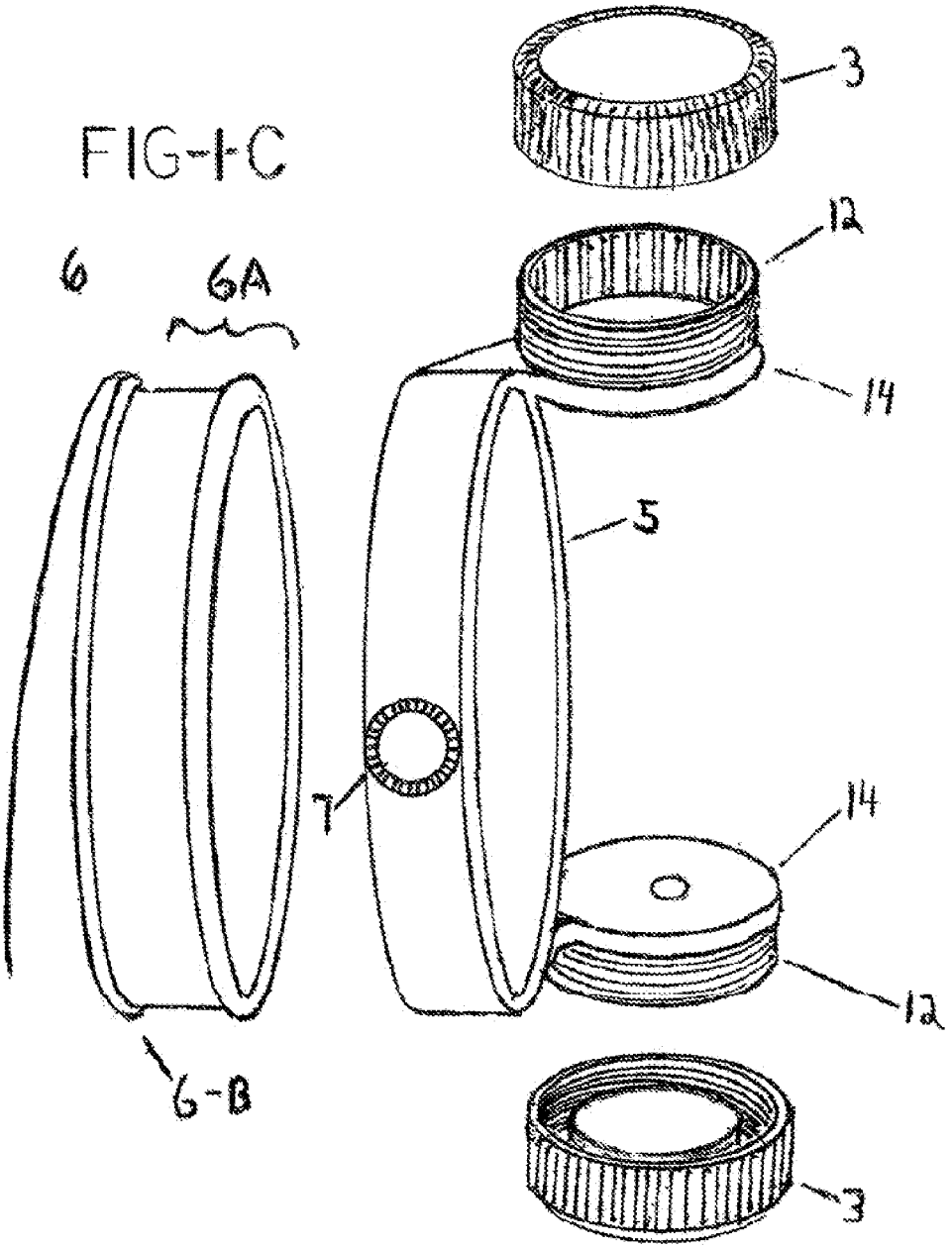

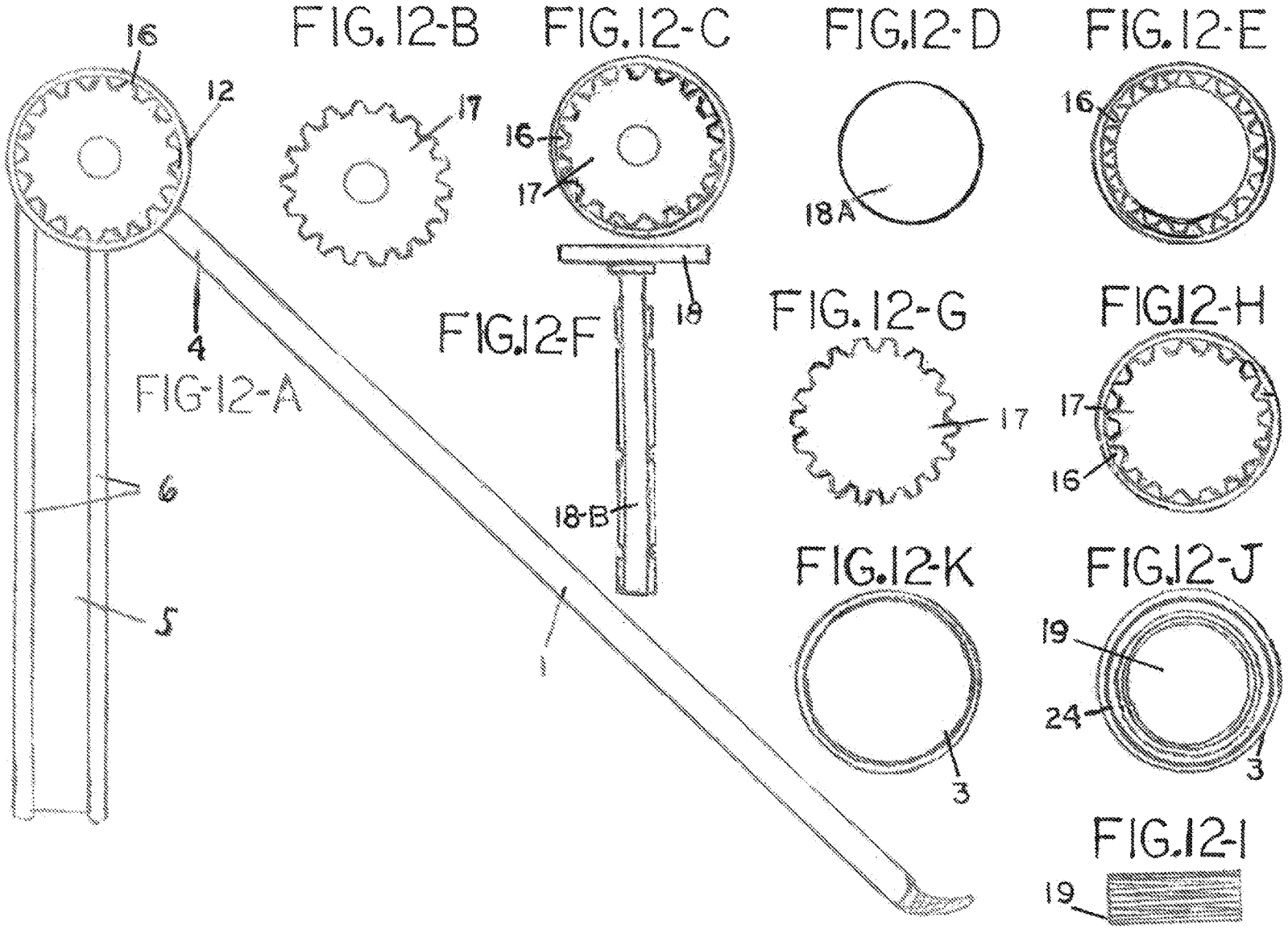
FIG.12-E
16
FIG.12-H
17
16
FIG.12-J
3
19
24
FIG.12-I
19
FIG.12-D
18A
FIG.12-G
17
FIG.12-K
3
FIG.12-C
16
17
18
FIG.12-F
18B
FIG.12-B
17
FIG.12-A
16
12
4
9
5

FIG-28-A
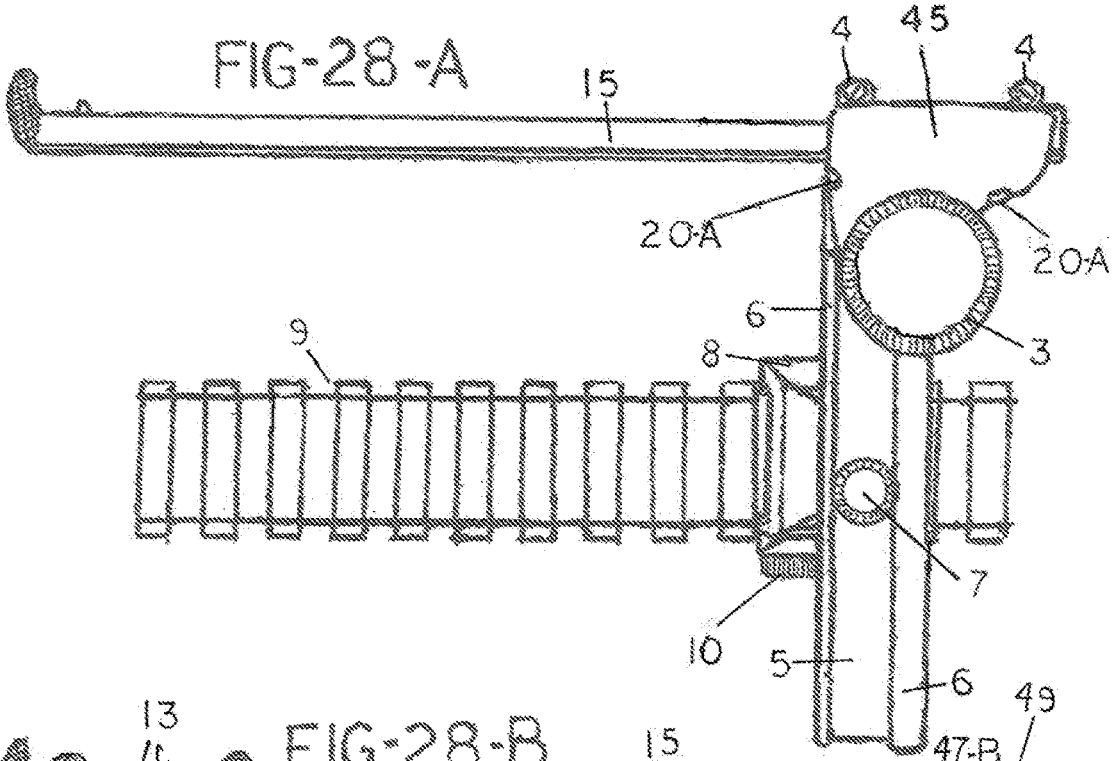
FIG-28-B
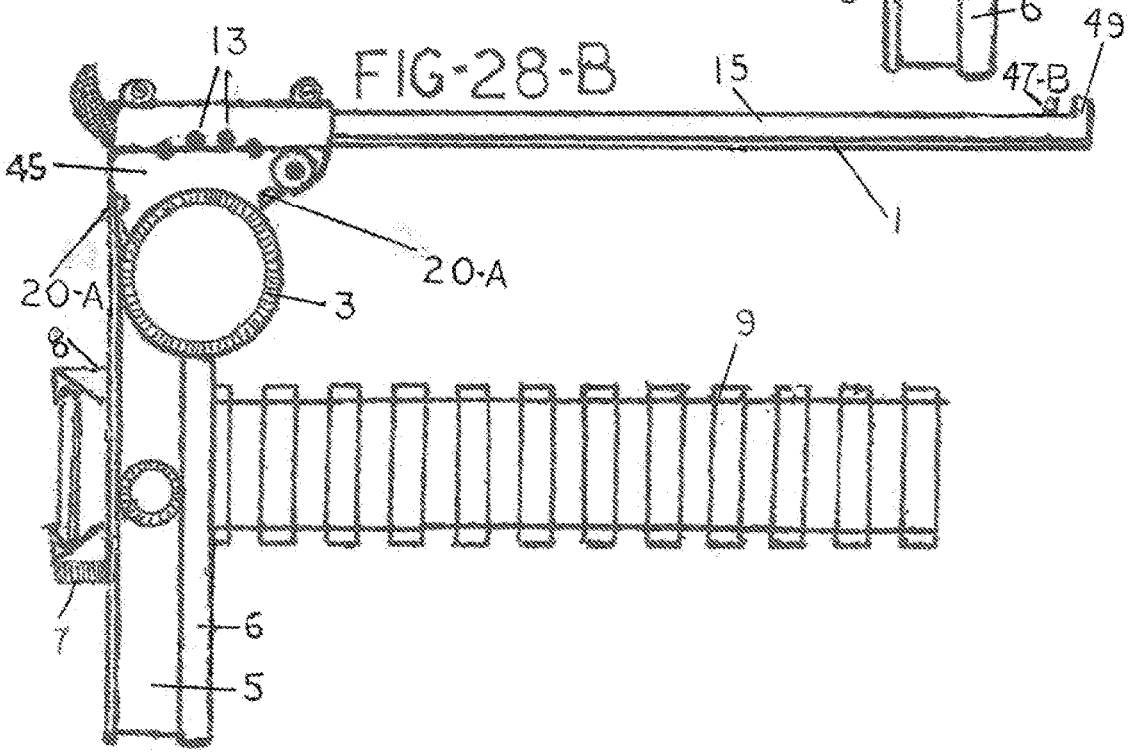

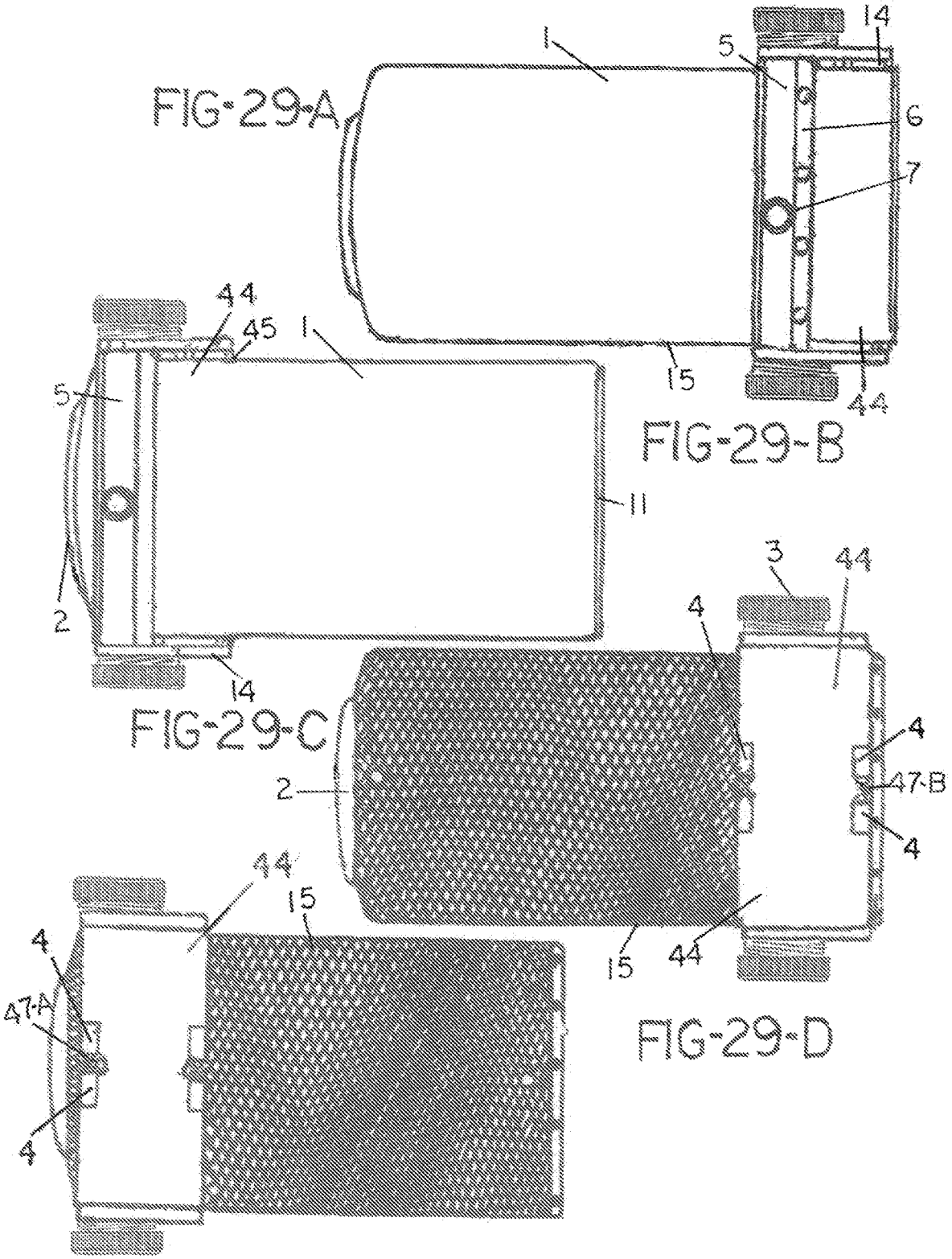
FIG-29-A
1
5
14
6
7
15
44
FIG-29-B
44
45
1
5
11
2
14
FIG-29-C
3
44
4
2
4
47-B
4
15
44
FIG-29-D
44
15
4
47-A
4

FIG-30-A
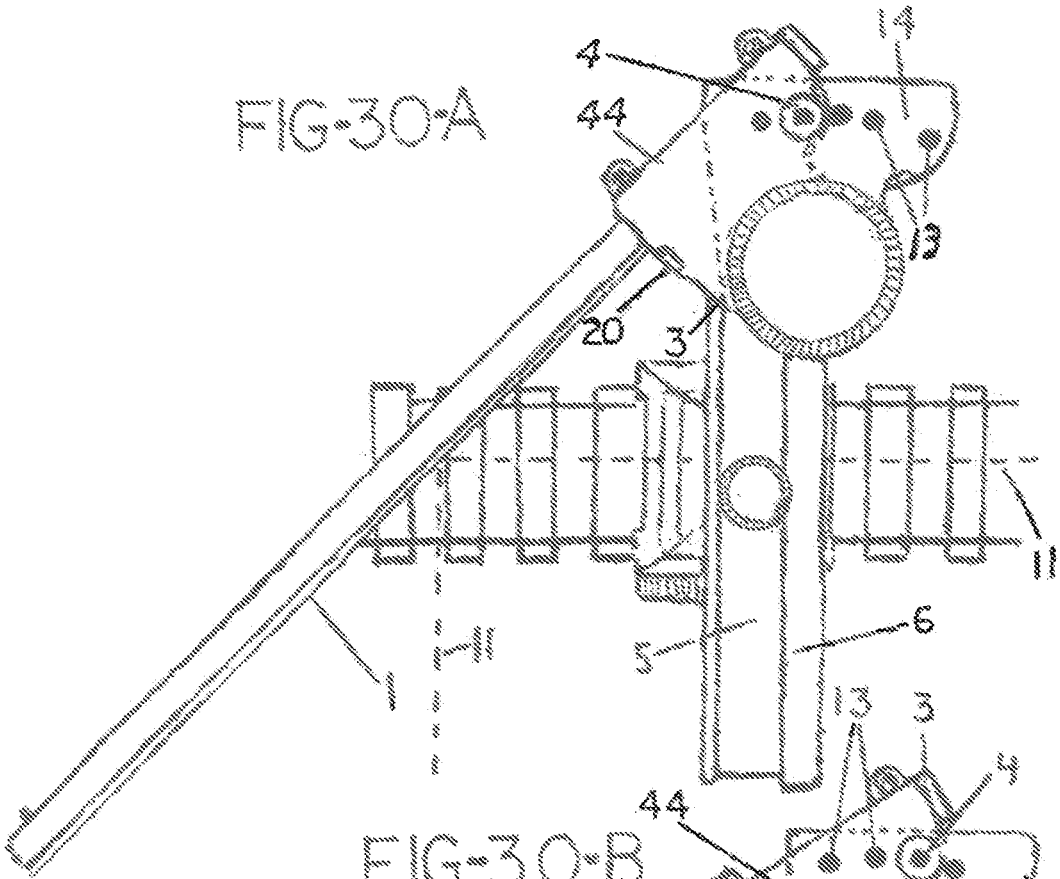
FIG-30-B
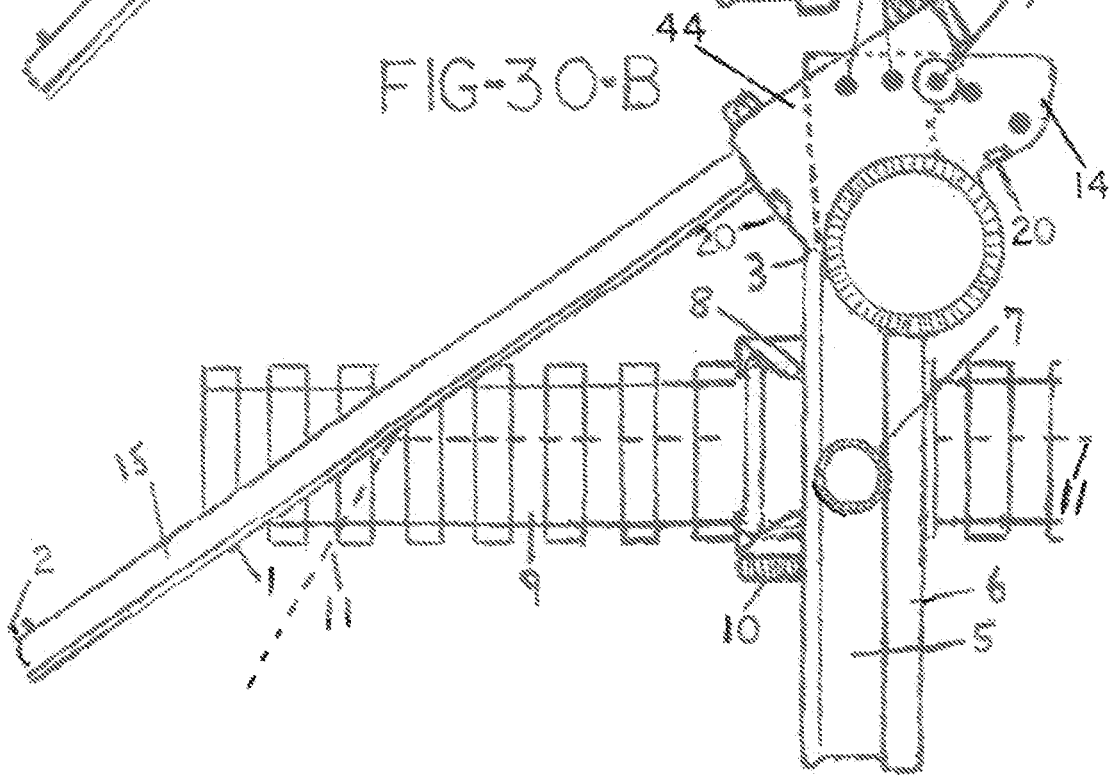

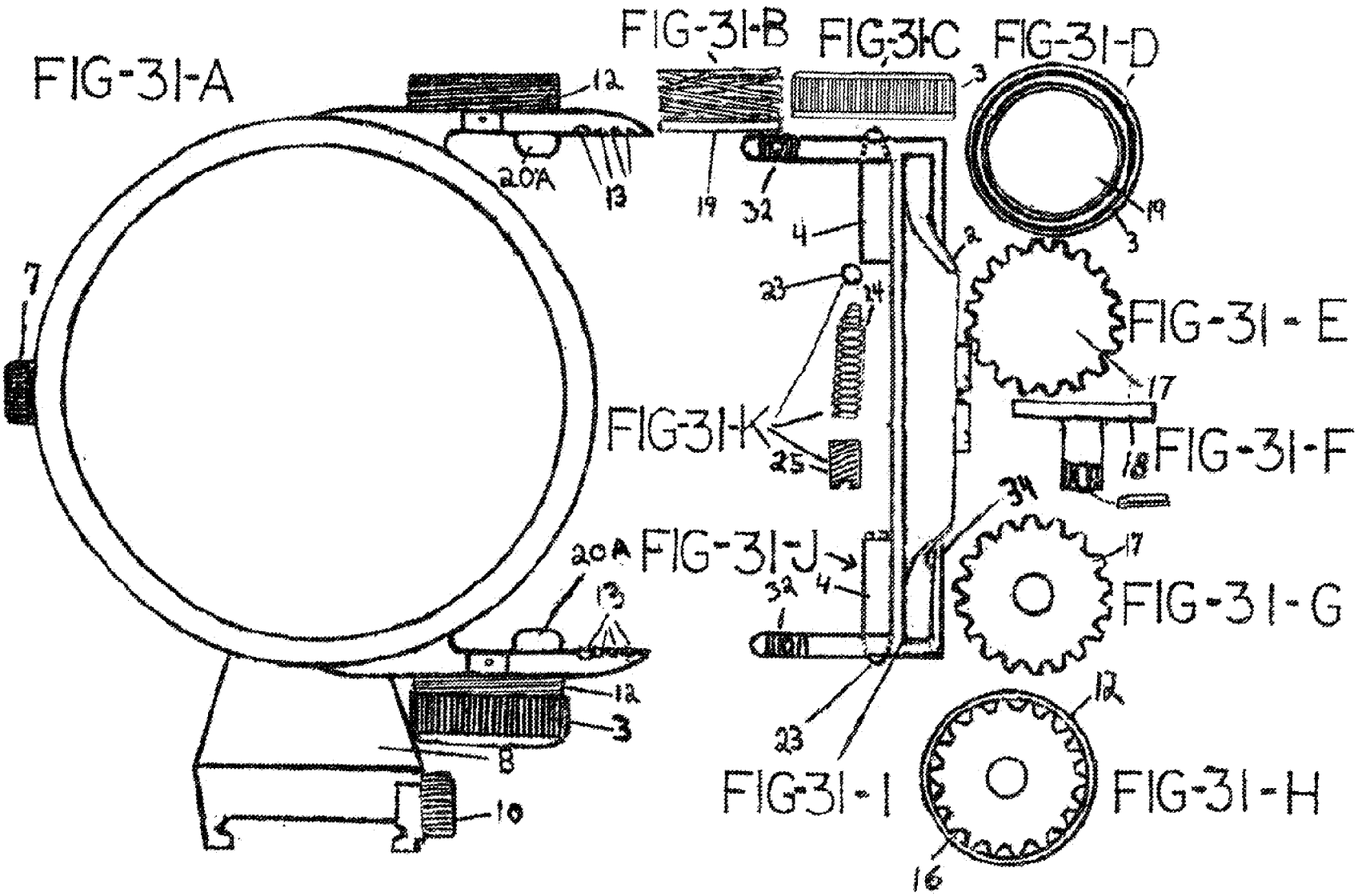
FIG-31-A
FIG-31-B
FIG-31-C
FIG-31-D
FIG-31-E
FIG-31-F
FIG-31-G
FIG-31-H
FIG-31-I
FIG-31-J
FIG-31-K FIG-41-F
FIG-41-D
7
26
27
25
3-B
FIG-41-E
5-A
FIG-41-A
44-A
FIG-41-C
46
45
45-C
45-A
45-B
FIG-41-B
1

ROTATIONALLY DEPLOYED NON-BLOCKING FIREARM MIRROR ACCESSORY

CROSS REFERENCE TO RELATED APPLICATIONS

This patent application is a continuation of U.S. patent application Ser. No. 15/398,674 that was submitted on Jan. 4, 2017, which claims benefit of earlier filed provisional patent applications including No. 62/282,267, that was submitted Jul. 29, 2015 and provisional patent application No. 62/387,780, that was submitted Jan. 4, 2016 and provisional patent application No. 62/358,099, that was submitted Jul. 4, 2016 and provisional patent application No. 62/403,040, that was submitted Sep. 30, 2016 and herein are incorporated in their entirety by reference.

FIELD OF THE INVENTION

The present invention relates to firearm devices that are utilized to assist a user for two purposes. First, to locate targets of potential danger such as hostile enemy combatants or for surveillance purposes, and second, if the decision is made, to accurately pinpoint and fire on same, from a safe, secure position such as behind a wall, tree, armored vehicle, tree, building or the like without exposing him or herself as a target while doing so. More particularly, the present invention relates to deployable mirrored devices that are suitably attached to a firearm's weapons rail or mechanically fastened to the target viewing device that they are working in conjunction with or to be suitably incorporated into the design and manufactured as an integral part of the target viewing device they are working in conjunction with thereby facilitating the viewing of persons, objects, or scenery from a relatively safe vantage point. When these devices are mounted on a rifle or pistol rail system, they are optionally used in two manners. Firstly, mounted to/or in front of a target viewing device, they are used to reflect the target image to the target viewing device or to the naked eye and thusly received by the user to locate targets of potential danger or to be mounted or fastened behind a target viewing device such as reflex sight, scope, night vision or other, they are used to reflect the target image from the target viewing device to the user from any position that the user would have to place himself in relationship to the firearm to effectively engage a target of potential danger from a safe, secure position.

Weapons Rails

Weapons rails are found in many types of firearms including rifles, pistols, automatic as well as semi-automatic and more. Various firearm accessories are mounted thereon whether on top or bottom, on one or more sides, in front or back, or any combination of the aforementioned. Various target viewing devices such as reflex sights, scopes, night vision, range finders, laser sights, as well as high powered lights and more are mounted on these weapons' rails to aid the firearm's overall range of use and function and they are ubiquitously seen on a wide range of firearms and firing ranges.

Background of Invention

In general, firearm accessories have long been established for mounting on rifles and pistols. Such accessories include red dot sights, high powered lights, night vision, scopes, laser sights, and the like. All of the aforementioned firearm accessories aid in locating and pin pointing a target, however, the aforementioned prior art offers no protection to the user in a theater of combat in that they fail to provide the user with the ability to accurately locate and pinpoint a target with the user being in the many various positions that he would have to position himself while taking cover during incoming fire in a theater of combat in that the user would have to expose himself as a target to the accurate use of a firearm.

In other words, in order to accurately locate, pinpoint, and fire on a target, the user of the firearm must become a target to do so which presents a problem in that first responders, soldiers, and law enforcement personnel often encounter hostile combatants, violent actors, or offenders who carry pistols, rifles, or other weapons. In military scenarios, battles and other military operations, often occur in urban theaters requiring armed forces to patrol and engage in battle in towns and cities. Personnel on patrol in dangerous areas must regularly take cover behind obstacles such as buildings, vehicles, trees, homes, etc. and have to locate and fire on hostile combatants from protective cover. The problem is that with friendly combatants' entire body being behind cover, a clear lineal view to be able to locate and accurately fire on advancing hostile forces cannot be accomplished without looking over or around these fortified structures to both locate and fire on hostiles, exposing himself as a target while doing so. In fact, statistics tell us that as much as 50 percent of American casualties occur on the battlefield while doing so.

Previous Solutions

Prior mechanical solutions found on the market made to accomplish the task of providing user with the ability to remain in a safe position out of the line of fire while maintaining the ability to locate hostile combatants and accurately return fire up to this point have achieved limited success for several different reasons. All of the current solutions are very limited in their overall range of use and application.

One of problems is the limited range of positions that the user must place himself in relation to the firearm for these solutions to function.

Another problem with the present solutions is that they only function when they are mounted behind red dot type sights and only red dot type sights that mount on the weapon's rail at the proper height to be used in conjunction with the present solutions, in that not only do the prior solutions only mount on a weapons rail but they only mount on this rail at one height and only function properly when they are mounted behind a red dot type sight that meets the proper height range requirements to be used in conjunction with the prior solutions and this range is very small and limited in that all of these red dot sights sit at various heights off of the weapon's rail that they are mounted to and that these devices are mounted behind.

The current solutions also all restrict the image provided by red dot type sight that they are working in conjunction with in one form or another when they are not in use.

All of these current solutions are also engineered solely to view target images reflected to the user provided by the sight, in other words, only to fire on targets from a safe, secure position, but none of these current solutions are engineered to function in front of the target viewing device that it is working in conjunction with, or in other words, to reflect the image of the target to the sight or target viewing device it is working in conjunction with to the user to do surveillance work or to locate targets of potential danger from a safe, secure position, so, in other words, the user would initially have to expose himself as a target to engage a target.

Initial target acquisition is very difficult with the present solutions as well, even if they have located their approximate position, in that they restrict or limit the full range or quality of the target image that they are receiving from the sight that they are working in conjunction with in one way or another, in that none of these devices offer a total unobstructed view of the target image and surrounding area receivable by the red dot sight they are working in conjunction with, in that the present solutions themselves partially block or restrict this image.

These devices also provide no solution to the user to easily achieve quick, proper mirror angle adjustment between target and firearm when time is critical.

The present higher tech solutions to this problem of being able to locate and engage a target without becoming a target have inherent problems as well in that they consist of multiple bulky components and electronic devices that all take up space as well as add additional weight to a soldier's already heavy load. These higher tech solutions also employ components are exclusive to themselves and only function as a complete unit, so they are restricted to being used with either the type of firearm they were designed to be used with or the type of firearm that they become an integral part of which means there are no real options as far as whether they are being used with a rifle or a pistol or what caliber or type of firearm that can be used with these other current solutions. This means that they also have no options as far as types of target viewing devices that they are being used in conjunction with such as red dot sights, scopes, night vision devices, etc.

Another problem with the present higher tech solutions is in their exclusivity to the solution in that they employ combinations of very expensive high-tech components that are exclusive to their solution and the many high tech electronic components employed in them that cannot be supplemented, which not only limits their versatility and range of application and use but also create additional problems of dependability in that all of these components are dependent on each other to work as a functioning unit. This, along with the cost of repair, service, and maintenance of these solutions which quite often make these solutions unaffordable for most small entities such as militias, microstates, police departments, etc. or to even supply all of the soldiers in our own military with these currently available higher tech solutions for that matter.

Therefore a need exists for a device both to the effective use of surveillance that enables the user to maintain a clear lineal view in a full range of viewing angles of an area while remaining totally behind protective cover as well as enabling the user to the full accurate use of a firearm from any position that the user would have to position himself or herself in relation to the firearm, more particularly for a device that provides advanced methods and systems that enable combatants the ability to remain fully behind protective cover while having the ability to both locate targets of potential danger as well as accurately fire around a wall, vehicle, or any other bullet proof structure combatant is taking protective cover behind without having to expose himself or herself as a target while doing so. Various solutions to this problem have been proposed in the literature of this patent application.

SUMMARY OF THE INVENTION

The present invention overcomes the deficiencies of the known art and the problems that remain unsolved by providing a firearm accessory as disclosed herein.

A rotationally deployable firearm accessory comprising: a mirror base having a mirror attached thereto such that the mirror base is rotationally disposed upon an axle such that the axle is associated with a sleeve rotationally disposed upon a bearing.

In another aspect, further comprising: a first tightening knob assembly where a portion thereof is fixedly attached to the sleeve and wherein the first tightening knob assembly houses a portion of the axle.

In another aspect, further comprising: a second tightening knob assembly where a portion thereof is fixedly attached to the sleeve and on an opposite side of the sleeve as to the first tightening knob assembly and wherein the second tightening knob assembly houses another portion of the axle.

In another aspect, further comprising: a friction pad assembly integrally disposed upon on edge of the mirror base and in contact with the sleeve.

In another aspect, further comprising: a lock assembly integrally disposed upon on edge of the mirror base and in contact with the sleeve.

In another aspect, further comprising: a first annular protrusion extending outwards from an edge of the sleeve.

In another aspect, further comprising: a second annular protrusion extending outwards from an edge of the sleeve at a position opposite to the first annular protrusion and in coaxial orientation thereto.

In another aspect, further comprising: a first friction component housing integrally attached to a side of the mirror base.

In another aspect, further comprising: a second friction component housing integrally attached to a side of the mirror base.

In another aspect, wherein the axle further comprises a first axle portion such that the first axle portion is placed through a hole in the first friction housing component and on into a first annular protrusion extending outwards from an edge of the sleeve.

In another aspect, wherein the axle further comprises a second axle portion such that the second axle portion is placed through a hole in the second friction housing component and on into a second annular protrusion extending outwards from an edge of the sleeve.

A weapons reflector device comprising: a rotational bearing having a sleeve mounted thereon; an axle associated with the rotational bearing and to a mirror base having a mirror attached thereto such that the mirror base is rotationally associated with the axle.

In another aspect, wherein the rotational bearing further comprises: an actuation surface having actuation positions.

In another aspect, wherein the mirror base further comprises: a first actuation surface having first actuation positions.

In another aspect, wherein the rotational bearing further comprises: a second actuation surface having second actuation positions a lock attached to the mirror base such that the lock actuates first and second clutch actuations positions.

In another aspect, wherein the axle further comprises: frictional members associated therewith and controlled by a manual knob.

A weapon mountable assembly comprising: a bearing having a sleeve mounted thereon upon a narrow portion of the bearing wherein the sleeve is rotationally associated with the bearing; a reflector attached to the sleeve through a first armature.

In another aspect, further comprising: a second armature attached to the reflector at an opposite side of the reflector than the first armature is attached thereto wherein the second armature is also attached to the sleeve at an opposite portion of the sleeve that the first armature is attached thereto.

In another aspect, further comprising: a friction engaging knob associated with the first armature.

These and other aspects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, in which.

FIG. IA presents an embodiment of a Rotationally Deployed Non-Blocking Firearm Accessory. FIG. IB shows the annular protrusions 14 integrally formed with sleeve 5 and threaded housing and knobs. FIG. IC shows the bearing 6A its neck 6B and its back portion 6.

With the mirror portion there of adjusted to an angle of 45 degrees

Figure 3:
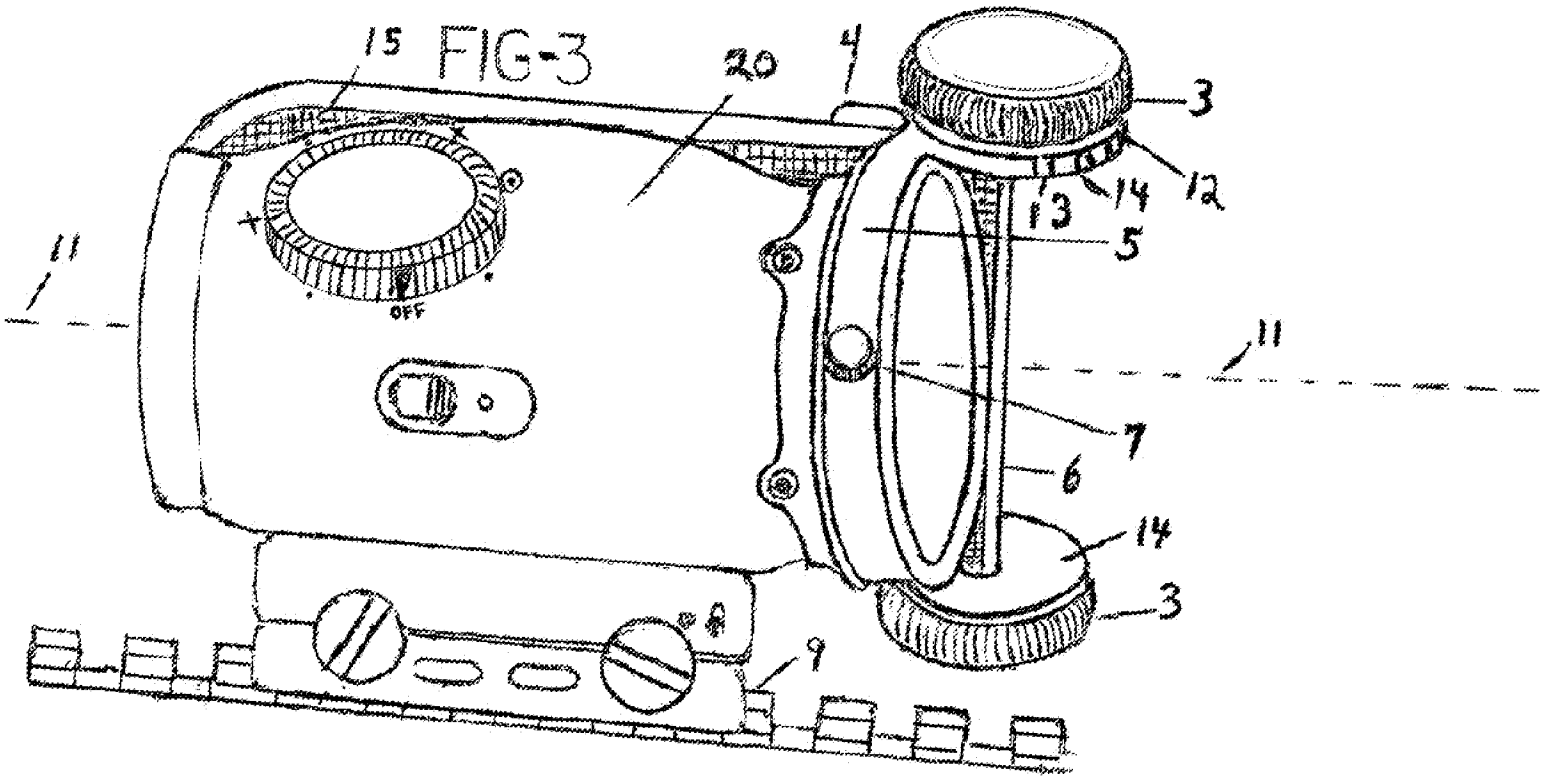
Figure 4:
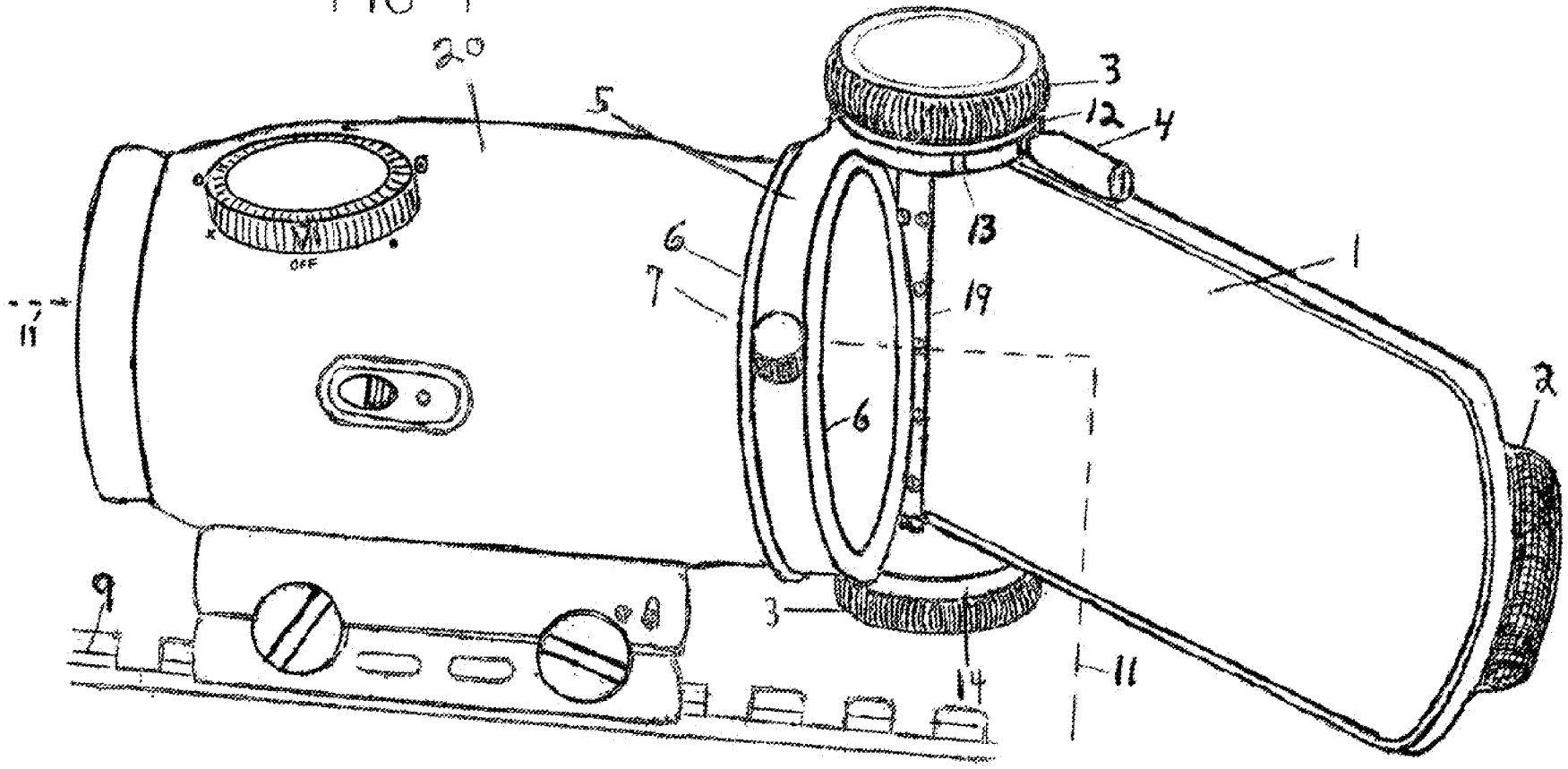

FIG. 3 presents an alternative embodiment showing the accessory rail mounted on a firearm. With its mirror portion rotated and locked or popped into its position of non-use FIG. 4 presents an alternative embodiment showing how the accessory is an integral part of a firearm viewing device.

Figure 5:
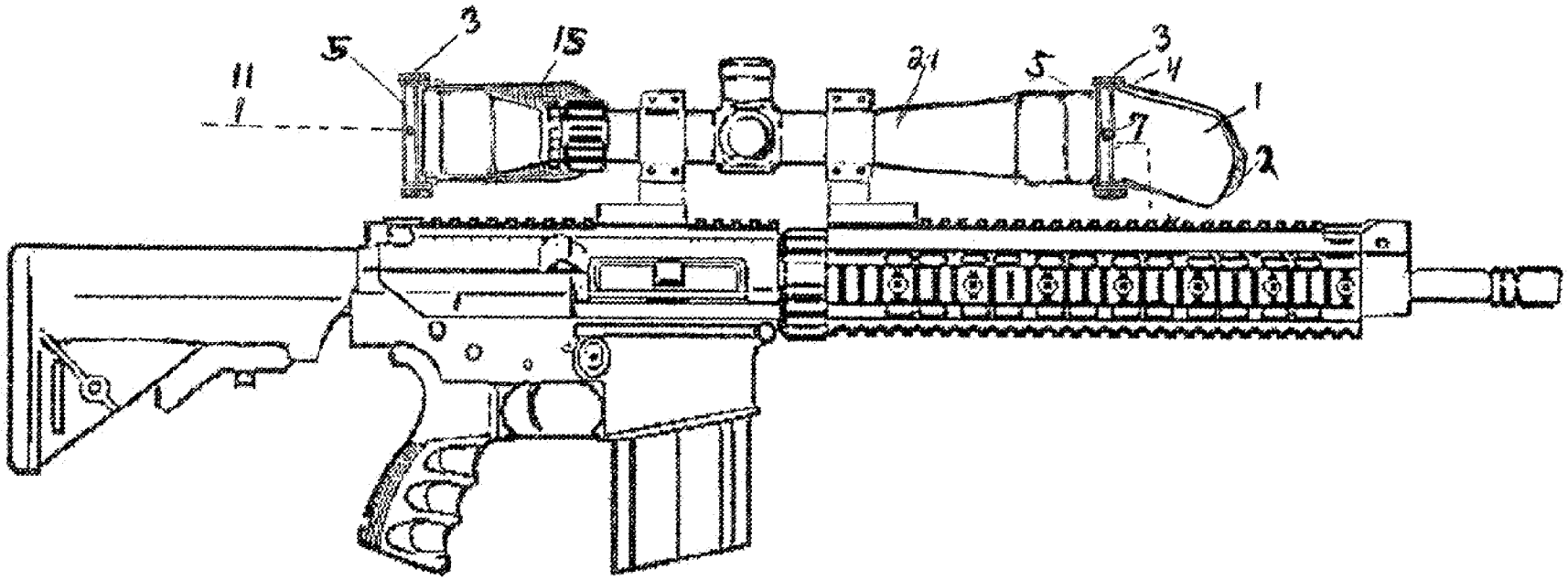
Figure 6:
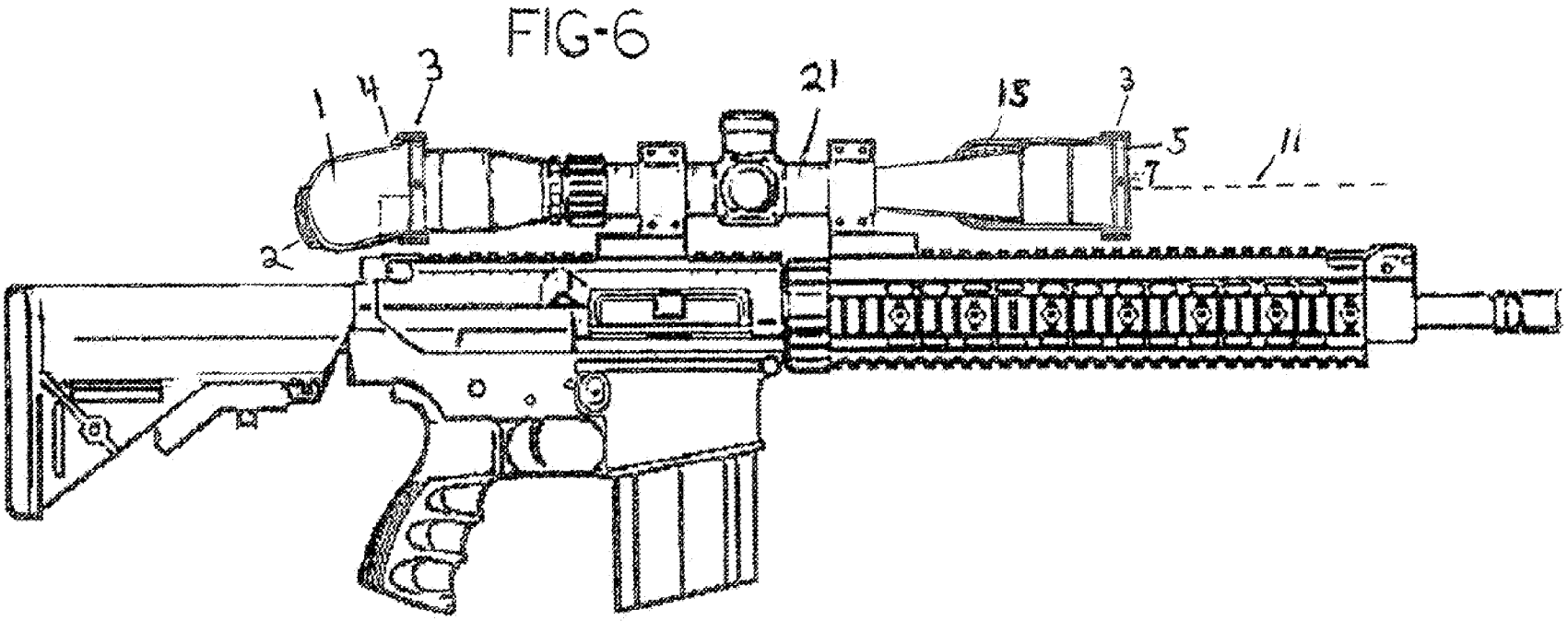
Figure 7:
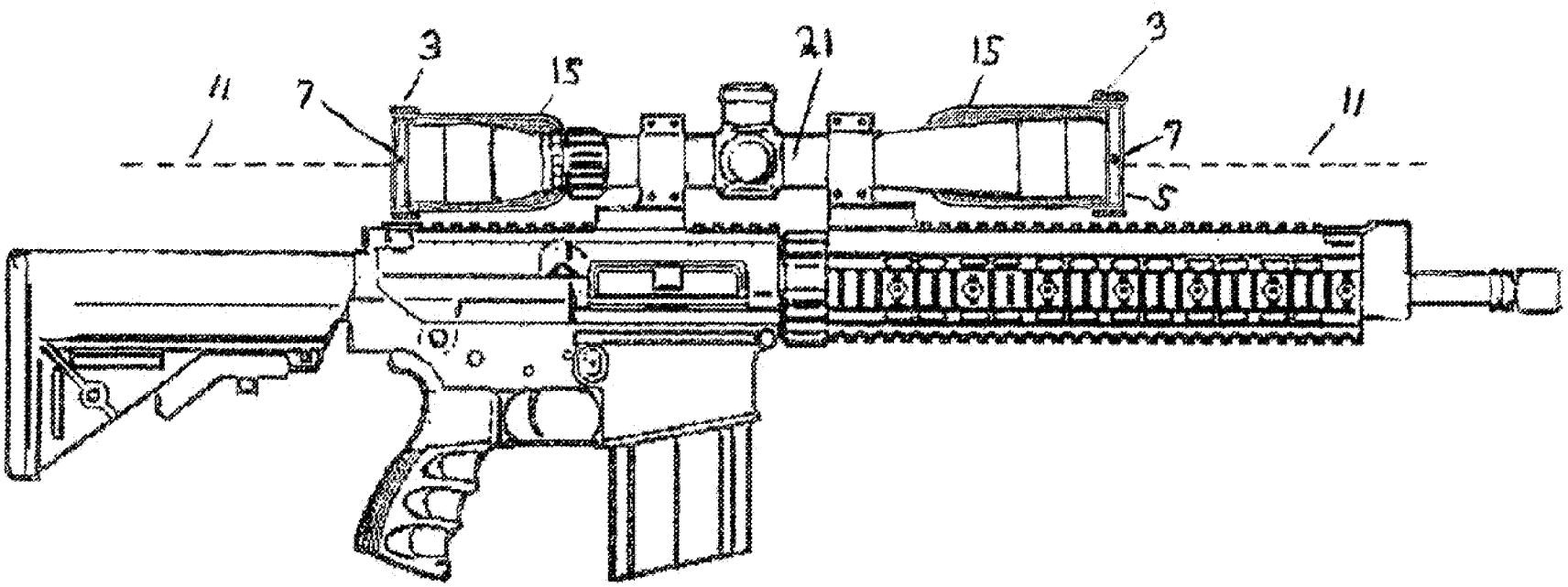
Figure 8:
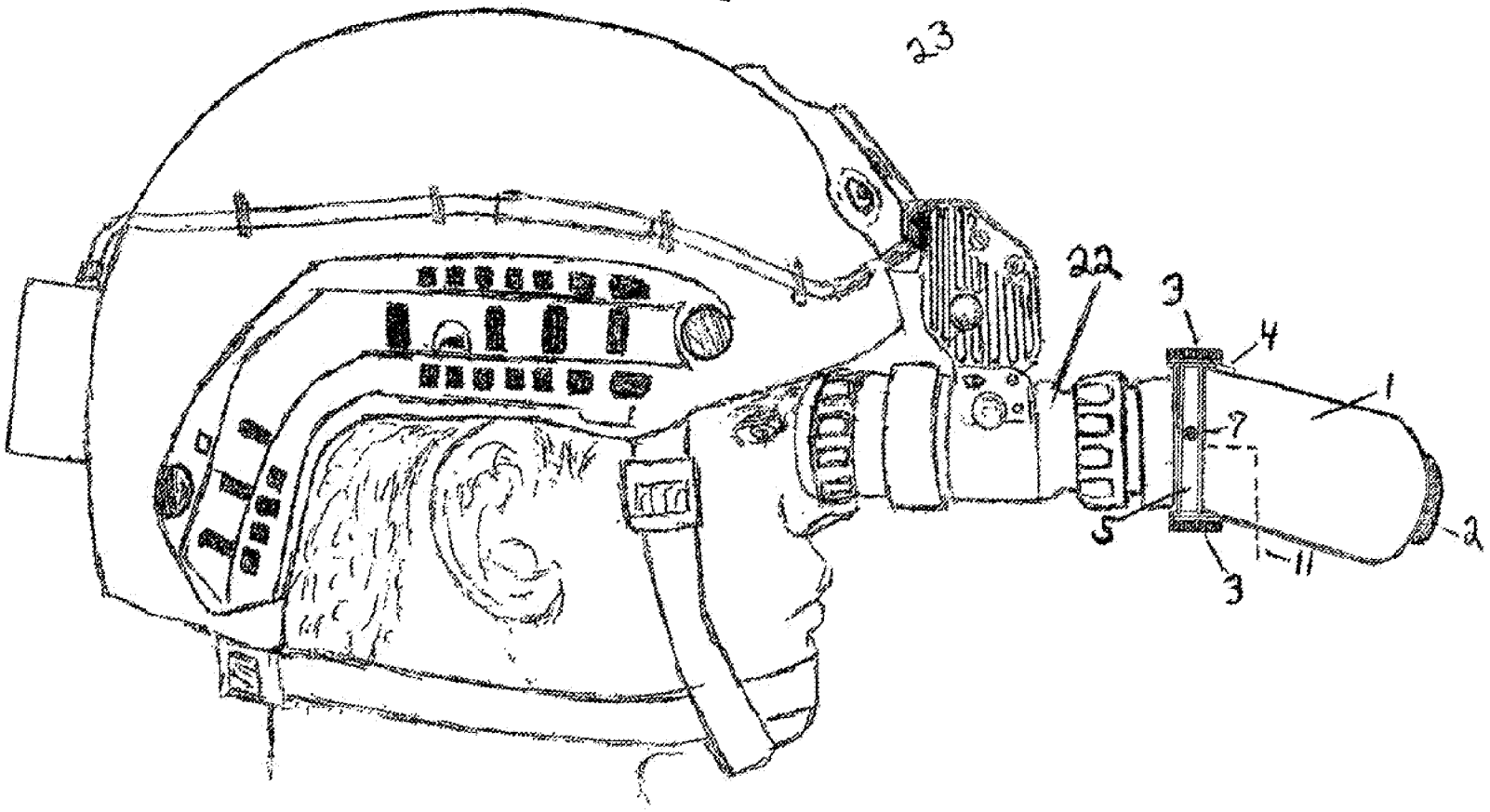
Figure 9:
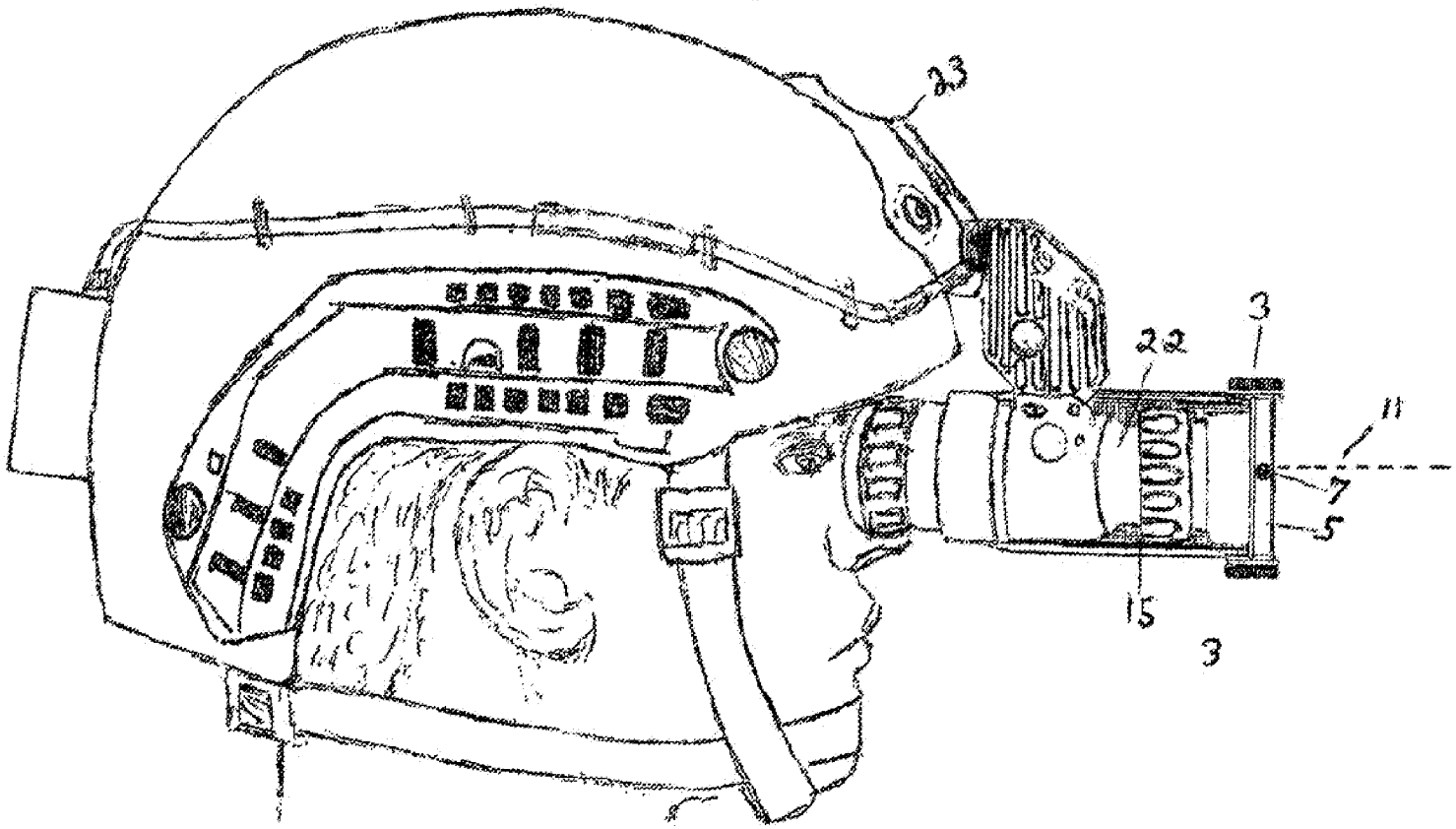

FIG. 5 presents an alternative embodiment showing how the accessory is alternatively mounted on both the front and rear of scope of a firearm. With the rearward accessory rotated and locked or popped into its storage or position of non-use and the forward accessory adjusted in and being used such as for surveillance purposes FIG. 6 presents an alternative embodiment showing how the accessory is alternatively mounted on both the front and rear of scope on firearm. With the forward accessory rotated back into its position of nonuse and the rearward mounted accessory In use as to view targets from off to the side of the firearm FIG. 7 presents an alternative embodiment showing how the accessory is alternatively mounted on both the front and rear of scope on firearm. With both accessories locked into a position of non deployment FIG. 8 presents an alternative embodiment showing how the accessory is alternatively mounted on or made as an integral part of a night vision device that is attached to a standard helmet mount with its mirror assembly locked into a position of non-deployment FIG. 9 presents an alternative embodiment showing how the accessory is alternatively mounted on or made as an integral part of a night vision device that is attached to a standard helmet mount and being deployed FIG. 10 presents an alternative embodiment showing some frictions portions separated from of the accessory for a better understanding thereof.

Figure 10:
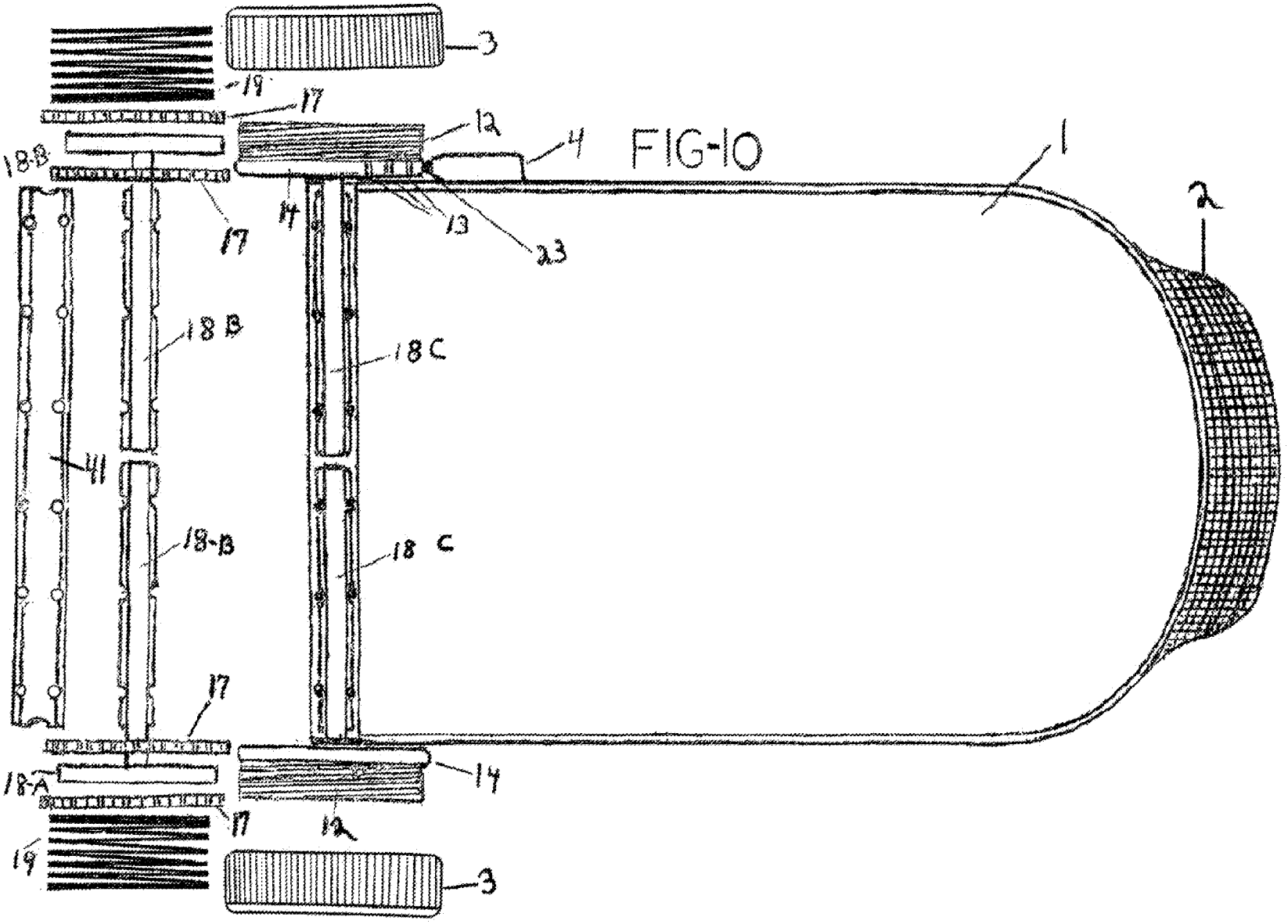
Figure 11:
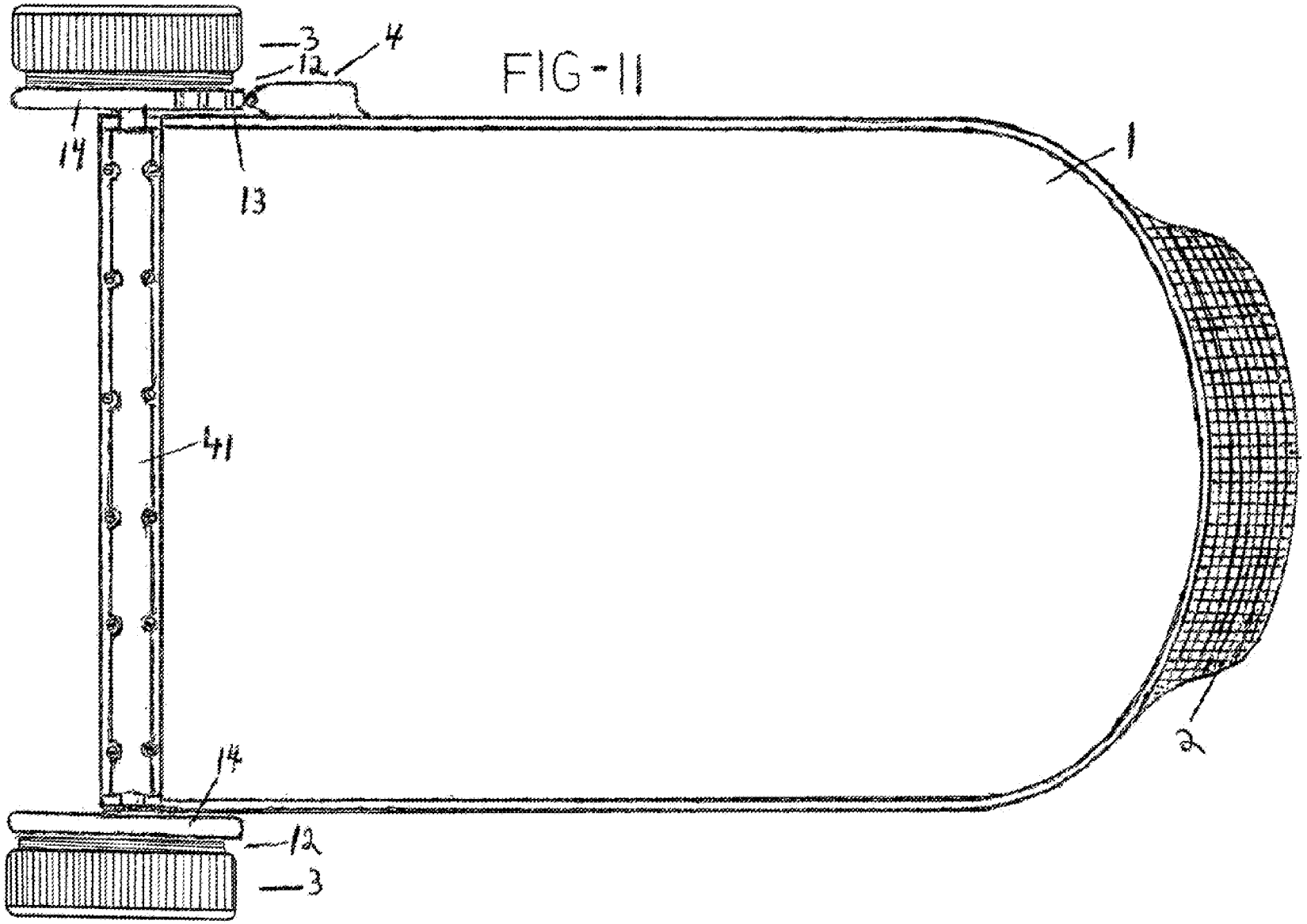

FIG. 11 presents an alternative embodiment with all friction components shown in FIG. 10 assembled back into the accessory.

FIG. 12A presents a top view of the accessory with mirror at an angle showing splined internal surfaces 16 of friction disk housing with knob and disk axle 18 removed. FIG. 12B presents a top view of a friction disk 17 having a hole for insertion into axle 18 having depressions and ridges for placement into friction disk housing splines. FIG. 12C presents a topview of splined internal surfaces 16 of friction disk housing with knob and disk axle 18 removed. FIG. 12D presents a top view of axle 18. FIG. 12E presents a top view of the friction disk housing having a friction disk loaded underneath the axle top portion 18A on the axle 18B through a hole in the friction disk 17.

FIG. 12F presents a side view of axle 18 showing its top disk 18A and axle portion 18B thereof. FIG. 12G presents a friction disk 17 having no central hole for mounting atop the disk axle top portion 18A. FIG. 12H presents a top view of a friction disk 17 having no central hole mounted atop the disk axle top portion 18A within a friction disk housing 12. FIG. 12I presents a spring and compression pad FIG. 12J presents an inside bottom view of the knob 3. FIG. 12K shows the top portion of knob 3

Figure 13A:
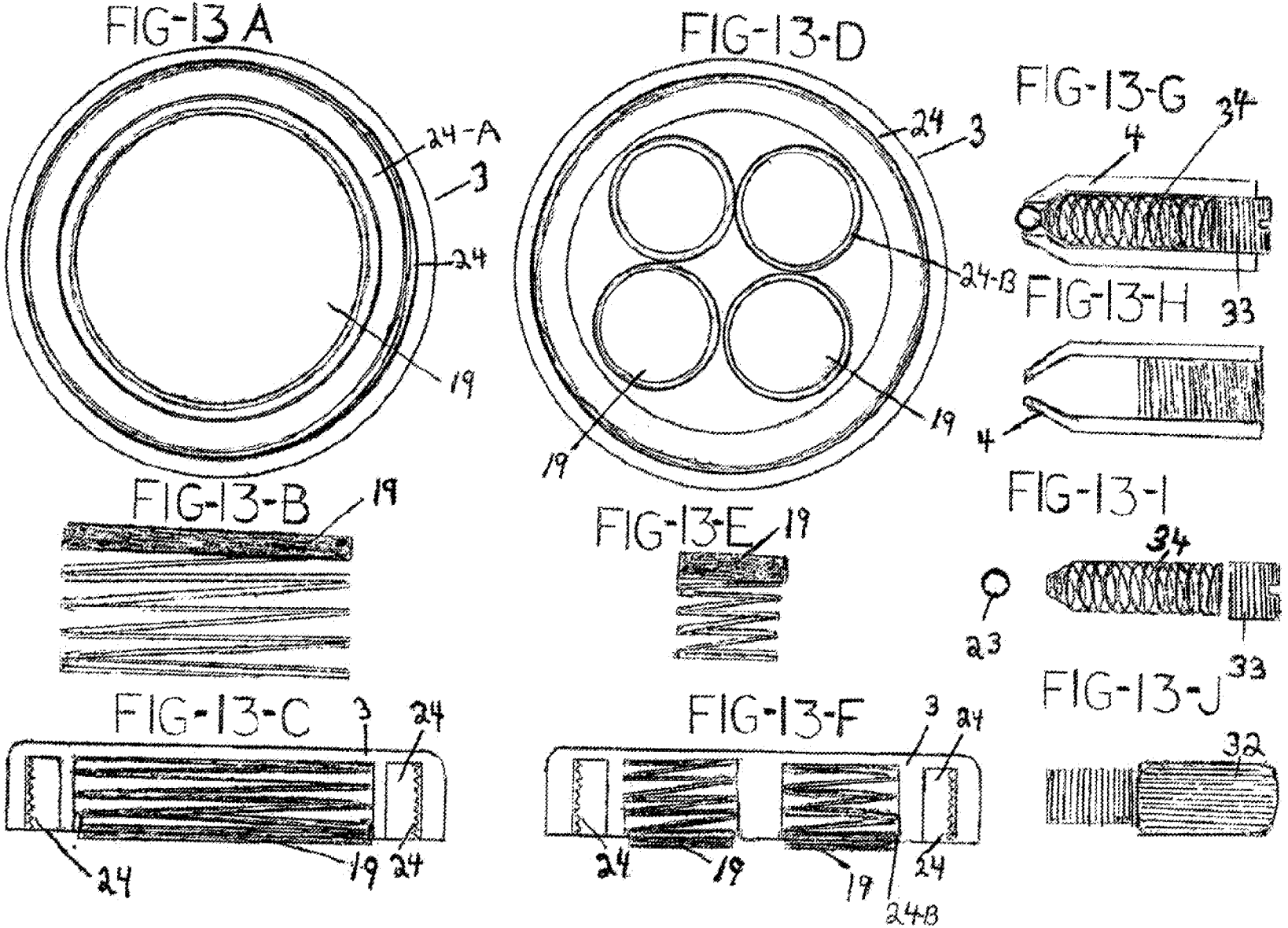

FIG. 13A presents a bottom view of knob 3 showing internal threads 24 and a bottom portion of a compression plate or pad 19 that has been mounted onto a spring; the view also shows how an inner space has been made by an internal cylindrical portion 24A separating the spring loaded within this inner space from the threads 24. FIG. 13B presents a side view of a spring having a friction pad 19 loaded thereon. FIG. 13C presents a side cross section view of knob 3 showing internal threads 24 and a bottom portion of a pad 19 that has been mounted onto a spring; the view also shows how an inner space has been made by an internal cylindrical portion 24A separating the spring loaded within this inner space from the threads 24.

FIG. 13D presents a bottom view of knob 3 showing internal threads 24 and a bottom portion of pads 19 that have been mounted onto a spring; the view also shows how inner spaces have been made by internal cylindrical portions 24B separating the springs loaded within these inner spaces from the threads 24. FIG. 13E presents a side view of a spring having a friction pad 19 loaded thereon. FIG. 13F presents a side cross section view of knob 3 showing internal threads 24 and a bottom portion of pads 19 that has been mounted onto a spring; the view also shows how inner spaces have been made by an internal cylindrical portions 24B separating the springs loaded within this inner spaces from the threads 24.

Figure 14:
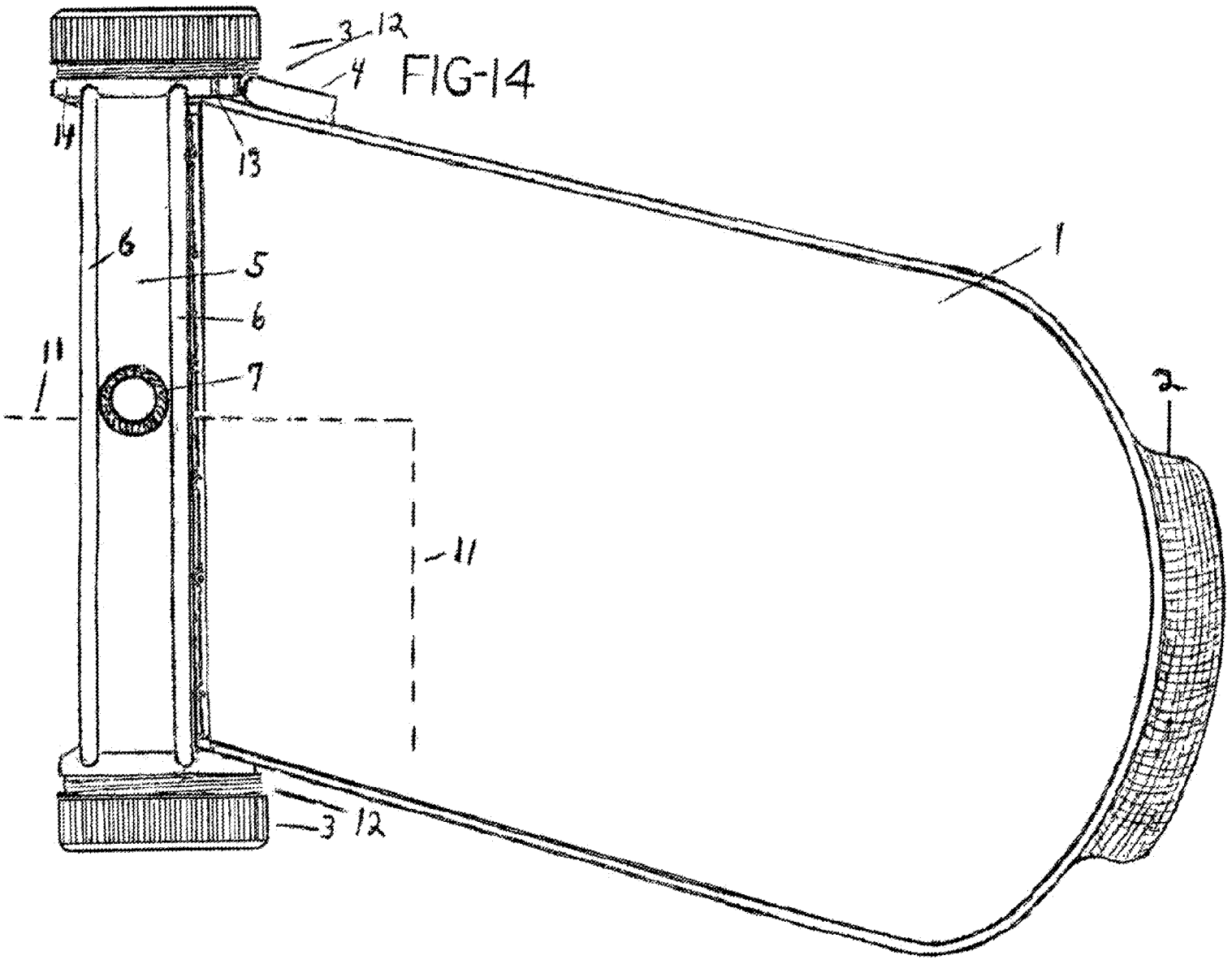

FIG. 13G presents an embodiment having a side cross section view of a container 4 that is further closed at one end by a screw 33 inserted in a threaded end of the container thereof. FIG. 13H presents a cross section view of FIG. 13G with the spring and ball removed. FIG. 131 presents a side view of the ball, spring and threaded screw. FIG. 13*j* presents an alternative embodiment of a side view of a spring 34 for container 4 being adjustable by a threaded knob;

FIG. 14 presents an alternative embodiment showing the adjustment to a 45 degree of the accessory with respect to a firearm.

Figure 15:
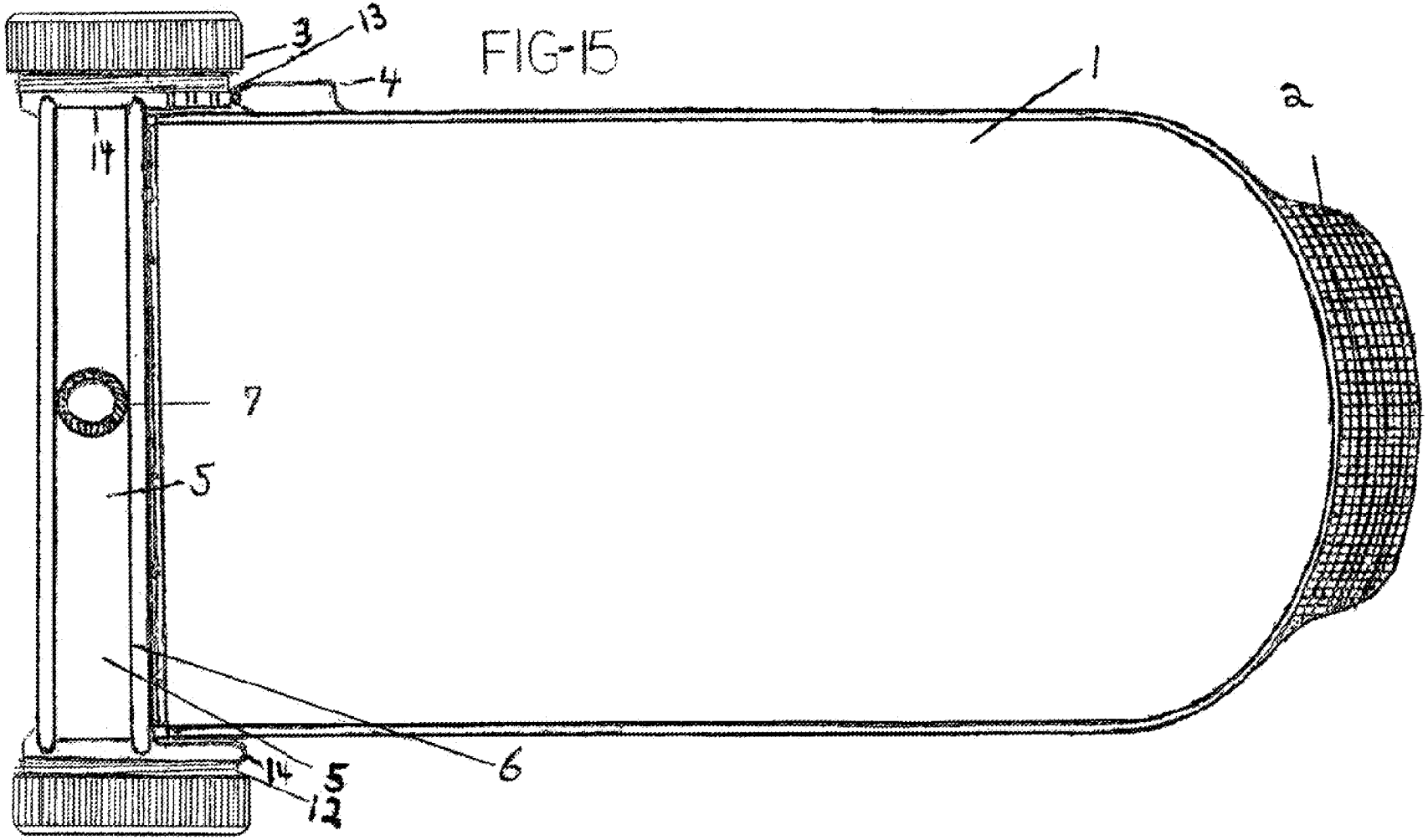

FIG. 15 presents an alternative embodiment showing mirror extended straight out; there is only one digital mirror positional indicator #4 on an edge of a mirror base.

Figure 16:
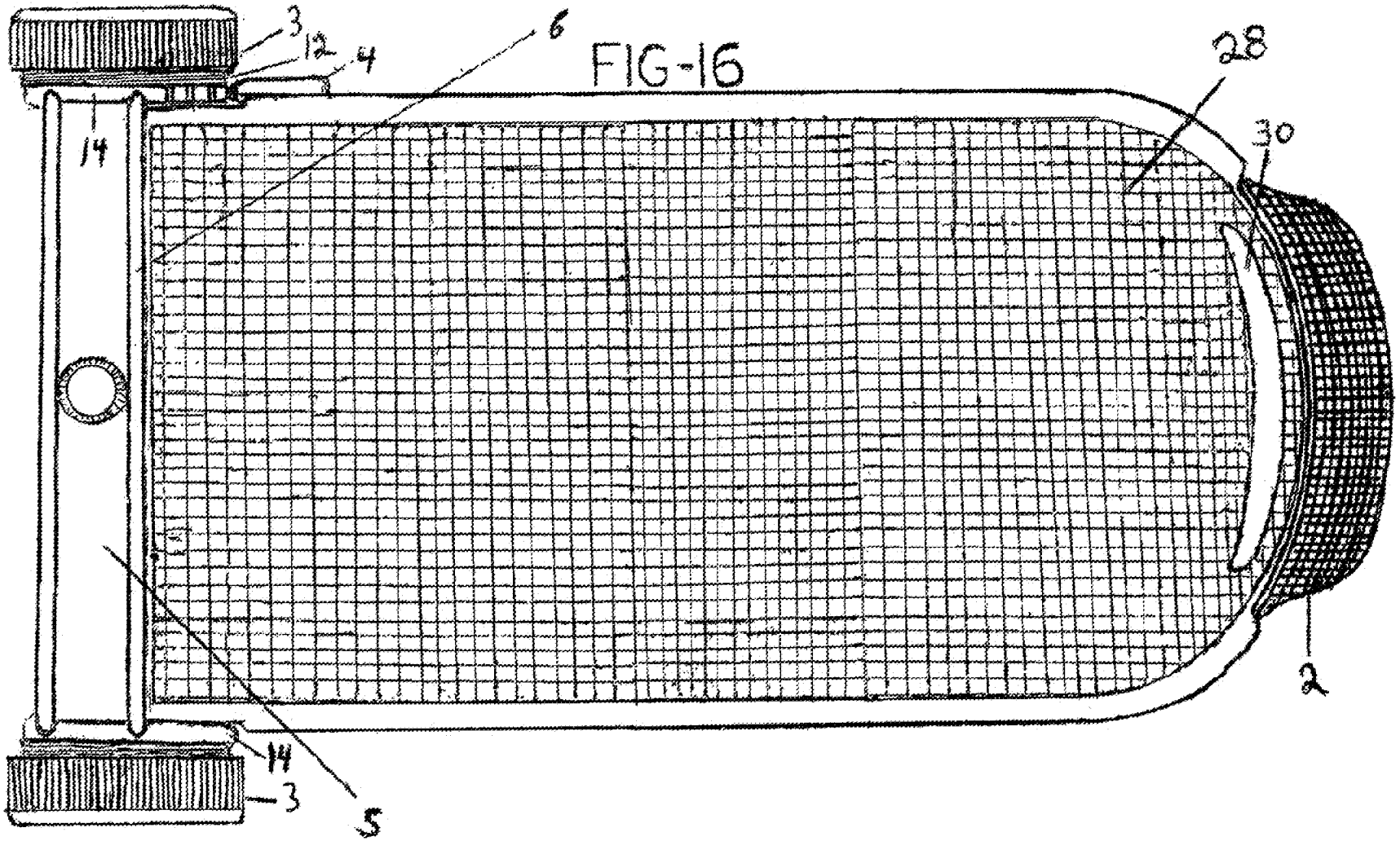

FIG. 16 presents an alternative embodiment showing the accessory having a mirror cover loaded onto the mirror reflective side portion of the accessory.

Figure 17:
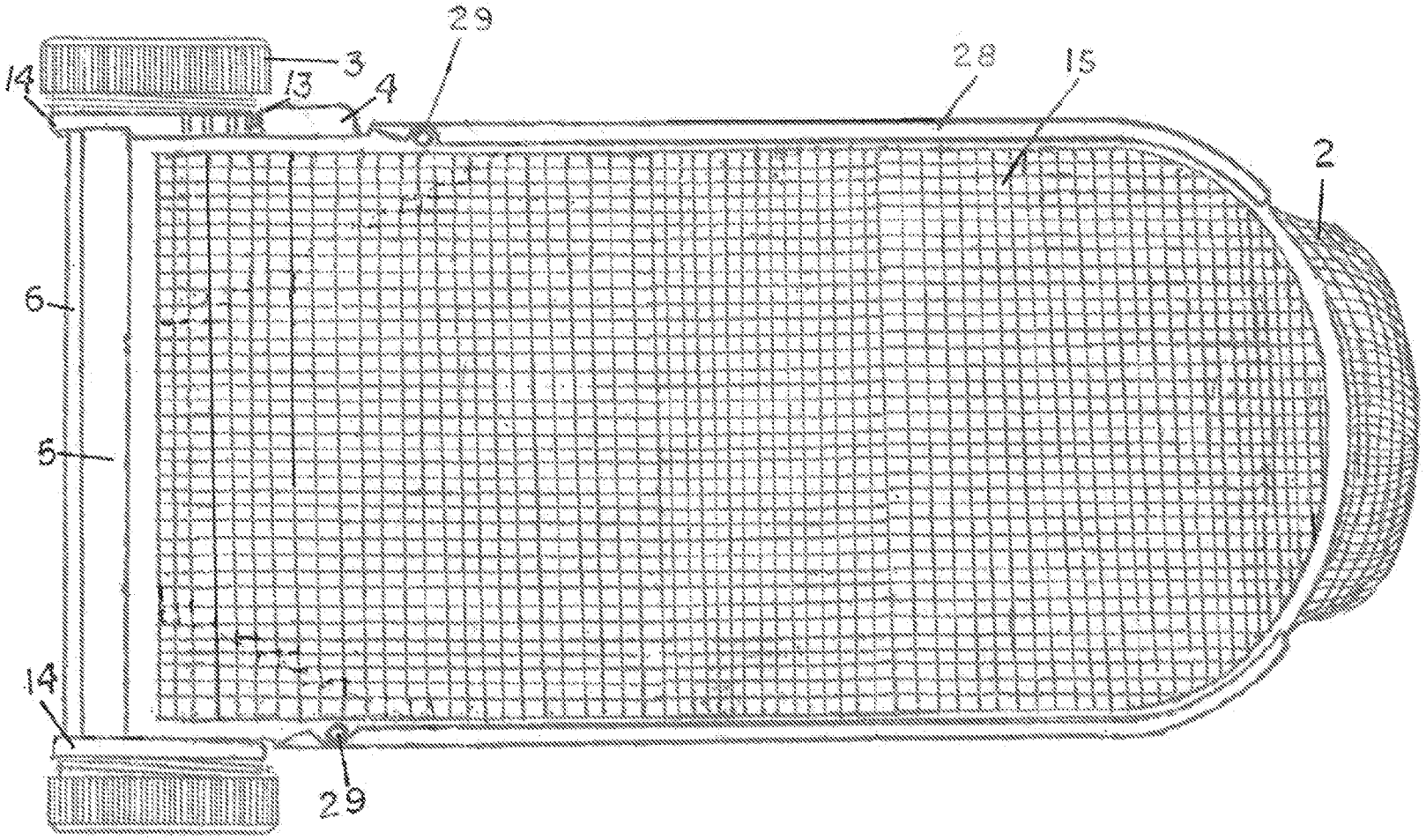

FIG. 17 presents an alternative embodiment showing the accessory having a mirror cover loaded onto the back of the mirror portion of the accessory with loading protrusions 29 helping to hold the cover in place.

Figure 18:
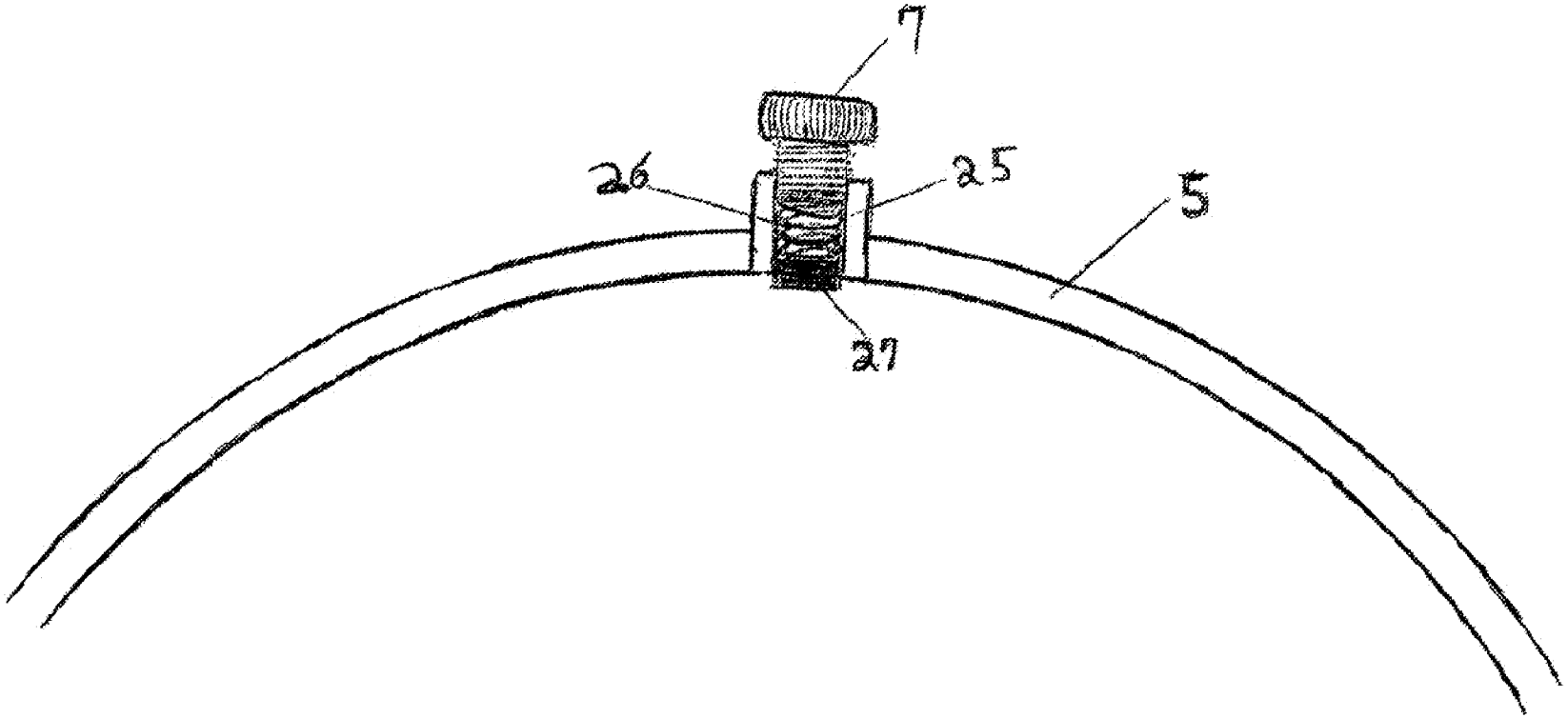
Figure 19:
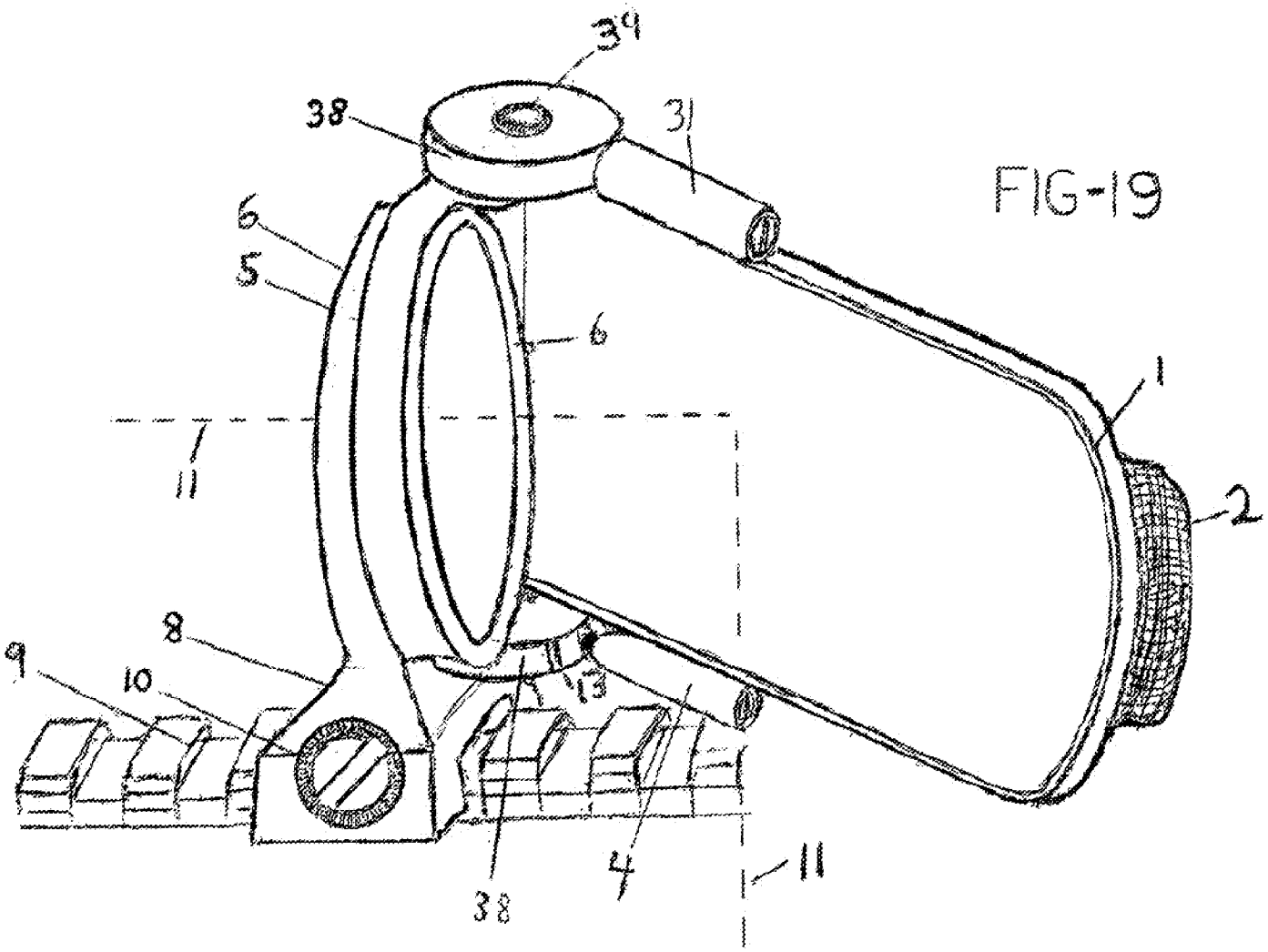

FIG. 18 presents an alternative embodiment showing a rotational sleeve 5 with rotational drag or friction controlling device with spring loaded friction pad FIG. 19 presents a perspective view of an alternative embodiment showing a friction assisting device as well as a spring acting ball device helps control rotation of the mirror accessory in a rail mounted configuration.

Figure 20:
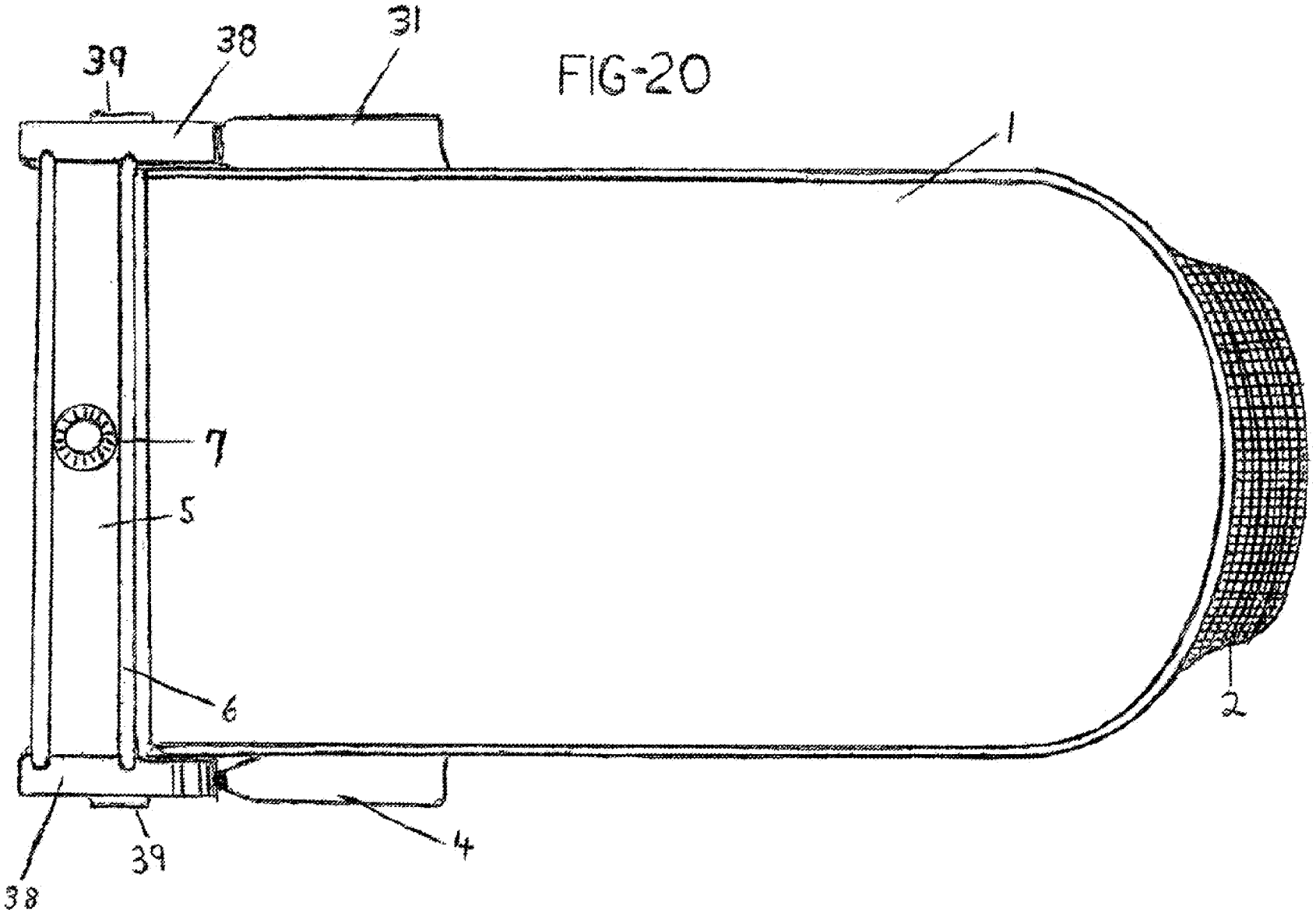

FIG. 20 presents a side view of an accessory having friction pad container and friction ball container in an alternative embodiment as taught herein.

Figure 21:
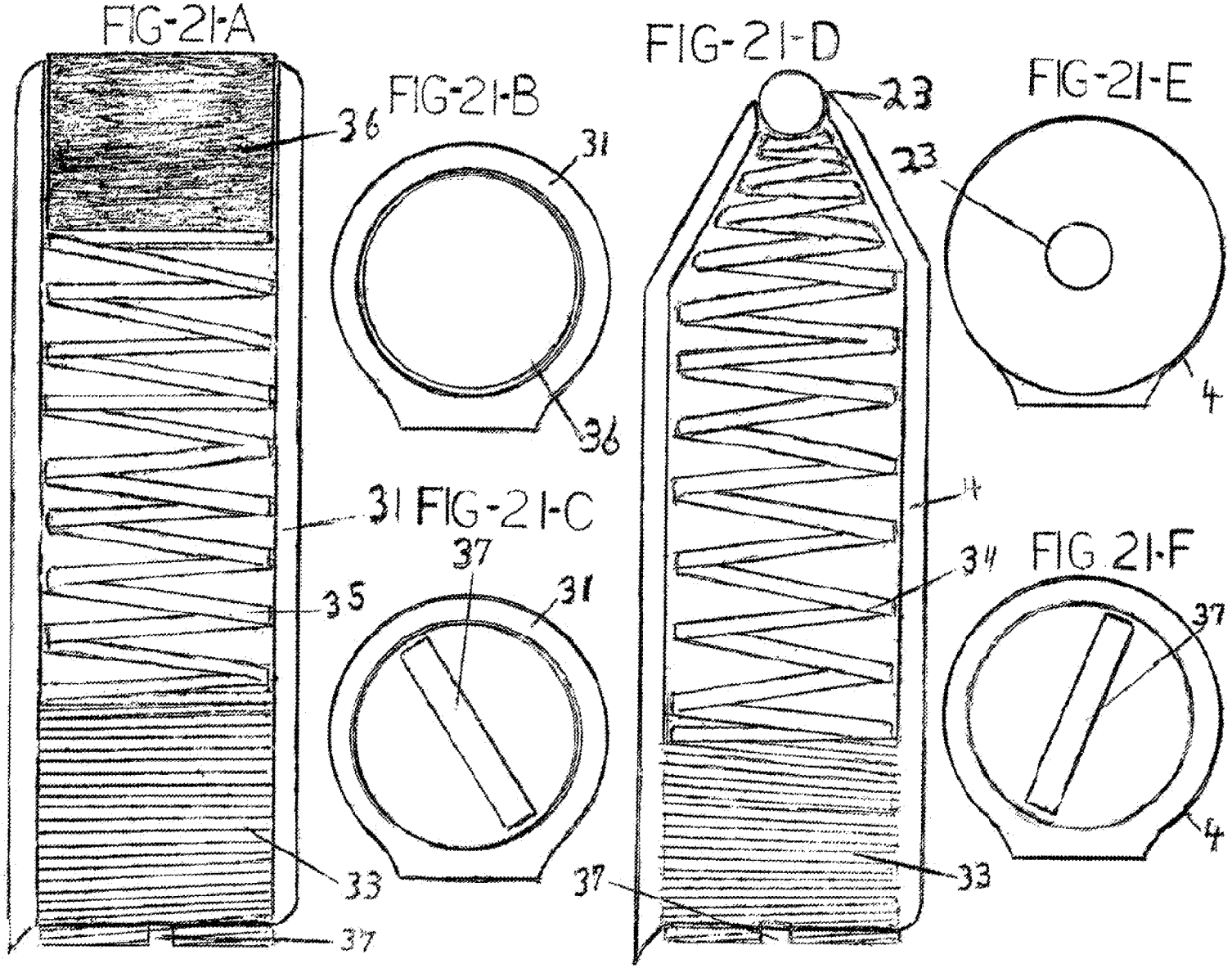

FIG. 21A present a cross section side view of a friction pad container having a friction pad pressed against by a spring tension adjusted by a screw having threads matching internal threads of container. FIG. 21B presents a front view of a friction pad container showing the friction pad therein. FIG. 21C presents a back view of a friction pad container showing the insertable screw mounted therein. FIG. 21D presents a side cross section view showing a ball container acted on by a spring loaded in the container tensioned by a screw having threads matching internal threads of the container. FIG. 21E presents a front view of a ball container showing the ball mounted therein. FIG. 21F presents a back view of a ball container showing the insertable screw mounted therein.

FIG. 22A present a side view of the mirror 1 and base 15 having a dual depression thereon for placement of axles one each in the depressions. 41 A FIG. 22B shows a front side view of an axle cover having holes therein for insertion of screws therein. FIG. 22C presents aback side view of an axle cover. FIG. 22D presents a side view of a top axle insert able in a depression of the base 15. FIG. 22E presents a side view of a bottom axle insert able in a depression of the base 15. FIG. 22F presents a side view of a top cover.

Figure 23:
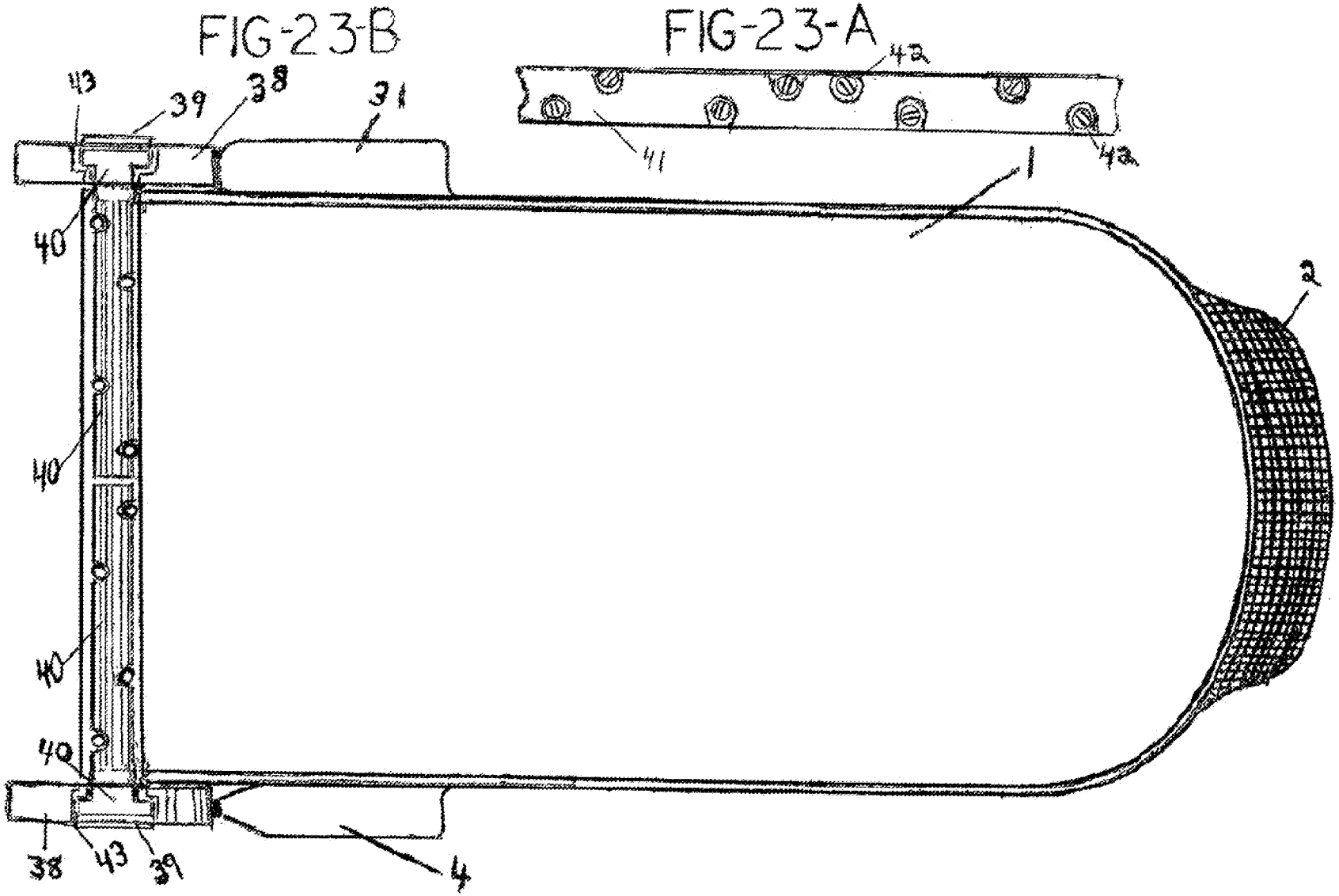
Figure 24:
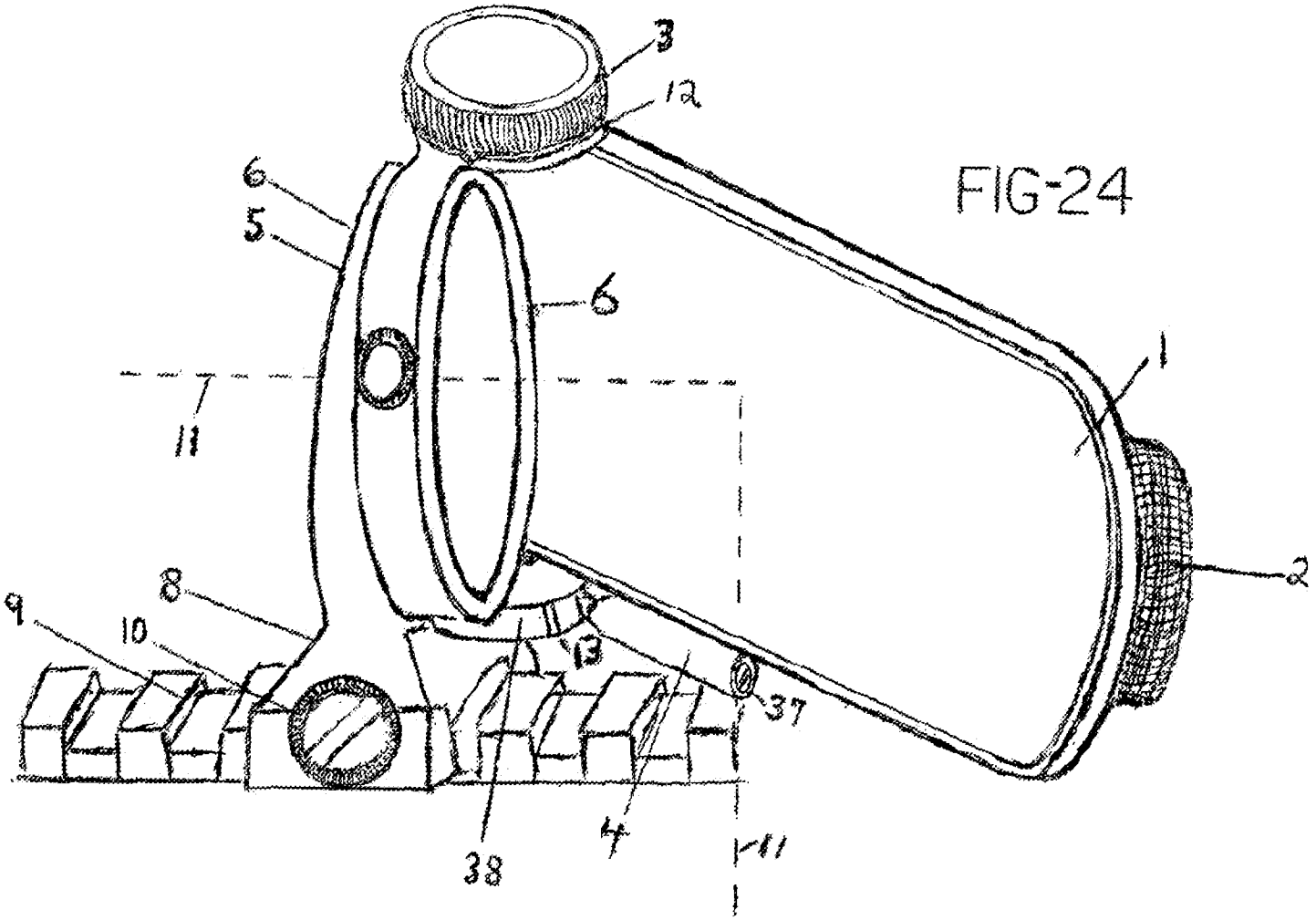

FIG. 23A shows a back side of cover having holes therein for insertion of screws 42. FIG. 23B present a side cross section view of axles 40 each mounted within a corresponding depression of the mirror base with the axle head also mounted in a bearing space 43 made within the mount housing of sleeve 38 and the other axle and head mounted on its opposite housing 43 coaxially disposed on sleeve 38 which is integral with 5 rotating collet or bearing FIG. 24 presents an illustration showing a rail mounted configuration with mirror set at 45 degrees to view targets at 90 degrees in relationship to firearm.

Figure 25:
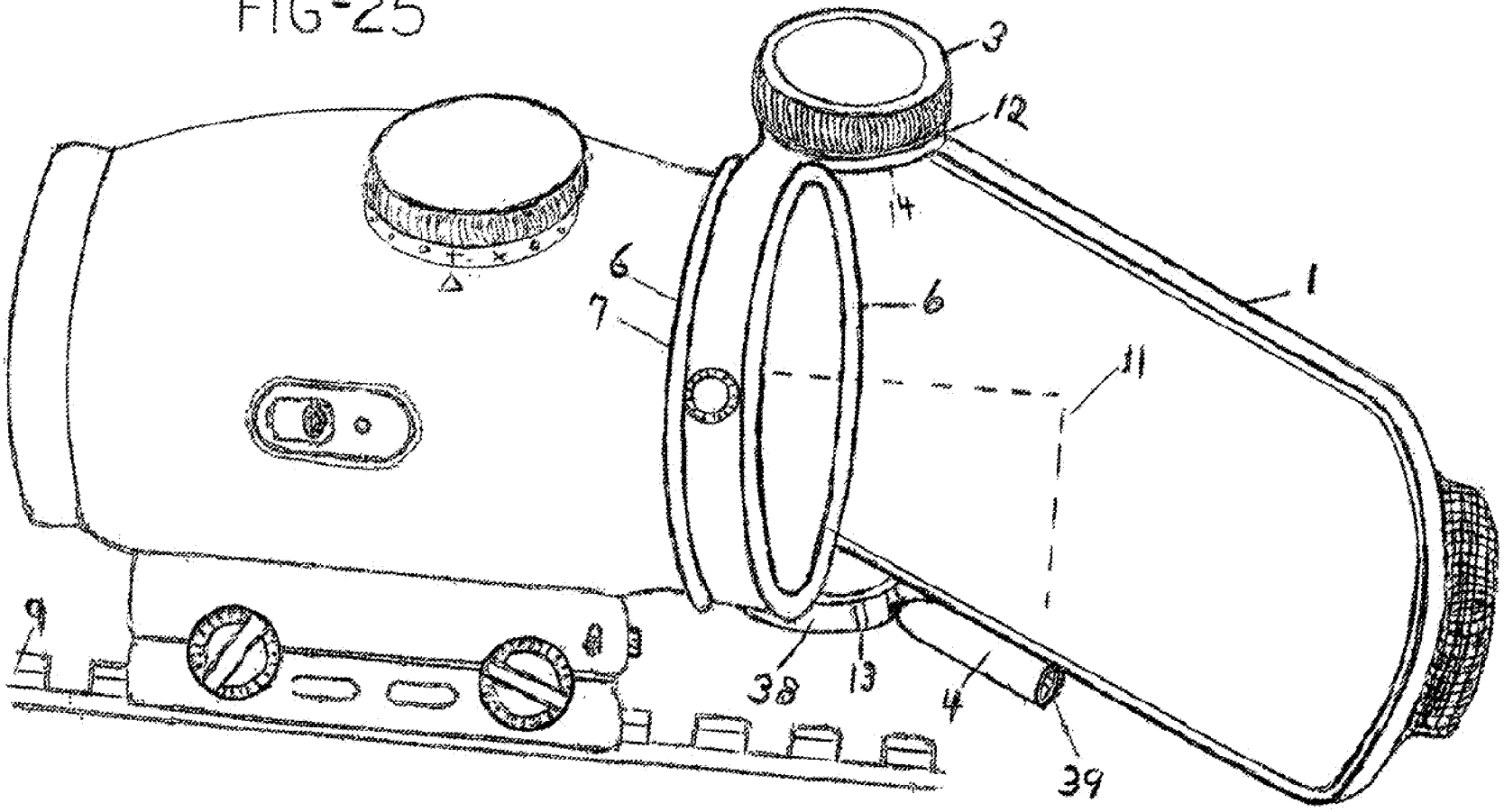

FIG. 25 is illustration showing invention in configuration that would be made as an integral part of a red dot type sight and mirror set at 45 degrees to view targets at 90 degrees in relationship to firearm.

Figure 26:
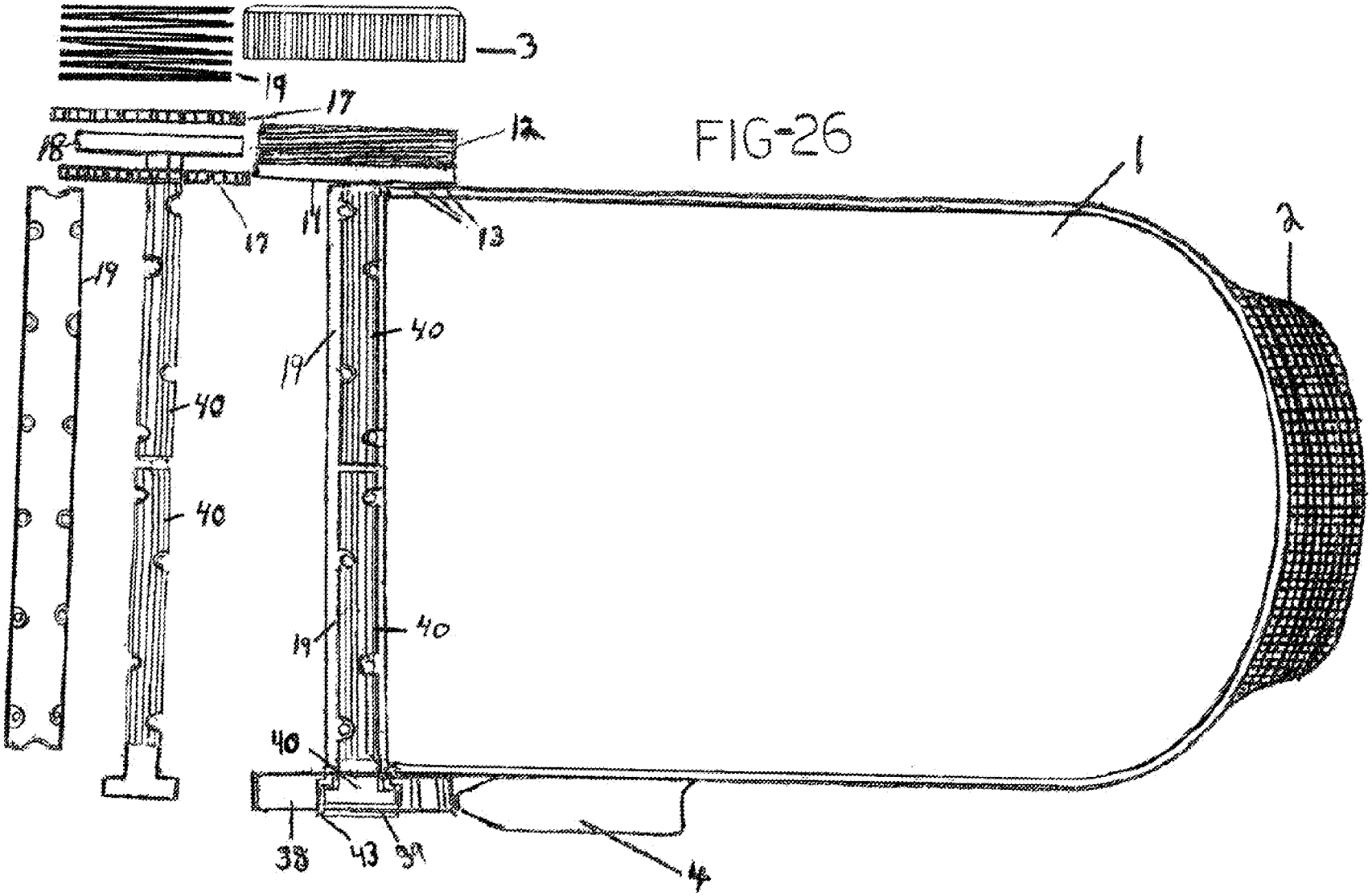

FIG. 26 presents a side view of an alternative embodiment having a tensioning knob 3 as well as the housing 12 therefore mounted on an annular disk 14 for ball activation from container 4. Additionally, this view shows a protruding axle design for axle 40 mounted with flanged head within bearing space 43 using disk 39 to be ball actuated from container 4 at the bottom portion of the device.

Figure 27:
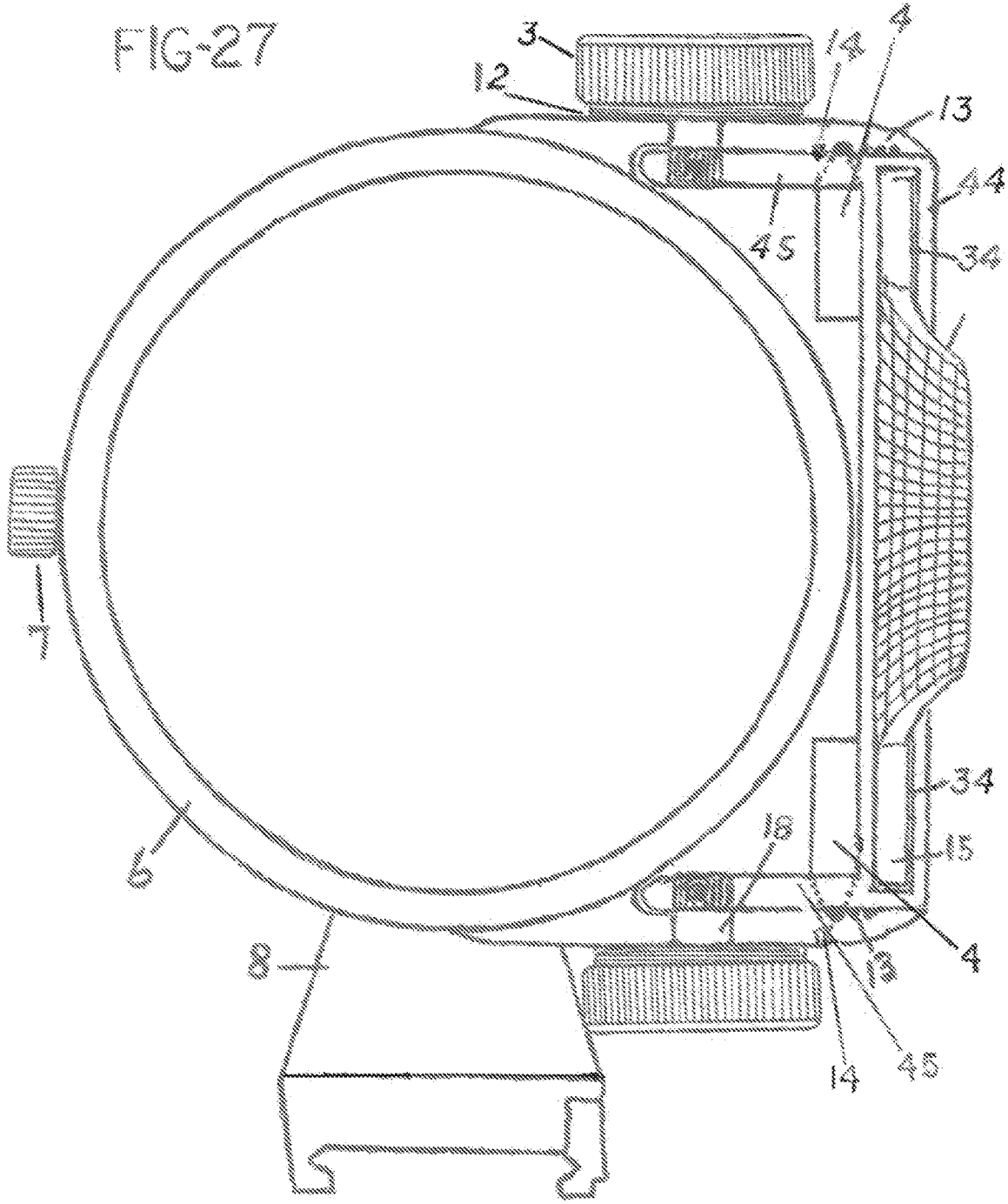

FIG. 27 presents a front view of a slidable and rotating mirror accessory in an alternative embodiment taught herein.

FIG. 28A presents a top view of a slidable and rotating mirror accessory in an alternative embodiment taught herein where the mirror and base have been translated forwards using a sliding system. FIG. 28B presents a slidable and rotating mirror accessory in an alternative embodiment taught herein where the mirror and base have been translated backwards using a sliding system. And thusly locking the mirror assembly into a position of non-use FIG. 29A presents a front side view of a slidable mirror and base extended outwards in an alternative embodiment taught herein. And locked into its position of deployment FIG. 29B presents a front side view of a slidable mirror and base extended inwards in an alternative embodiment taught herein. And locked into its position of non-deployment FIG. 29C presents a back side view of a slidable mirror and base extended outwards in an alternative embodiment taught herein. FIG. 29D presents a back side view of a slidable mirror and base extended inwards in an alternative embodiment taught herein.

FIG. 30A present a top view of a slidable and rotatable mirror and base in an alternative embodiment herein showing spring loaded ball actuation transverse to the motion of the mirror and base popping mirror into a desired angle of use. FIG. 30B present a top view of a slidable and rotatable mirror and base in an alternative embodiment herein showing spring loaded ball actuation transverse to the motion of the mirror and base stepped backwards along the actuation surface popping mirror into an alternate angle of use FIG. 31A presents a front view of a rotational sleeve, bearing and rail mount having attachment points for a mirror base and slidable mirror as taught herein in an alternative embodiment. FIG. 31B presents a side view of a pad 19 loaded on a spring. FIG. 31C presents a side view of a knob for tension adjusting a housing 12. FIG. 31D presents a bottom view showing an inner cylindrical portion integrally formed from the inner top surface; this inner cylindrical portion has a spring and pad 19 abutting against it and the inner top surface thereof. FIG. 31E presents a top view of a friction disc 17 having depressions therein for splined surfaces internal to housing 12.

FIG. 31F presents a side view of a shortened axle 18S having a top disk portion. FIG. 31G presents a top view of a friction disc 17 having a hole therein having depressions thereon along its outer edge for splined portions of the housing 12. FIG. 31H presents a top view of a housing 12 having a friction pad 17 placed within housing 12 such that its depressions match corresponding splined ridges 16 within housing 12. FIG. 31I presents a sliding mirror assembly as taught in an alternative embodiment herein. FIG. 31J presents a side view of a spring activated ball device. FIG. 31K presents a side view of a threaded screw 25 member for tension adjusting the spring 24 activated ball 23 device.

Figure 32:
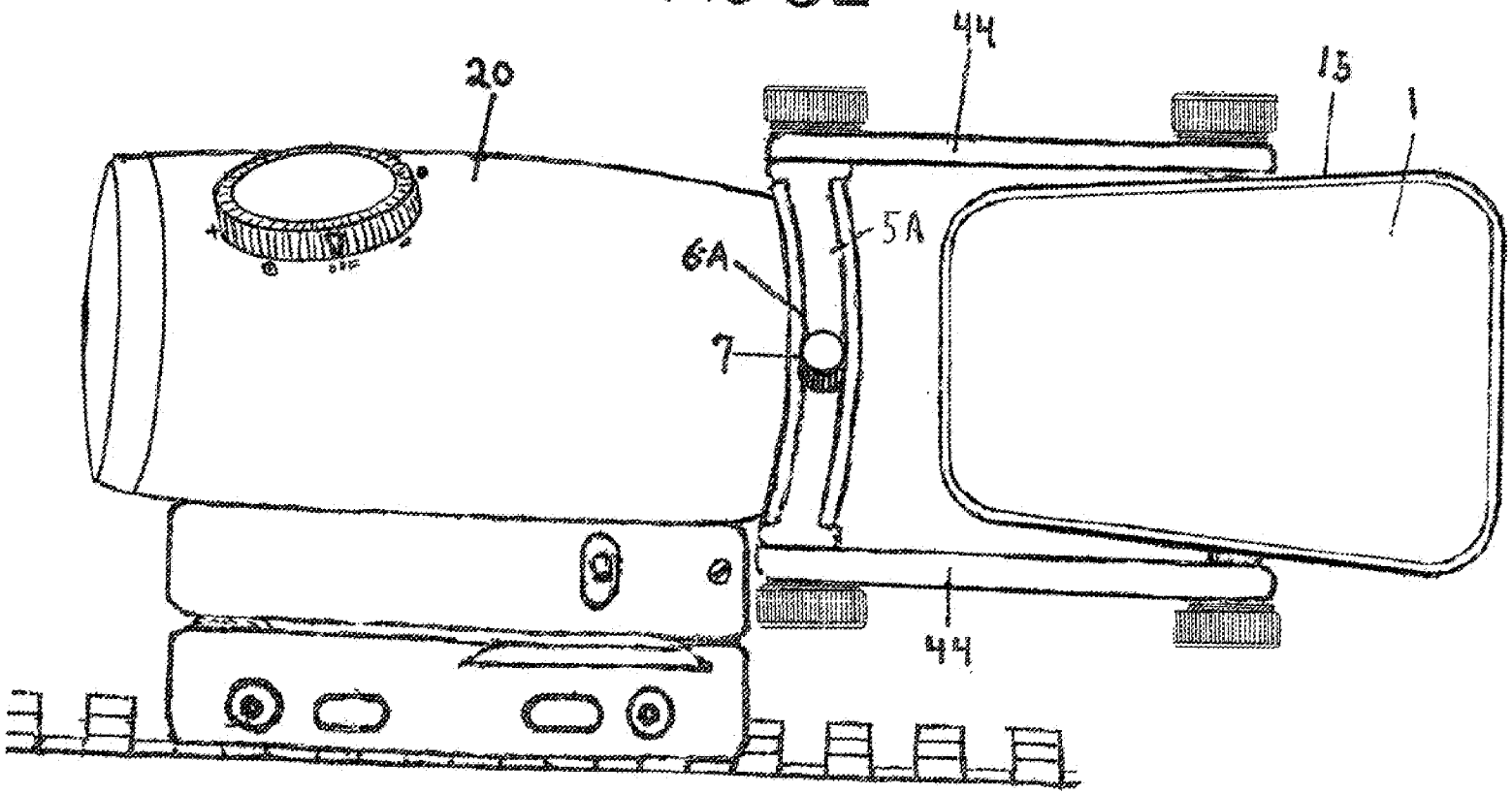

FIG. 32 presents a side view of a sighting device manufactured as an integral part of a target viewing device having an alternative embodiment of the accessory attached thereto.

Figure 33:
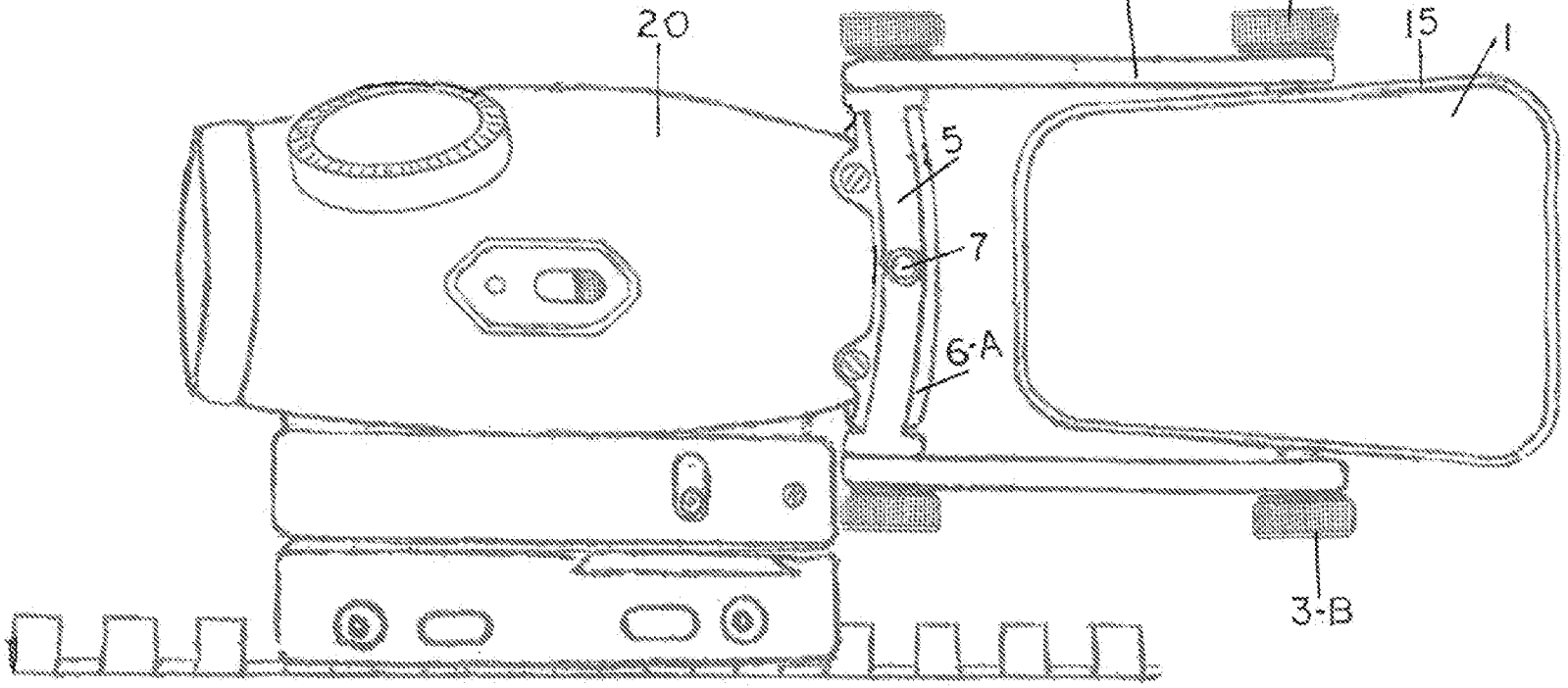

FIG. 33 presents an alternative embodiment showing how the accessory is attachable to and removable from existing viewing devices that are themselves rail mounted on a firearm.

Figure 34:
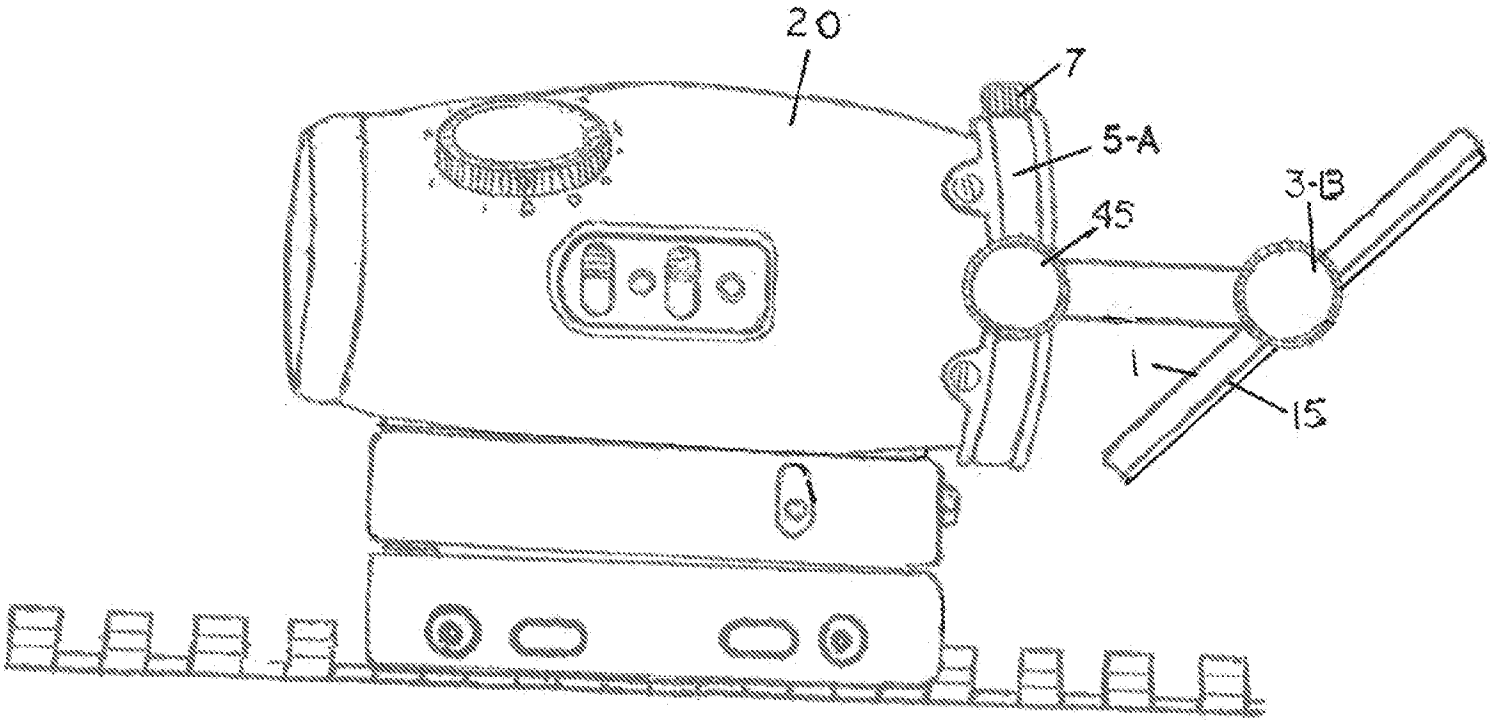

FIG. 34 presents an alternative embodiment herein disclosed showing the red dot sight of FIG. 33 having rotated the sleeve SA upon the bearing in an embodiment taught herein as well as upon the forward armature portions leaving the mirror 1 and mirror base 15 at an angle thereto.

Figure 35:
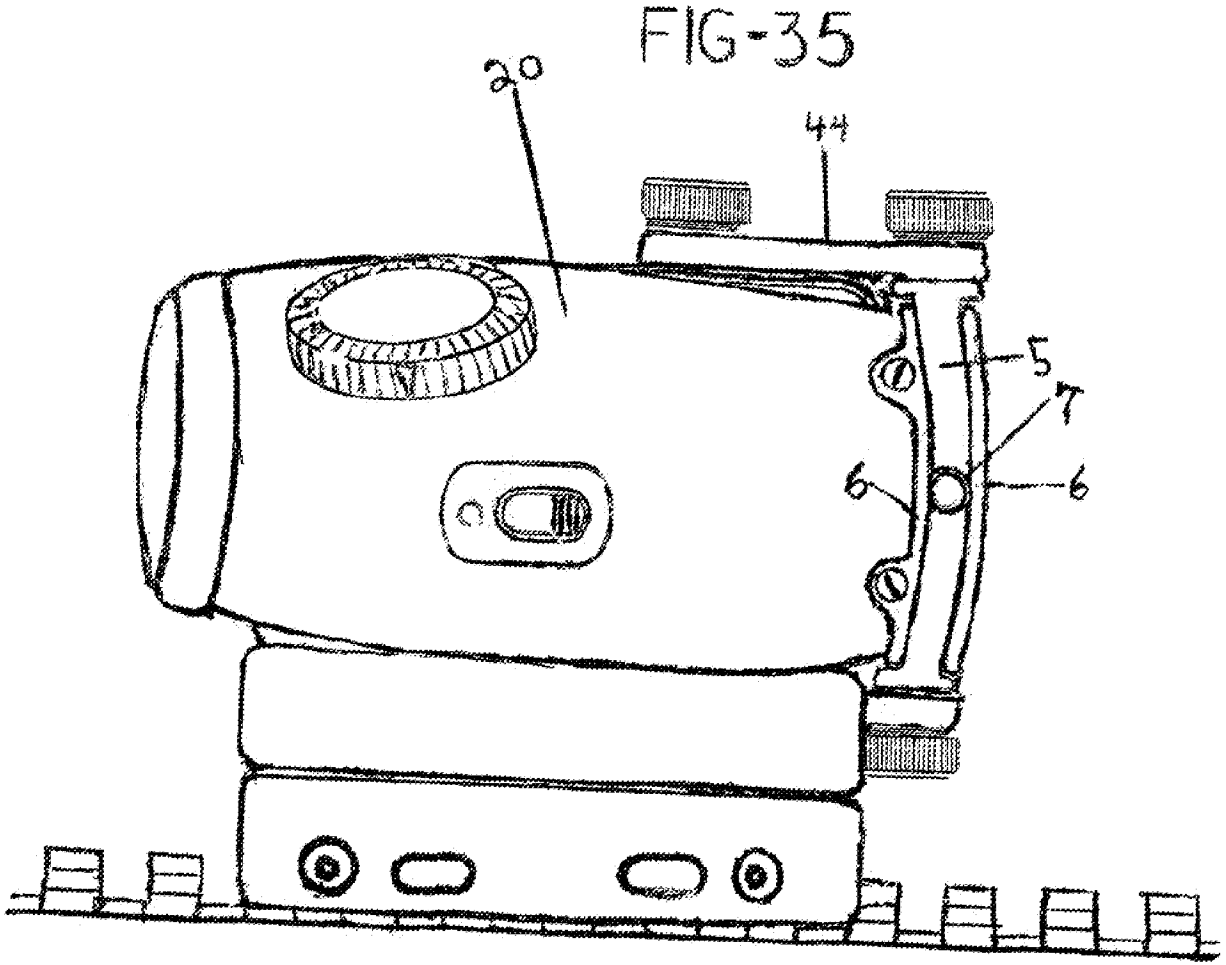

FIG. 35 presents an alternative embodiment herein disclosed showing the red dot sight of FIG. 33 having rotated the armatures backwards so that the mirror 1 and mirror base 15 may bestowed approximately parallel to the red dot sight in a position of non-use in an embodiment taught herein.

Figure 36:
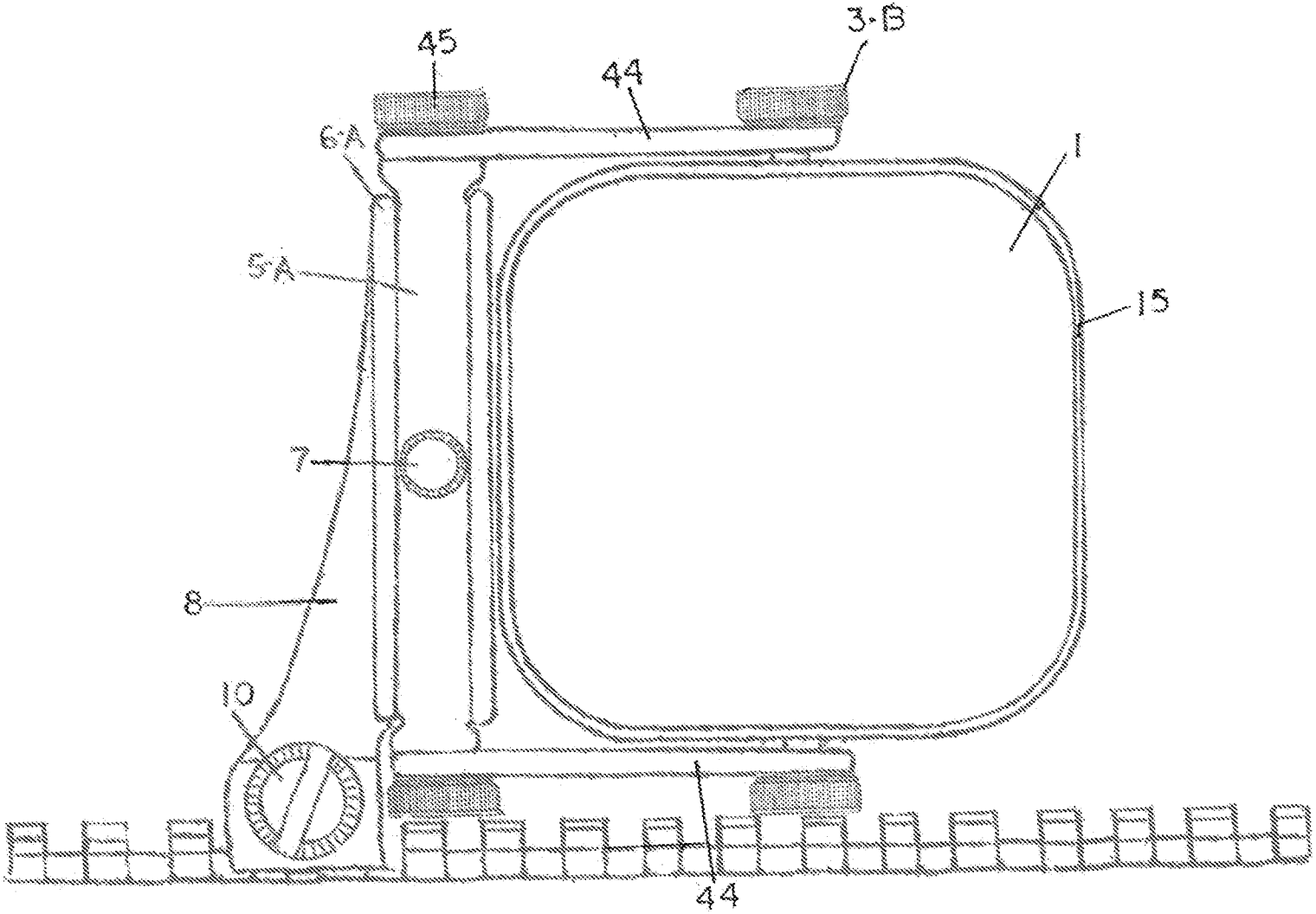

FIG. 36 presents an accessory mounted on a weapons rail in an alternative embodiment taught herein.

Figure 37:
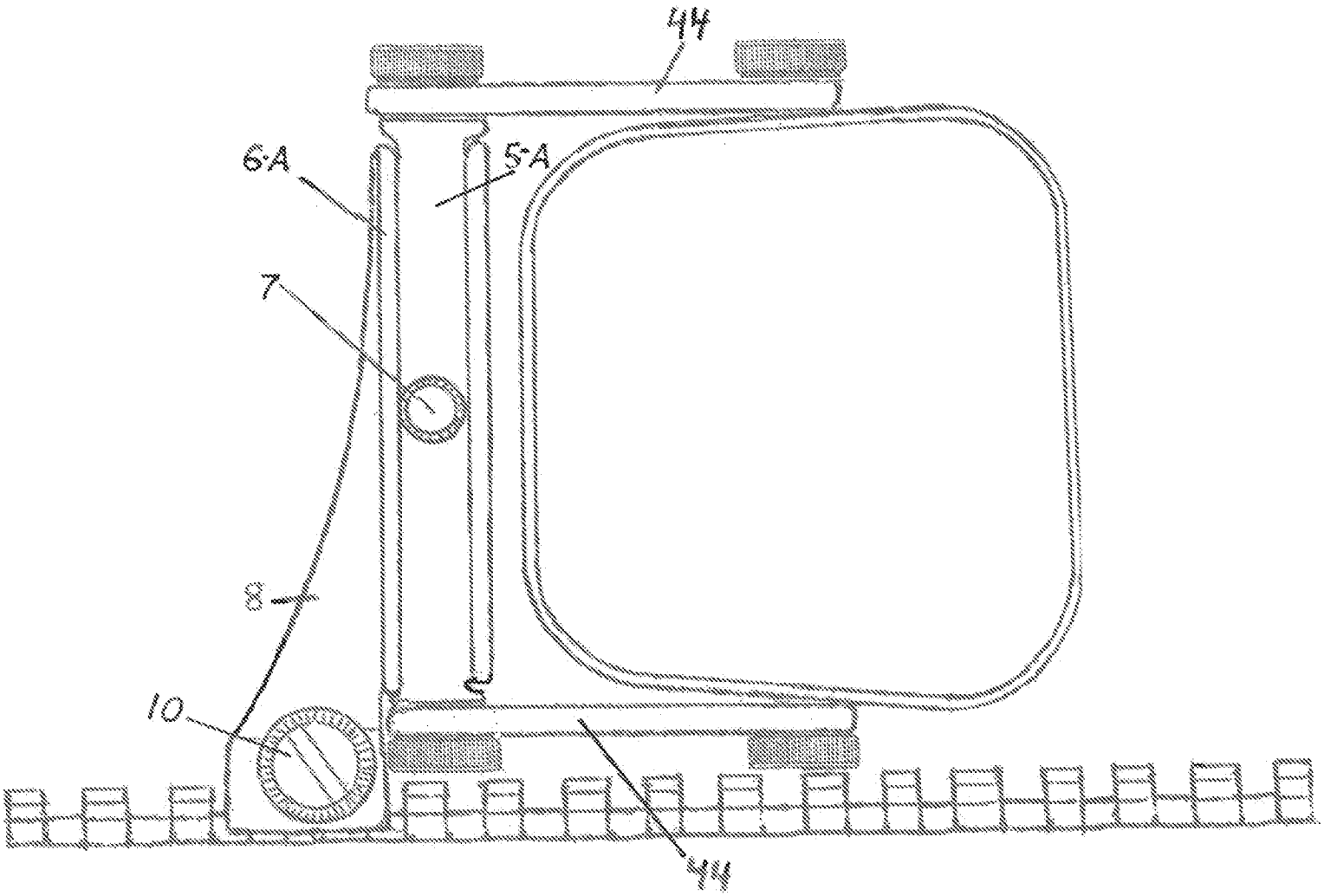

FIG. 37 presents an accessory mounted on a weapons rail in an alternative embodiment taught herein with the mirror turned at an angle upon forward armature mounts.

Figure 38:
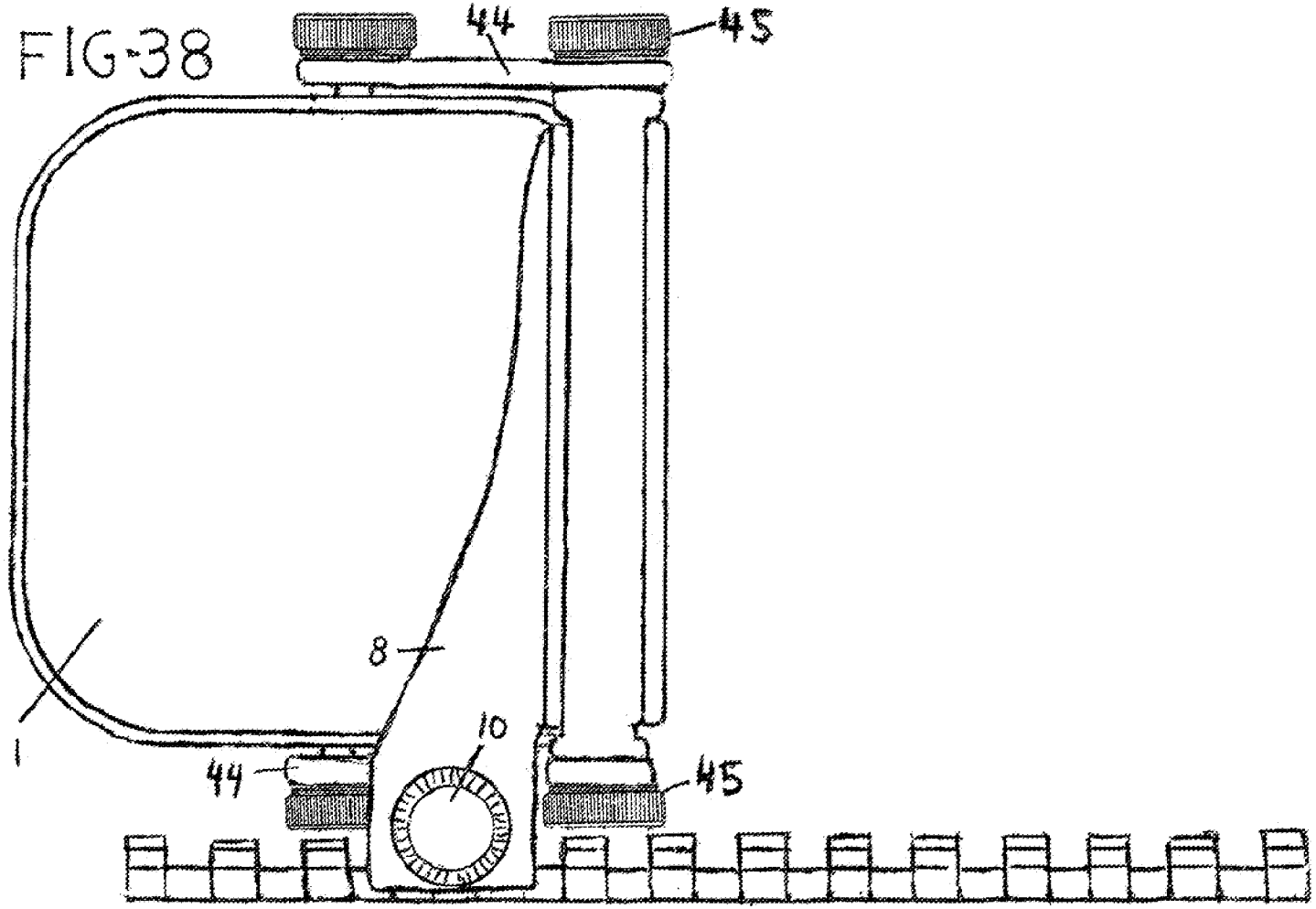

FIG. 38 presents an accessory mounted on a weapons rail in an alternative embodiment taught herein with the mirror folded back as far as possible presenting a mirror stored position.

Figure 39:
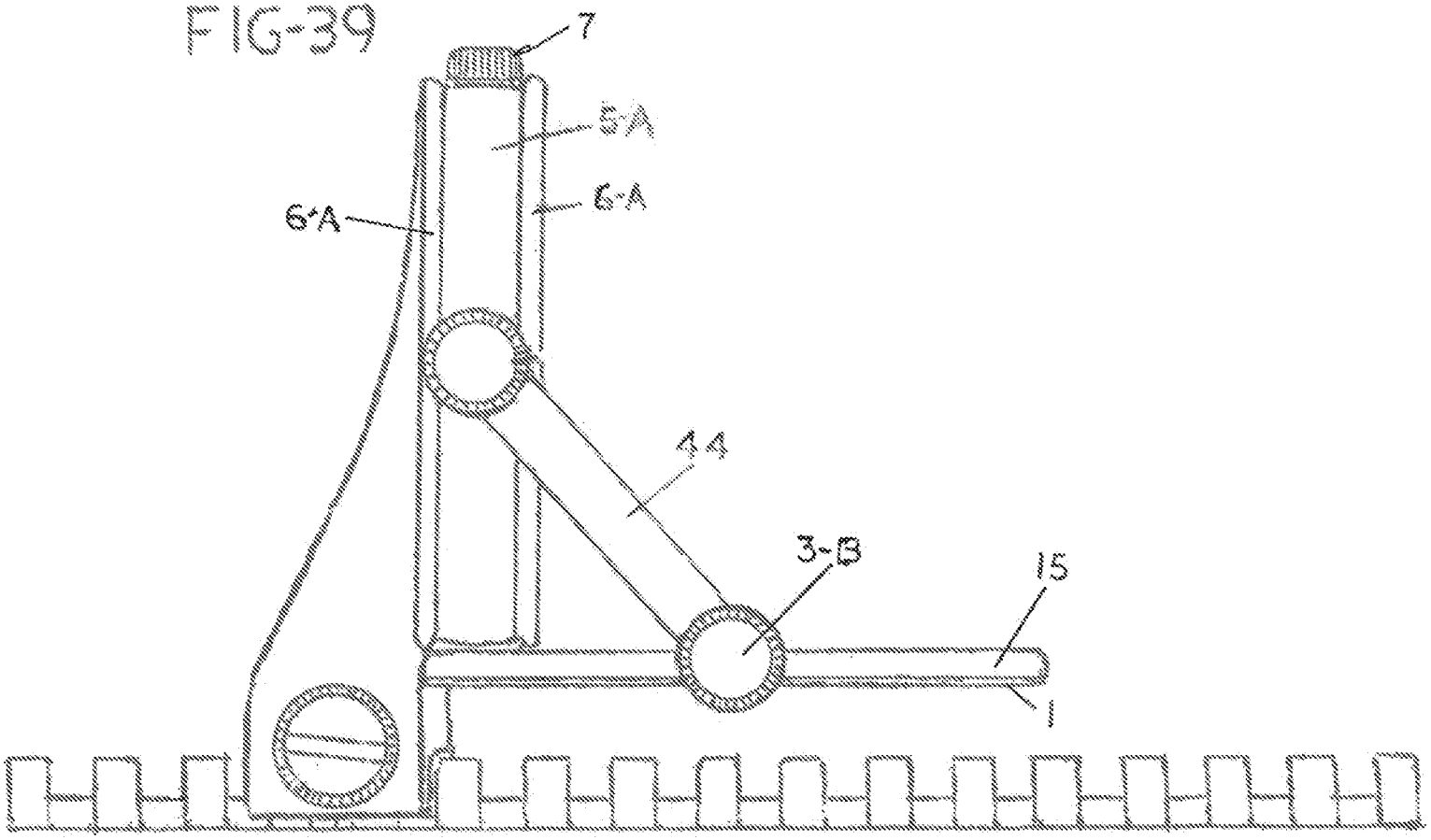

FIG. 39 present an accessory mounted on a weapons rail such that accessory rotated to face weapons rail with reflective side of mirror facing downward in an alternative stored position.

Figure 40:
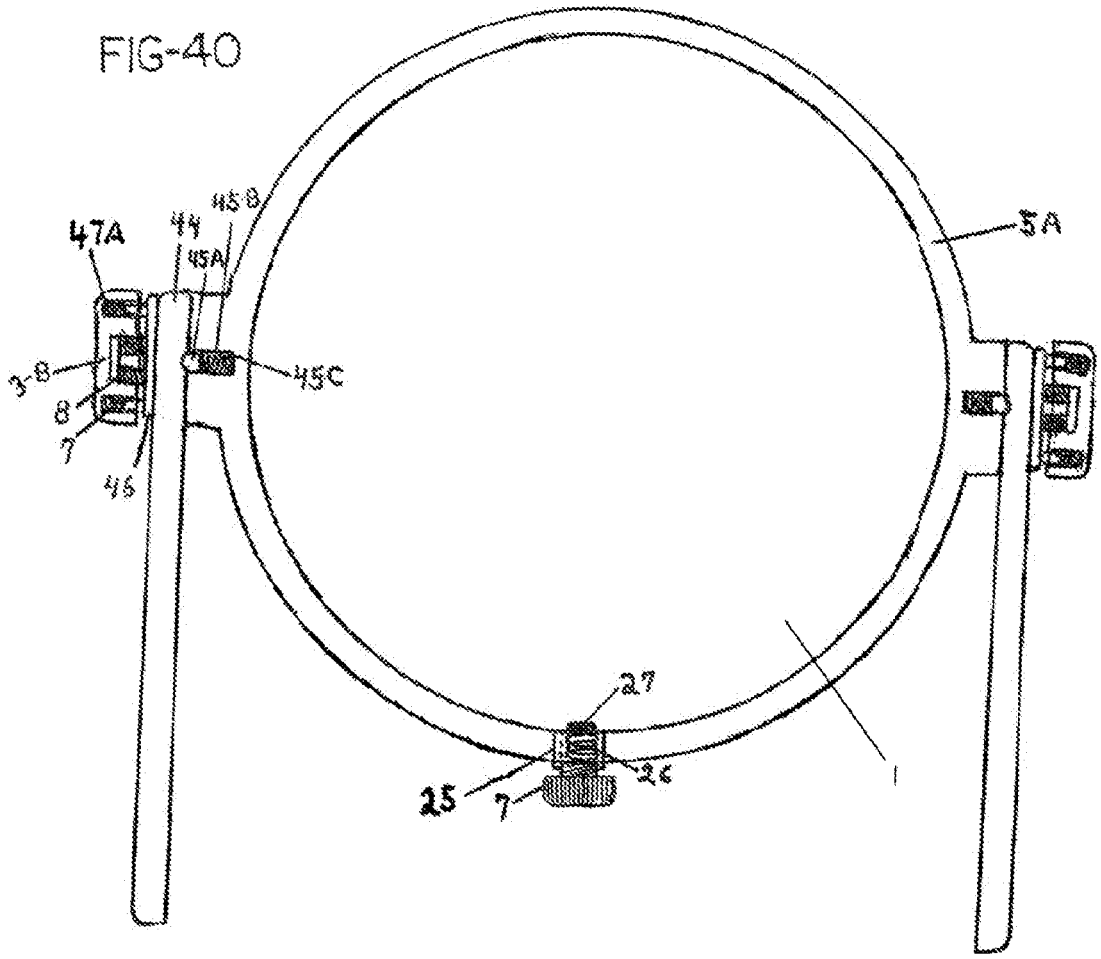

FIG. 40 presents a view of an alternative embodiment of a connection assembly having dual armatures and a rotatable collet with a mirror.

FIG. 41A illustrates a Rotatable collet #5A that mounts to armatures #44 as shown in FIG. 40 to and allow mirror #1 to be adjusted to a full range of 360 degrees.

FIG. 41B illustrates Armatures that mount to rotatable collet #5 and mirror base #15 that pop and lock into various positions of use and non-use and on which mirror #1 is angle adjusted FIG. 41C illustrates Friction discs, like tiny clutch plates, which create friction or drag between armatures #44 and collet #5.

FIG. 41D illustrates a tension adjustable knob that creates adjustable friction or drag between armatures #44 and collet #5.

FIG. 41E illustrates Springs that are housed inside tension adjustable knob 3B.

FIG. 41F illustrates a Side view of tension adjustable knob 3B as if knob housing was transparent showing internal springs housed within. This knob would house two or more of these springs.

Figure 42:
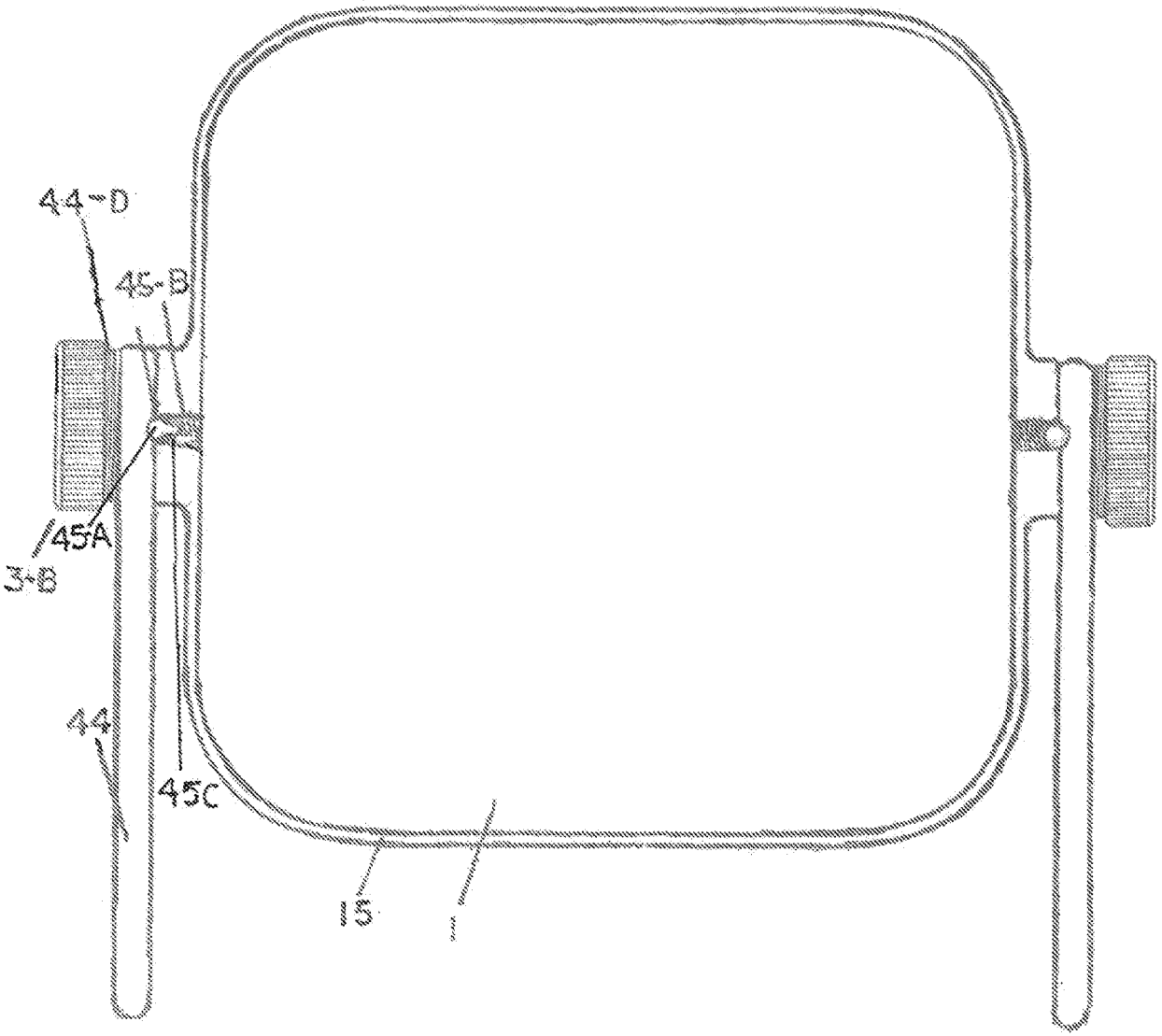

FIG. 42 presents a close-up view of an alternative embodiment of a connection assembly of a forward portion of a mirror base mounted on forward points of dual armatures showing the knobs whereby a mirror 1 and mirror base 15 can be attached to sleeve SA using dual armatures 44 as taught herein.

FIG. 43A illustrates a mirror and mirror base that can connect to dual armatures as shown in FIG. 42.

FIG. 43B illustrates a side or profile view of armatures 44 with threaded friction disc housing, an integral part of armatures 44.

FIG. 43C illustrates a bottom or inside view of the tension adjustable knob that is housing spring loaded compression pads.

FIG. 43D illustrates a spring and integral compression pad housable in tension adjustable knob housing.

FIG. 43E illustrates a disc that mechanically fastens to mirror post 48B with machine screw seen in 43F FIG. 43F illustrates a machine screw that fastens disc 43E to 48A that would be tightly secured with thread locker FIG. 43G illustrates inside or bottom view of armature 44 that fits up against 45.

Figure 43:
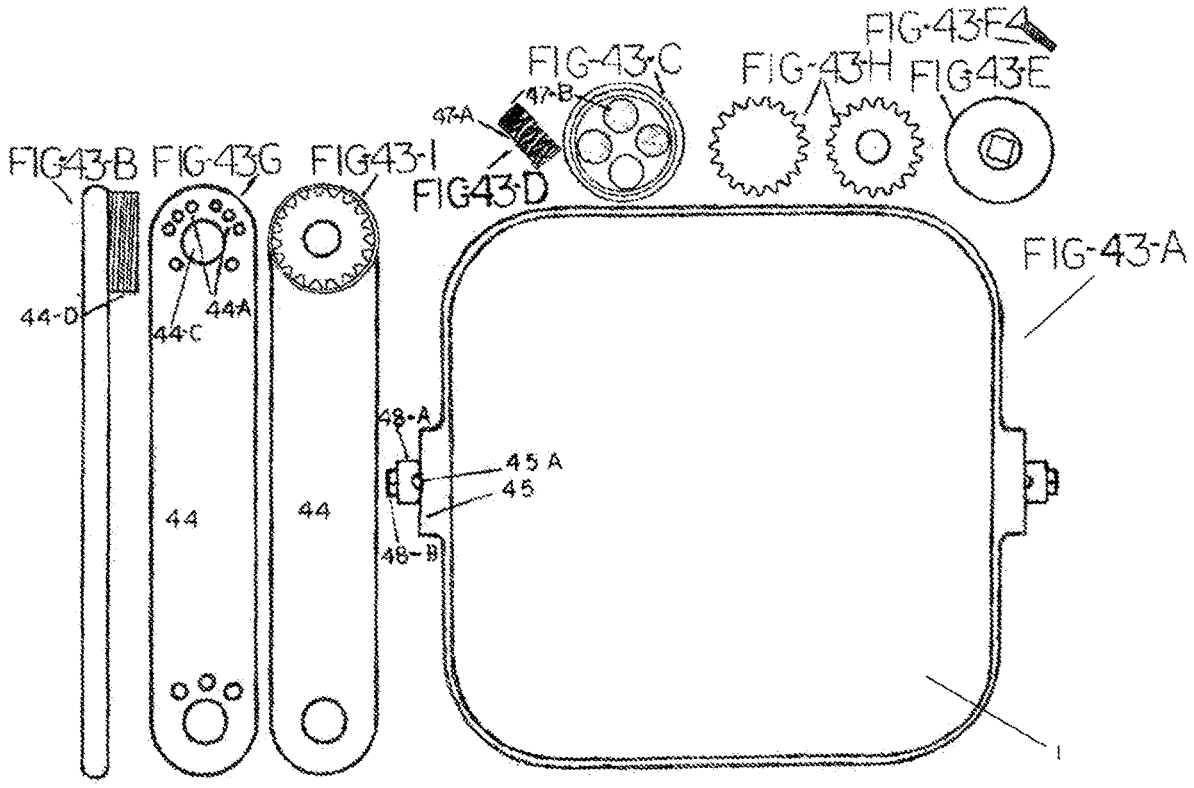
Figure 44:
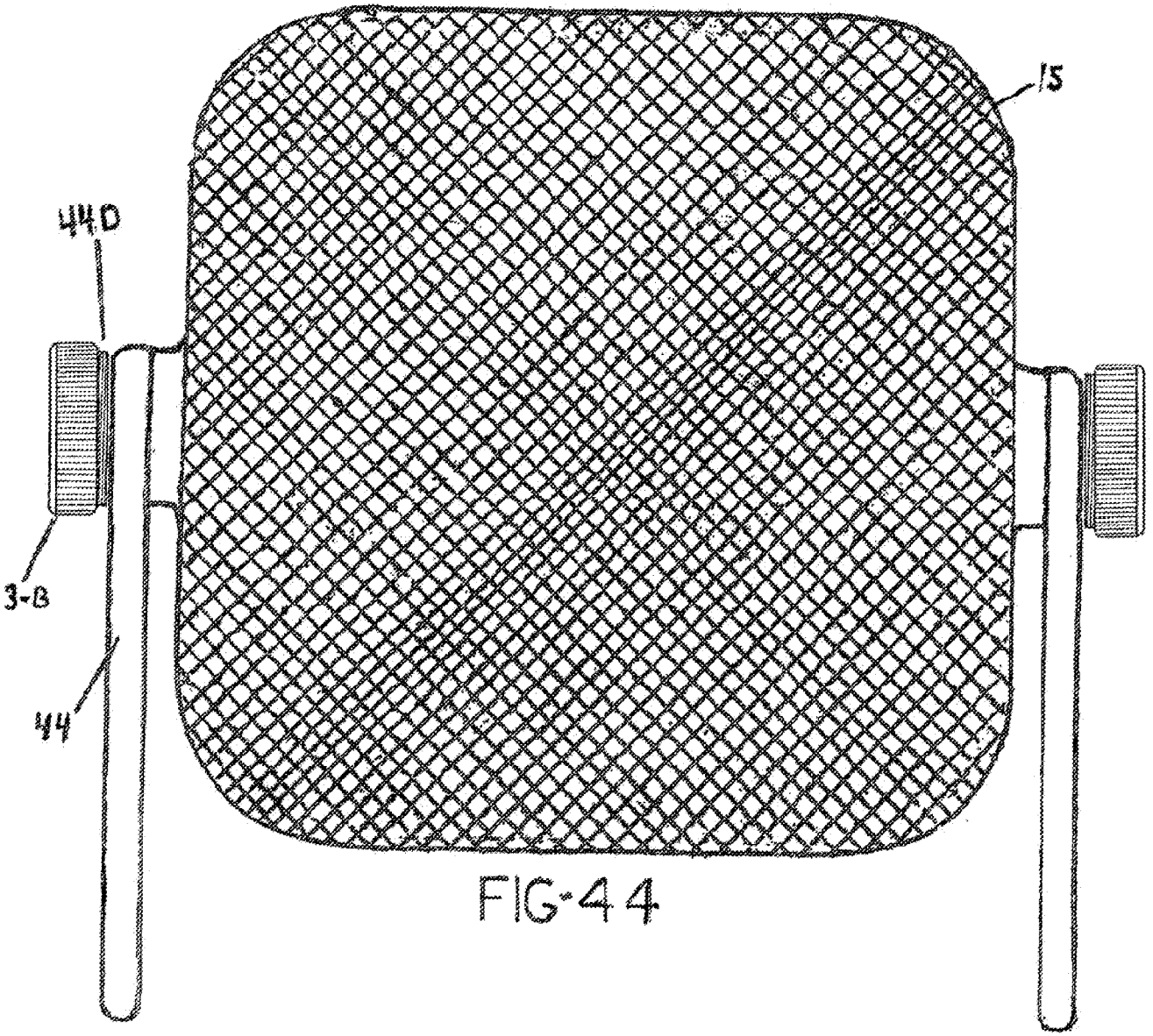

FIG. 43H illustrates friction discs that would be installed on each side of disc seen in FIG. 43E that is mechanically fastened to mirror post 48A FIG. 43I: illustrates a top view of armatures 44 showing inside portion of friction disc housing FIG. 44 presents a closeup of a back portion of a mirror base mounted on forward points of dual armatures showing the knobs.

Figure 45:
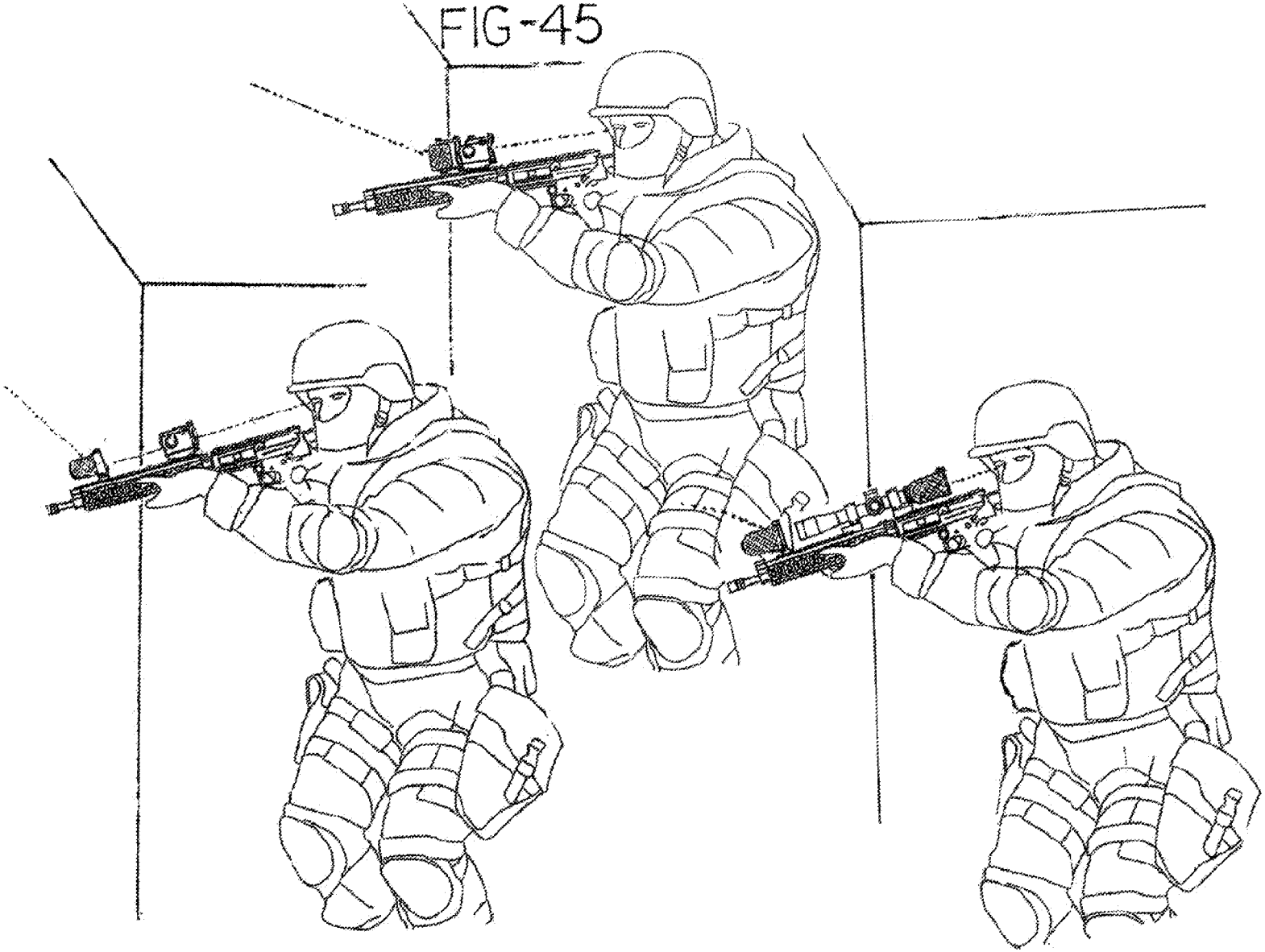

FIG. 45 illustrates an embodiment of a rotationally deployed non-blocking firearm accessory mounted on a firearm in front of the firearm's sight.

Figure 46:
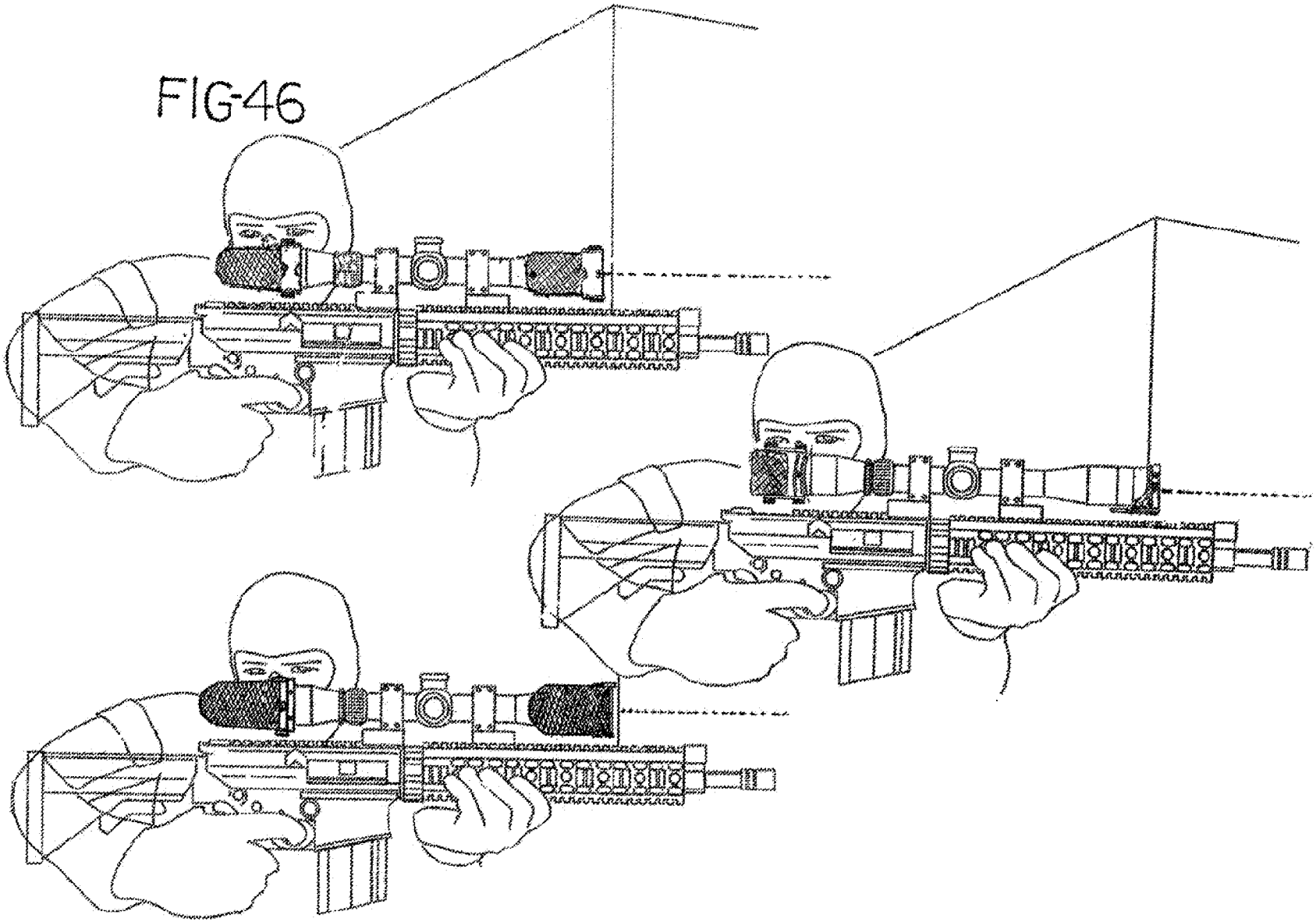

FIG. 46 illustrates an embodiment of a rotationally deployed non-blocking firearm accessory mounted on a firearm behind the firearm's sight.

Figure 47:
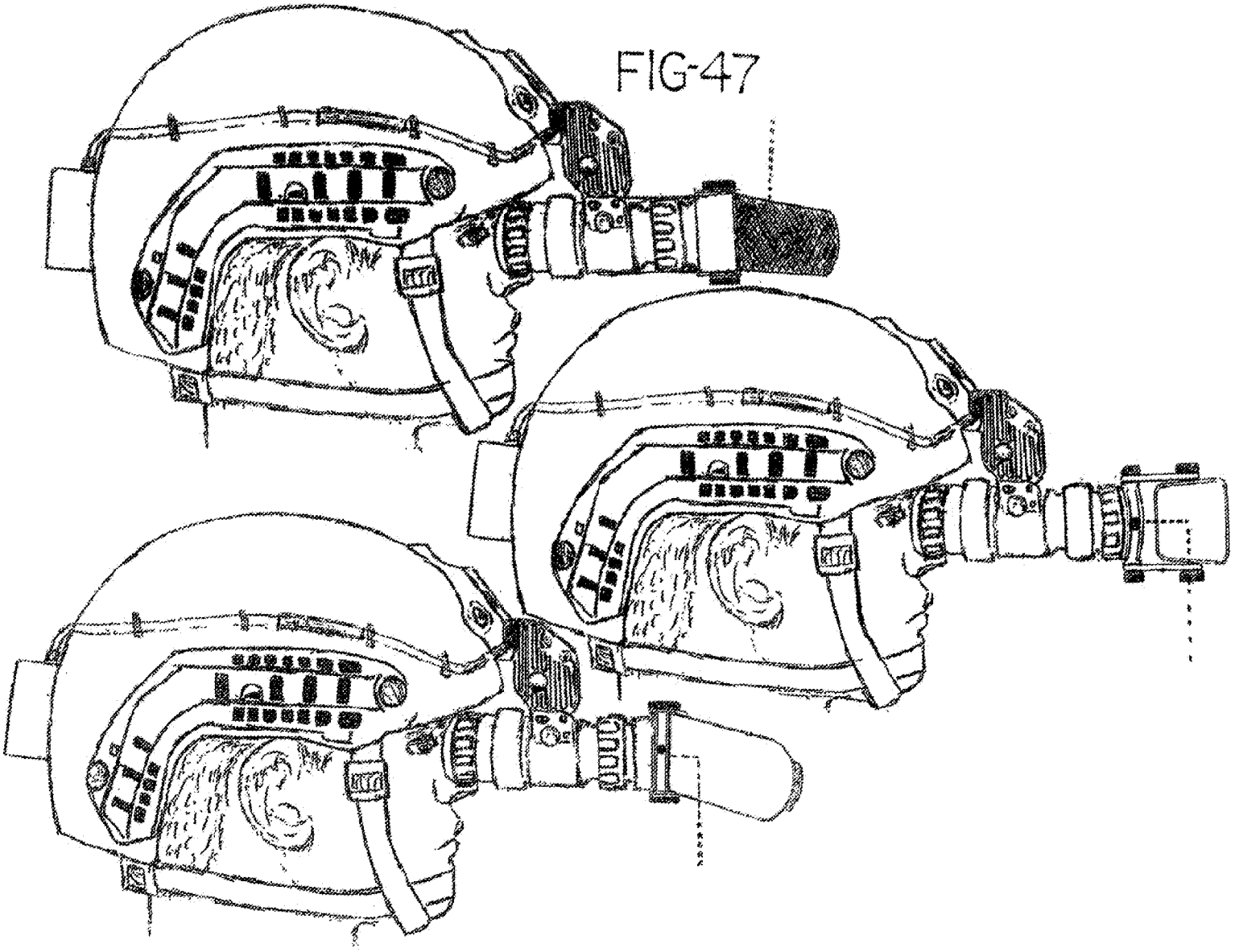

FIG. 47 illustrates an embodiment of a rotationally deployed non-blocking firearm accessory, in an in-use position, mounted or made integral with a night viewing device on a helmet.

Figure 48:
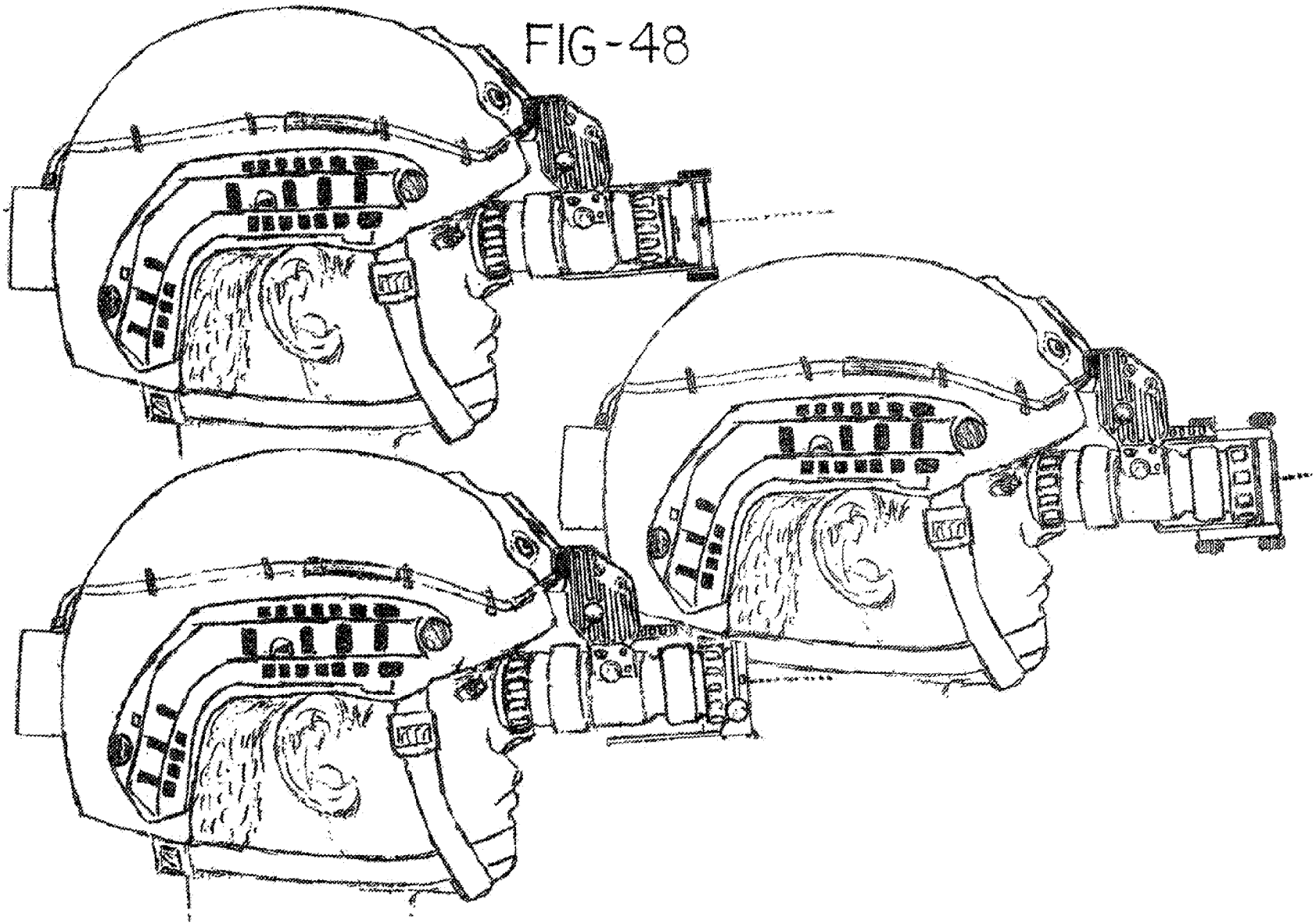

FIG. 48 illustrates an embodiment of a rotationally deployed non-blocking firearm accessory in a non-use position, mounted or made integral with a night viewing device on a helmet.

Like reference numerals refer to like parts throughout the several views of the drawings.

Rotationally Deployed Non-Blocking Firearm Mirror Accessory

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in each figure.

Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise. It should be understood that there are several embodiments taught herein that disclose a plurality of unique characteristics.

A) Angle of Usage: In particular, the rotational firearm accessory taught herein. Mirror assembly is adjustable to a full range of angular adjustment while also maintaining a full 360 degrees of rotational adjustability as well, providing user with target acquisition abilities from either side of the firearm, from over or under the firearm, or from any points between such as from either side and partially over or under the firearm, or from a full range of 360 degrees as well as from points forward or behind firearm, providing user with target acquisition from basically any position user would have to place himself in relation to the firearm to the accurate use thereof.

B) Multiplicity of Targeting Positions: When the firearm accessory is mounted behind the target viewing device, the firearm accessory enables a user to view the reflected target image provided by the target viewing device with the target image being viewable from any position that the user would have to position himself relative to the firearm, from either side around the firearm. Then, by either rotating the firearm, or by rotating the bearing or collet and adjusting the angle of the mirror as needed, the user is able to also view the target reflected image provided by the viewing device from any position the user would have to position him or herself to the accurate use of the firearm, such as from overhead, underneath, or from either side of the firearm. Because of this ability to view targets from virtually any position, users can engage targets over a wall or armored vehicle and more; he or she is able to target objectives from overhead, underneath or basically from any position that the user could have to engage targets without becoming a target in the process.

C) Surveillance Abilities: When a firearm accessory from one of the embodiments taught herein is mounted in front a target viewing device, the device enables the user to surveil the environs and thereby locate advancing hostiles from any position. Of course, this happens whilst using the previously described rotational and positional capabilities; because of this, a user is able to watch the situation develop, such as the advancement of hostile combatants, from off to any angle that the user would be in relation to the area being surveilled, from a safe secure location such as behind a building, armored vehicle, truck or other fortified structure. The reflected image of the target and surroundings arrives at the firearm accessory mirror in front of the target viewing device and is reflected thereby through the target viewing device and directly back to the user of the firearm. This device also works extremely well with the naked eye when using this device for surveillance purposes.

D) Predetermined Positions: The firearm accessory embodiments taught herein are designed to have a plurality of common angles of adjustment. Thus, locking devices disclosed within this document enable the device to be situated rapidly into these common angles for quick and easy targeting acquisition thereby. This enables a user to acquire targets quickly and easily. This device is also engineered with adjustable friction devices that maintain its horizontal, vertical and rotational desired angle of adjustment which prevents the mirror from moving out of its angle of adjustment while being exposed to the forces of inertia during recoil or other forces that may be encountered during the use thereof.

E) Non Obstruction of Target Image: The firearm accessory taught herein in its disclosed embodiments are engineered in a manner that this device does not obstruct or impair the target image provided by the target viewing device it is working in conjunction with, in any way, while in use or with the mirror stored in its position of nonuse. This is mainly attributed to a rotatable collet or bearing that the mirror assembly attaches to and pivots on the outer member thereof. This collet or bearing totally encompasses the outer perimeter of the target viewing device that the accessory is working in conjunction with.

F) Application and Configuration Options: The firearm accessory in in embodiments taught herein would be manufactured in at least three different configurations. Firstly, as a rail mountable device, it would be mountable to the firearm weapons rail in front of or behind a target viewing device. Secondly, to be mechanically fastened and mountable to the outer perimeters of the front or back or both front and back of a target viewing devices' windows or lenses being mountable to the housings thereof. Thirdly, to be integrated into the design and manufactured as an integral part of target viewing devices.

Herein described is a firearm accessory designed to be used on both rifles and pistols; this accessory has a mirror device folding completely out of the way when not in use. It is quickly and easily adjustable to any angle by 360 degree rotation thereof effectively permitting a user to assume almost any position with relationship to the firearm. Because of this, the user is both able to locate, pinpoint and fire on targets without having to become a target while doing so as is to be described by the various features herein described. The accessory is able to be located behind or forward of a viewing device also used in conjunction to locate targets.

Various manufacturing options and or configurations are available to the end user; the device can be made as an I) attachable part of a scope or sight; or 2) integral to a sight or scope; or 3) individually mountable before any firearm viewing device (red dot sight or scope, night vision, etcetera); or 4) mountable device having the ability to be placed on weapons mounting rails directly behind or in front of a firearm viewing device; or 5) standing alone and used in conjunction with laser sights or iron sights or simply with the naked eye for surveillance purposes An embodiment of the accessory herein described is a single angle adjustable mirror mounted on its own rotating platform; its pivoting point is located just off to the side of the posterior sight opening (through which persons view objects) or similarly deployed nearby other firearm viewing devices such as scopes, night vision, or other such sights. This accessory is mounted and stored parallel to the firearm; its mirror swings out from its parallel stored position and is manipulable by a user to adjust the reflection of images from sights, scope or other such viewing devices at different angles from off to the side of firearm or through viewing device.

To maximize the flexibility of the user experience, the mirror portion of the accessory is able to rotate 360 degrees on a joint that acts like a bearing. This joint combines the rotating mirror part of device that the mirror is attached to as well as a bearing mounting device forming a simple bearing whereupon the mirror rotates. The bearing itself is mountable directly on a rail of a firearm or is integral with a scope, sight or is attachable and removable from any of the foregoing. When attached to a rail of a firearm the bearing would have an integral mounting device so as to ensure proper attachment thereto.

It should be appreciated that the accessory is an extremely versatile device as it thus has:

I) the capability to retract the mirror portion of the accessory when not in use, 2) the adjustability of the mirror angle, as well as 3) the ability to rotate the mirror portion of the accessory through 360 degrees. All of these work together with each other so that the viewing portion of the mirror can be rotated to either side of firearm thereby facilitating visuals from either side of the firearm as well as to any angle above or below firearm. Then mirror can be adjusted out to any angle to view targets not only just off to the side, but forward or from angles from slightly off to the side, or from behind firearm; in other words, from virtually all positions in three dimensions that the user would haft to position him or he self in relation to the firearm accurate use of the firearm It should be understood that the mirror assembly is fairly long in design in comparison to the other components thereof; this is because tests have shown that the visualization of objects at very slight angles from behind and off to either side of firearm are aided by this longer mirror. It thus gives you the ability to view targets at much slighter angles and as such the embodiment taught herein has a much broader range of use. Finally, with the mirror folding back to its storage position, that would provide an unobstructed view through sights and or scopes mounted on the firearm. Because of the aforementioned the user is able to never become a target whilst locating, pinpointing, and firing on targets.

A casual review of battlefield casualty statistics has shown that a user gravely risks his or her life when attempting to locate and fire on a target as the firearm user many times must enter a clear area viewable by others. But with the embodiment's mirror ability to fold back out of way of sights and other types of viewing devices, this accessory doesn't obstruct the view of sights or viewing devices in any way; as a result, there would be no reason to remove this accessory when not in use (although in most designs of this device it is easily removable).

The following drawings of the various embodiments taught herein show optional variations that are combinable in any conceivable fashion. For example, there is a tensioning system used to keep a mirror at a stationary angle during operation of a firearm; these are adjustable clutch devices located at one or more narrow sides of a mirror mounting platform (all embodiments also have at least one) each having a spring loaded ball that engages into and out of small grooves external to a tensioning device. This not only helps keep a mirror adjusted to the most common angles of use for quick easy angle adjustment when time is critical as well as keep it in its non-use position. Other embodiments show this system simply being an adjustable spring loaded friction pad on one or both sides of the mirror or in combination with a spring activated ball system engaging the tensioning device at an opposite mirror side as that engaging the friction pad.

Both the spring loaded pad system and the spring loaded ball system apply friction or drag to the mirror mount tensioning device. As stated previously, an optional embodiment teaches the combination of both systems adjustable clutch-like ball system located on one side of mirror mount and the spring loaded pad system located on the other side of the mirror mount.

An Embodiment of this Invention Seen in FIGS. 1 Through 26

In this embodiment, a device for use with a target viewing device is provided that solves the above described problems. A device for attaching in front of and behind a target viewing device of a firearm. In one embodiment, the device comprises of a collet comprising a central opening defined by a first part and a second part. The second part is rotatably coupled to the first part such that the second part rotates relative to the first part. A friction tensioning device is provided, the threaded housing of which, being an integral part of the second part, housing a spring tensioning friction disc or brake pad that creates adjustable friction or drag between the first and second part. At least one attaching member is configured to fixedly couple the first part of the collet to or proximate to the target viewing device such that the opening does not obstruct an image provided to and from the target viewing device. A mirror is pivotally coupled to the second part via at least one hinge. On the outboard side of at least one of these hinges, a tension adjustable friction device is provided to apply adjustable friction or drag to the pivot point of the mirror assembly to maintain its adjusted position during use. A spring loaded ball or other is provided that the mirror may be popped in and out of position of non-use as well as positions of most common use for quick and easy mirror adjustment when time is critical. Mirror assembly may pivot about the hinge into positions of use to position the mirror relative to the target viewing device to provide a reflection of an image provided by the target viewing device to the user when the device is positioned behind or on the rearward end of target viewing device and thus receivable to the user as well as to provide a reflection of the target to the viewing device when the device is positioned in front or on the forward end of the target viewing device. Mirror is returned to position of non-use by simply rotating mirror back to where it would lay up against the side or on top of target viewing device it is working in conjunction with where protective cover could be slid over and popped onto mirror assembly to protect mirror and eliminate unwanted glare.

FIG. IA presents a Rotationally Deployed Non-Blocking Firearm Mirror Accessory as taught in an embodiment herein disclosed. A mirror I is integrated into a base 15 by gluing, mechanical tongue and groove attachment, welding or simple fasteners as appropriate. This base 15 has a handle 2 formed at one narrow end of the base that extends beyond the unrestricted end of the mirror 1. A tensioning knob 3 adjusts tension to springs 19 and friction pads 17, located inside knob that applies pressure to friction pads 17, that produces friction or drag to the surface of discs 18A, that is at the top part of shafts that attaches to the mirror base 15 and optionally at a corresponding bottom portion of the shaft using another tensioning knob.

A spring loaded ball system is located at a narrow side edge of the base 15 that extends somewhat beyond the mirror 1. It is housed in a generally cylindrically container 4 permanently attached by welding, brazing, or integral plastic formation to the edge of the mirror base 15 as disclosed below. The container 4 is further closed at one end and has a hole at another end for spring activation of a ball found therein; this open end having a hole conically reduces to a diameter narrower than the rest of the container thereby trapping a ball larger than the hole diameter therein; the ball's diameter permits it to partially extends through that hole but forbidding its exit.

Further, the ball is pushed by a spring loaded behind it that presses against the closed side of container 4; this engages various notches 13 or grooves in an annular protrusion 14 integrally formed from a side of the sleeve 5. A corresponding duplicated annular protrusion 14 is located opposite to the first one and to another side of the sleeve 5 such that the annular opening within each is coaxial to the opposite protrusion so that these can cooperate together to permit mirror I rotation.

FIG. IB shows the annular protrusions 14 integrally formed with sleeve 5. A threaded housing 12 is integral with the annular protrusions 14 that has threads for knob 3. FIG. IC shows bearing 6A having a back portion 6 and a narrow neck portion 6B. These two annular protrusions 14 along with an axial system associated therewith and as described herein operates to permit the mirror I and base 15 to slide conveniently thereon as moderated by various friction devices found within the axial system and as described further in relation to other figures (for example FIG. I 0) as described below. These friction devices are found within threaded friction disc housing 12 that is generally circular in shape having a single spiral groove for engagement of knob 3 thereon. Threaded housing 12 houses friction pads 17, discs 18, springs 19 and mounts tension adjusting knob 3 on its threaded external surface. An additional friction device that provides adjustable control of rotational drag or friction control of sleeve 5 in relation to collet 6 is adjustably controlled with knob 7 this permits a user great control of mirror I adjusted position.

Further expanding a user's perspective is facilitated by sleeve 5 being mounted onto an outwardly extending portion of the bearing 6A integrally formed from a back portion 6; this back portion 6 is of the same or larger outer diameter than the sleeve 5 so that it restricts motion of the sleeve 5 against this back portion 6 once the sleeve is mounted on to the bearing. By mounting onto the bearing neck 6B and by being pressed against the back portion 6 the mirror 1 and its base 15 are rotatable for a full 360 degrees by connection of the mirror 1 and base 15 through an axial system to sleeve 5 and its integrally formed annular protrusions 14.

The back portion 6 of also has an integrally formed rail mount 8 (there are various types of quick release existing rail mounts that can be used for this purpose) that spreads out wider and attaches conventionally to a weapon rail 9 using thumb screw 10. This screw 10 is used to fasten and remove a device that is loaded onto a rail mount configuration. Thus, by mounting the accessory on a weapon's rail 9, it is primarily to be used in conjunction with red dot sights, iron sights, laser sights, scopes, and more such that it is mounted behind a scope or some such other viewing device. Of course, expanding on this idea, it is optionally mounted on either side of firearm's target viewing device; thus, a user views these devices on the firearm from any position user would be in relationship to firearm. The person using the device thereby locates, pinpoints, and fires on a target from a safe, secure position or it may be mounted on other side of viewing device on a firearm to use as surveillance device to locate targets from a safe, secure position.

Finally, tensioning knob 7 adjusts tension to internal springs and friction pads that creates friction or drag between sleeve 5 mounted on bearing 6A neck portion 6B and against back portion 6; this is used to keep mirror in a stable position when tightened appropriately for easy location of a target. Thus, a target located at some imaginary vantage point presents an image that travels along ray 11 represented as a dotted line showing the line of sight through the opening of sleeve 5 and bearing 6A and on through a hole in back portion 6 that continues the narrow portion of the bearing 6A neck 6B. It should be appreciated that this neck 6B is between a conical portion of the forward outwardly extending bearing 6A and the back portion 6.

Figure 1A:
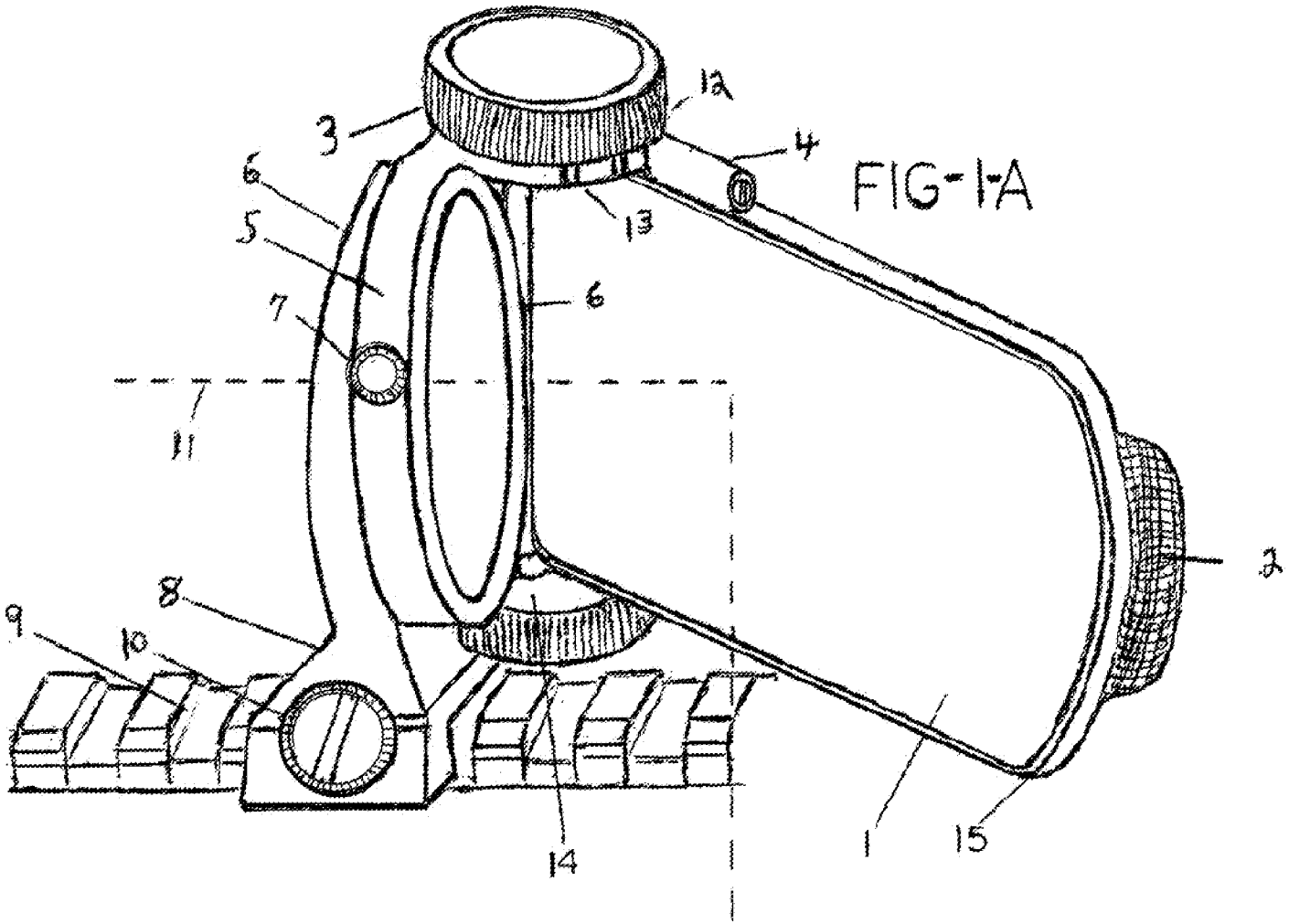
Figure 2:
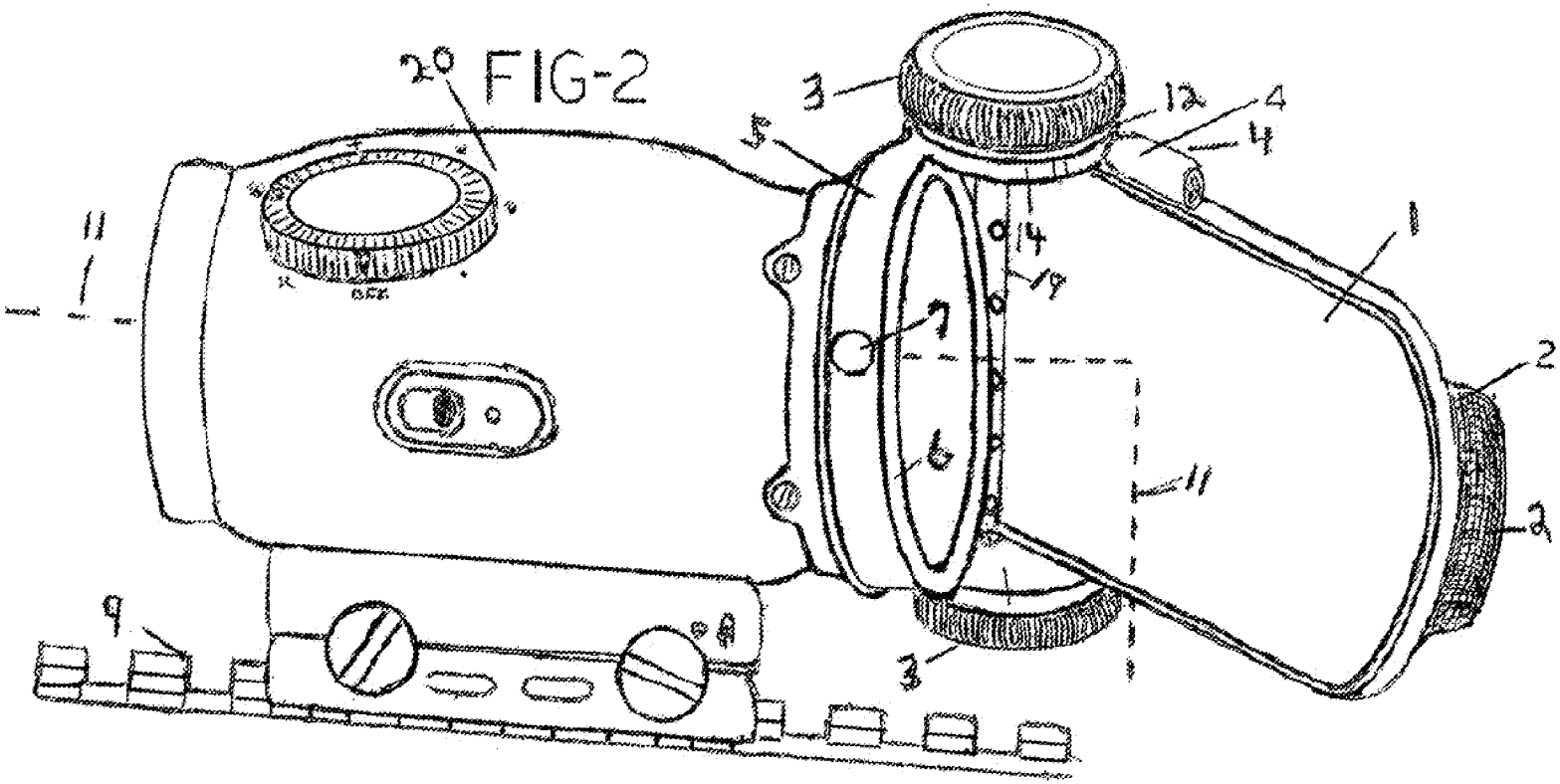
FIG. 2 presents an alternative embodiment showing how the accessory is attachable to and removable from existing viewing devices that are themselves rail mounted on a firearm.

FIG. 2 presents an alternative embodiment showing how the accessory is attachable to and removable from existing viewing devices that are themselves rail mounted on a firearm. Thus, the accessory is optionally mounted on either side of the firearm viewing device. This facilitates a multi-viewpoint operation of the accessory. As a result, a user is able to take any position with relationship thereto to locate, pinpoint, and fire from a safe, secure position or alternatively use the accessory as surveillance device to scan the scenery or locate targets from a safe secure position. Here, a red dot sight 20 mounted on a rail has the accessory attached to it using a plurality of screws threaded through holes in the accessory and pressed against the outer surface of the red dot sight; alternatively, these pass into corresponding threaded holes in the red dot sight 20; The back portion 6 is extended over a portion of the red dot sight for fixed attachment thereto. Additionally, in this embodiment the accessory does not have a rail mount. Axial components 18A and 18B form a rotational axis by which mirror angle adjustment between the mirror 1 and sleeve 5 and bearing 6A occurs.

FIG. 3 presents an alternative embodiment showing the accessory in its attachable to and removable form from existing viewing devices that are themselves rail mounted on a firearm. In this view, the viewing device is a red dot type sight with mirror folded back and popped into position of non-use. Of course, this permits the mirror to be seen when not in use and thus a convenient cover is provided so as to eliminate this problem.

FIG. 4 presents an alternative embodiment showing how the accessory is an integral part of a firearm viewing device. This exemplary embodiment shows how the accessory is made as an integral part of red dot type sight. In this embodiment the back portion 6 is integrated into the housing onto the front portion there of it is understood that these accessories in all of their embodiments can be engineered to either be mounted thereupon the front or rear portion of a target viewing device such as a reflex type sight, scope night vision or the like or can be manufactured as an integral part of the housing of various types of target viewing devices.

FIG. 5 presents an alternative embodiment showing how the accessory is alternatively mounted on both the front and rear of scope of a firearm. In the view shown in the figure, the accessory that is mounted on the front part of the scope is shown being used for surveillance purposes; here a user looks through the back part of the scope and receives light or in other words the target image and sounding aria received at the front accessory mirror that transits through the scope into the user eyes. Thus, by rotating and adjusting the angle of accessory reflective mirror the user can essentially find targets at innumerable positions. It should be understood that the accessory may be alternatively mounted on solely the front or solely the back part of the scope.

FIG. 6 presents an alternative embodiment showing how the accessory is alternatively mounted on both the front and rear of scope on firearm. In the view shown in the figure, the accessory that is mounted on the back part of the scope actually is shown being used to locate, pinpoint, and fire on target from a safe, secure position such as behind a wall, embankment, or any other protective structure. Of course, it should be understood that the accessory may be alternatively mounted on solely the front or solely the back part of the scope. And simply remounted on either side if desired FIG. 7 presents an alternative embodiment showing how the accessory is alternatively mounted on both the front and rear of scope on firearm; this view shows both mirrors folded back and placed into a quiescent storage or non-use position. In this stored position, a user can use the scope or other viewing device in an ordinary fashion without the intervention of either or both accessories. While maintaining a totally unobstructed vied of image provided by the target viewing device while doing so FIG. 8 presents an alternative embodiment showing how the accessory is Alternatively mounted on or made as an integral part of a night vision device that is attached to a standard helmet mount. And is being used to locate targets of potential danger at night without exposing himself as a target while doing so.

FIG. 9 presents an alternative embodiment showing how the accessory is alternatively mounted on or made as an integral part of a night vision device that is attached to a standard helmet mount; in this view, the accessory is folded back and positioned in a storage or non-use location. This illustration shows how the accessory does not hinder an overall function or use of this optical viewing device when not in use.

FIG. 10 presents an alternative embodiment showing some frictions portions separated from of the accessory for a better understanding thereof. These friction portions are spring loaded tensioning devices that create drag or friction that helps maintain the accessory mirror at a fixed angle; they are located on both sides of mirror mounting platform as described further below. Additionally, there is a locking device made from a spring loaded ball 23 found within a housing 4; the housing 4 is located at a narrow top edge of the plastic or metal mirror 1 mount of the accessory. As the accessory mirror is rotated the spring loaded ball 23 in housing 4 engages grooves 13 formed at the base of an exterior surface of tensioning device housing 14.

Cylindrical housings 12 have one large opening and one smaller opening for the insertion of an axle 18B therein. The axles 18B one for the top knob 3 and one for the bottom knob 3 has a central rod shape and an integral disk head; each of the rod shapes is inserted into one of the small openings whilst each of the disk heads comfortably sits within one of the cylindrical housings 12. A friction pad 17 having a small central hole and splined edges is inserted using this small central hole onto the rod shape of axle 18B and sits within the housing 12 between the closest surface of integral disk head of axle 18B and the surface of the housing 12 having the small hole; of course, this is duplicated on the other axle 18B.

A spring 19 abuts the inner surface of the knob 3 and makes contact with a friction pad 17 that in turn abuts a broad surface of integral disk of axle 18B; this is similarly repeated on the other axle 18B. Housing 12 has a threaded outer portion that permits knob 3 having a corresponding inner threaded surface to be mounted thereon; the housings 12 are integrally formed from annular protrusions 14. Each axle 18B is inserted through a hole in an annular disk 14 integrally associated with sleeve 5 and rotationally sits within a corresponding integral depression 18C within the base 15. The axles 18B have splined edges that correspond with ridges in the depressions 18C that permits the axles to swivel within depressions 18C; these ridges have holes for the attachment of screws. Holes in the cover 41 match the ridge holes and small screws 42 engage an axle cover 41 thereto; thus, the cover 41 holds the two axles 18B in place and permit rotation of thereon and lock axles 18B solidly to mirror bases.

FIG. 11 presents an alternative embodiment with all friction components shown in FIG. 10 assembled back into the accessory. The spring loaded ball tensioning device 4 that digitally pops mirror into positions of most common use is shown being on only one side of the mirror base in this drawing.

FIG. 12 is presents an embodiment of the various components of the tensioning devices. FIG. 12A presents a top view of a portion of the accessory as taught in an embodiment herein. A splined inner surface of housing 12 has splines 16 making up the shape of the inside of housings that house friction discs 17 that are located on both sides of disc 18, that is part of axle 18B. These ridges hold these friction discs securely so that friction discs do not spin with integral disk top 18A of axle 18B. FIG. 12A presents a top view of the accessory with mirror at an angle showing splined internal surfaces 16 of friction disk housing with knob and disk axle 18 removed. FIG. 12B presents a top view of a friction disk 17 having a hole for insertion into axle 18 having depressions and ridges for placement into friction disk housing splines. FIG. 12C presents a top view of splined internal surfaces 16 of friction disk housing containing disc 17 with a central hole seen in 12B with knob and disk axle 18 removed.

FIG. 12D presents a top view of axle 18. FIG. 12E presents a top view of the friction disk housing having a friction disk loaded underneath the axle top portion 18A on the axle 18B through a hole in the friction disk 17. FIG. 12F presents a side view of axle 18 showing its top disk 18A and axle portion 18B thereof. FIG. 12G presents a friction disk 17 having no central hole for mounting atop the disk axle top portion 18A. FIG. 12H presents a top view of a friction disk 17 having no central hole mounted atop the disk axle top portion 18A within a friction disk housing 12. FIG. 12I presents inside or bottom view of the friction disk knob 3. FIG. 12*j* is a topview of friction disc housing knob used to apply adjustable pressure or friction to friction discs FIG. 13 shows various components in an embodiment taught herein. FIG. 13 presents various components in an alternative embodiment herein disclosed. FIG. 13A presents a bottom view of knob 3 showing internal threads 24 and a bottom portion of a pad or plate 19 that has been mounted onto a spring [note this pad or plate is only for the purpose of Appling even pressure to spring 19 and may or may not be deemed necessary and employed] the view also shows how an inner space has been made by an internal cylindrical portion 24A separating the spring loaded within this inner space from the threads 24. FIG. 13B presents a side view of a spring having a friction pad 19 loaded thereon. FIG. 13C presents a side cross section view of knob 3 showing internal threads 24 and a bottom portion of a pad 19 that has been mounted onto a spring; the view also shows how an inner space has been made by an internal cylindrical portion 24A separating the spring loaded within this inner space from the threads 24.

FIG. 13D presents a bottom view of knob 3 showing internal threads 24 and a bottom portion of pads 19 that have been mounted onto a spring; the view also shows how inner spaces have been made by internal cylindrical portions 24B separating the springs loaded within these inner spaces from the threads 24. FIG. 13E presents a side view of a spring having a compression pad 19 this compression pad may or may not be incorporated into the final design of this spring loaded thereon. FIG. 13F presents a side cross section view of knob 3 showing internal threads 24 and a bottom portion of pads 19 that has been mounted onto a spring; the view also shows how inner spaces have been made by an internal cylindrical portions 24B separating the springs loaded within this inner spaces from the threads 24.

FIG. 13G presents a side cross section view of a container 4 that is further closed at one end by a screw 33 inserted in a threaded end of the container thereof. Further, there is a hole at another end for spring activation of a ball found therein; this open end having a hole conically reduces to a diameter narrower than the rest of the container thereby trapping a ball larger than the hole diameter therein; the ball's diameter permits it to partially extends through that hole but forbidding its exit.

FIG. 13H presents a cross section view of FIG. 13G with the spring and ball removed. FIG. 131 presents a side view of the ball, spring and threaded screw. FIG. 13*j* presents an alternative threaded adjustment screw integral to a knob FIG. 14 presents an alternative embodiment showing the adjustment to a 45 degree of the accessory with respect to a firearm. Here there is only one frictional spring loaded ball assembly 4 on an edge of a mirror base. Finish design may have an additional spring loaded ball assembly on the other side of mirror base if deemed beneficial FIG. 15 presents an alternative embodiment showing mirror extended straight out; there is only one frictional assembly on an edge of a mirror base.

FIG. 16 presents an alternative embodiment showing the accessory having a mirror cover loaded onto the mirror portion of the accessory. This cover 28 is a longitudinal pocket formed from most likely from molded plastic in that this cover is simply to protect the mirrors surface and to eliminate unwanted glair when the mirror is in its position of non-deployment this mirror cover extends around the two longitudinal sides and one narrower side. Thus, there remains an opening inside this narrow pocket for insertion of the mirror portion of the accessory. It is easily and quickly removable by pulling a raised area 30 on the cover (formed from a raised section of the cover of material appropriately and similarly attached thereto) thereby sliding the protective cover straight off of it. The raised area 30 is alternatively a plastic piece that has been sewn or heat treated into the material of the cover 28.

FIG. 17 presents an alternative embodiment showing the back side of the accessory the accessory having a mirror cover loaded onto the mirror portion of the accessory with loading protrusions helping to hold the cover in place. The mirror cover 28 slides onto the mirror portion of the accessory and suitable cut out sections therein on a top and bottom portion of one or both sides of the cover 28 pop onto protrusions, posts, or bumps 29 that are integral to a mirror base 15. Thus, the cover 28 is easily slid able onto and held in place as well as quickly and easily being removable by simply sliding it off FIG. 18 The sleeve 5 has a threaded aperture 25 having a cylindrical shape (with a narrow internal portion) perforating the sleeve 5 for insertion of a screw like tension knob 7; this knob 7 adjusts tension to a spring 26 loaded with a pad in the aperture 25 underneath the knob 7. The increase or decrease of tension affects a friction pad 27 creating friction or drag between sleeve Sand bearing 6 that is used to keep the mirror portion of the accessory in alignment.

FIG. 19 presents an alternative embodiment showing a spring acting ball in a container 4 as well as a friction pad in another container 31 controlling rotation of the mirror accessory.

Container 31 has a tension adjustable spring loaded friction pad that applies friction to cylindrical housing 38 that is integral sleeve 5; a corresponding housing 38 is disposed coaxially and on an opposite side of sleeve 5. This corresponding housing has depressions thereon 13 A rotational member 40 having a cover 39 facilitates rotation of the mirror 1 and base 15 thereon whilst spring loaded ball container 4 pushes against notches 13 for digital control of the rotation. This permits mirror 1 to pop into positions of most common use as well as into position of non use. Container 31 and container 4 are optionally closed at the back end, having a tension adjusting screw inserted at the back internally threaded end thereof or knob adjustable as in FIG. 18 above.

FIG. 20 presents a side view of an accessory having friction pad container and friction ball container in an alternative embodiment as taught herein. showing side view of invention with mirror tensioning device consisting of tension adjustable spring loaded pad housed in housing #31 as well as spring loaded ball housing in housing #4, as well as the cylindrical discs or drums that tension adjustable spring loaded compression pad and tension adjustable spring loaded ball work in conjunction with. One added advantage to this design is that it could be made in a lower profile than designs of invention with other type of mirror tensioning device.

Figure 22:
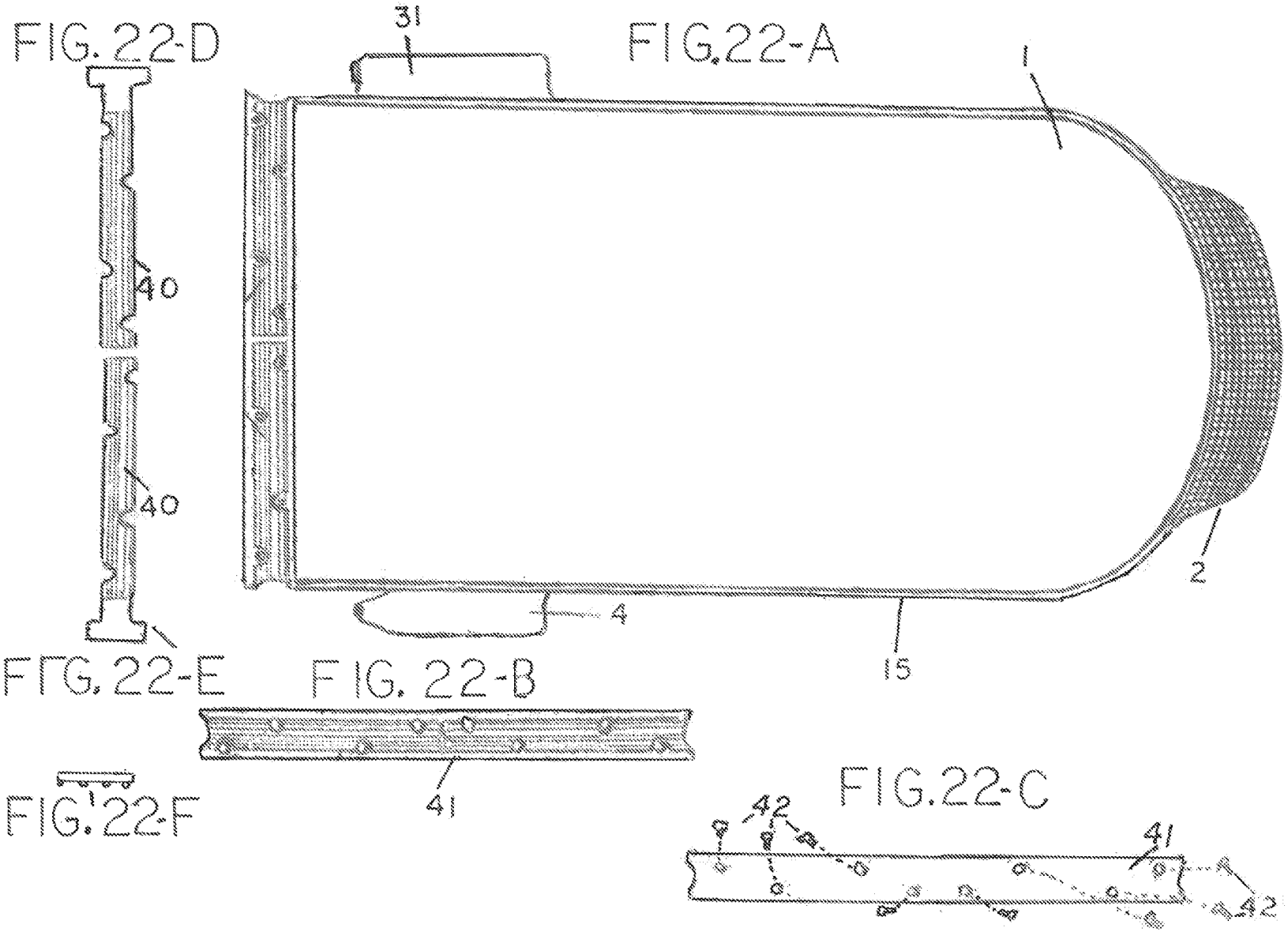

FIG. 21A present a cross section side view of a friction pad container having a friction pad pressed against by a spring tension adjusted by a screw having threads matching internal threads of container. FIG. 21B presents a front view of a friction pad container showing the friction pad therein. FIG. 21C presents a back view of a friction pad container showing the insertable screw mounted therein. FIG. 21D presents a side cross section view showing a ball container acted on by a spring loaded in the container tensioned by a screw having threads matching internal threads of the container. FIG. 21E presents a front view of a ball container showing the ball mounted therein. FIG. 21C presents a back view of a ball container showing the insert able screw mounted therein. Both embodiments here illustrated would be made as an integral part of the mirror housing FIG. 22 presents an alternative axle rotational system for the accessory. FIG. 22A present a side view of the mirror 1 and base 15 having a dual depression thereon for placement of axles 40 one each in the depressions 41A. FIG. 22B shows a front side view of an axle cover 41 having holes therein for insertion of screws 42 therein. FIG. 22C presents a back side view of an axle cover 41. FIG. 22D presents a side view of a top axle 40 having a T shape insertable in a depression inside a large portion of 38. This large portion is an opening where the axle passes through to a base of 15. This T portion and the housing act like a cup Bearing. With a hole in the center there of FIG. 22E presents a side view of a bottom axle 41 having a T shape insert able in a depression 41A of the base 15. FIG. 22F presents a side view of a top cover 39 for the top of axle and cup bearing FIG. 23A shows a back side of cover 41 having holes therein for insertion of screws 42. FIG. 23B present a side cross section view of axles 40 each mounted within a corresponding depression of the mirror base with the axle head also mounted in a bearing space 43 made within the mount housing 38 of sleeve 5 and the other axle 40 and head mounted on its opposite housing 38 coaxially disposed on sleeve on the base of mirror base 5.

FIG. 24 presents an illustration showing a rail mounted configuration with mirror set at 45 degrees to view targets at 90 degrees in relationship to firearm. This illustration as well as FIGS. 25 and 26 show a configuration that is a combination of previous designs. Thus, this has a spring loaded tension adjustable ball assembly and annular disc with grooves in it for quick easy reference to mirror angle and to pop mirror assembly into position of non-use located on one side of mirror; also, a tension adjustable knob that adjusts drag or tension to mirror assembly to keep mirror in adjustment once adjusted located on other side of mirror assembly.

FIG. 25 is illustration showing invention in configuration that would be made as an integral part of a red dot type sight and mirror set at 45 degrees to view targets at 90 degrees in relationship to firearm. This illustration shows a configuration that is a combination of other designs. A spring loaded tension adjustable ball assembly and annular disc with grooves in it for quick easy reference to mirror angle and to pop mirror assembly into position of non-use located on one side of mirror of course this spring loaded ball could located on the other side of the mirror base like in other embodiments with a large spring loaded friction pad and housing 31 as seen in FIG. 22 in its place and with housing 12 device and tension adjustable knob device that adjusts drag or tension to mirror assembly to keep mirror in adjustment once adjusted located on other side of mirror assembly.

FIG. 26 presents a side view of an alternative embodiment having a tensioning knob 3 as well as the housing 12 therefore mounted on an annular disk 14 for. Additionally, this view shows a protruding axle design for axle 40 mounted with flanged head within bearing space 43 using disk 39 to be ball actuated from container 4 integral to mirror base 15 at the bottom portion of the device annular discs 38 and 14 are actually integral to rotating collet 5 not shown for purposes of illustration.

Another Embodiment of Invention Seen in FIGS. 27 Through 31

In another embodiment, a device for use with a target viewing device is provided that solves the above described problems. A device for attaching in front of and behind a target viewing device of a firearm. In this embodiment, the device comprises a collet comprising at least a central opening defined by a first part and a second part. The second part is rotatably coupled to the first part such that the second part rotates relative to the first part. A friction tensioning device is provided, the threaded housing of which, being an integral part of the second part, housing a spring tensioning friction disc or brake pad that creates adjustable friction or drag between the first and second part.

At least one attaching member is configured to fixedly couple the first part of the collet to or proximate to the target viewing device such that the opening does not obstruct an image provided to and from the target viewing device. A mirror and mirror housing or track is pivotally coupled to the second part via at least one hinge. The mirror extends in and out of mirror housing or track locking it into positions of use and non-use and mirror assembly is engineered so that when mirror is extended out and locked into position of use, mirror assembly may pivot about the hinges to either be adjusted to desired angle of use or popped into a position of most common use to position the mirror relative to the target viewing device to provide a reflection of an image provided by the target viewing device to the user when the device is positioned behind or on the rearward end of target viewing device and to provide a reflection of the target to the viewing device when the device is positioned in front or on the forward end of the target viewing device.

Then mirror is taken out of service by pivoting mirror assembly back to a position of 90 degrees to the first and second member and mirror is simply popped out of position of use and slid back and popped into position of non-use where mirror would lock into position beside or over target viewing device that it is working in conjunction with and target's image is received from, with reflective side of mirror positioned beside or over target viewing device as not to create unwanted glare.

FIG. 27 presents a front view of a slidable and rotating mirror accessory in an alternative embodiment taught herein. A rail mountable accessory is shown having annular protrusions 14 disposed coaxially and opposite one another; these have an integrally formed housing 12 for the attachment of a tensioning knob 3 situated to the furthest limits away from each other on the outside portion of the annular protrusions 14 so disposed. The protrusions 14 sit external to and above and below respectively to one of two corresponding arms 45 that are parallel to each other and extend away from the body of the mirror housing 34 that mirror slides. in and out in popping or locking mirror assembly into positions of use and non use.

These arms 45 are formed so as to engage the annular protrusions 14 using two axles 18 each having an operational top disk integrally formed therewith. Each axle 18 sits within an externally threaded housing 12 having its main rotational rod extending through a hole in the body of a housing 12 and further through the annular protrusion 14 where splined end shaft is slid into splined hole in arms 45 where a press pin is inserted securely into a hole drilled in alignment with an oblong hole located in the end of the splined shaft this hole in the shaft is oblong to allow for a slight bit of vertical movement or adjustability to allow for friction disc wear The other axle is similarly positioned within the other housing 12, protrusion 14, and arm 45. Friction causing pads and or other devices are situated within the housing 12 to further facilitate control of the rotational motion of the accessory using knob 3.

This motion occurs as the frame 44 is moved upon arms 45 using axles 18.

It should be understood that each arm 45 is further attached one to a top portion of a frame 44 and the other to a bottom portion of the frame so as to permit rotation about axles 18. The frame itself is shaped as a rectangular object having an open narrow mouth 34 and has a mirror 1 and mirror base 15 inserted within its rectangular open mouth. The mirror 1 and mirror base 15 are thus, permitted to slide in and out of the open mouth 34 but are prevented from extending beyond the limits thereof.

Two containers 4 are fixedly attached one to a top inner portion and one to a bottom inner portion of the frame mirror housing 44 and opposite one another. These containers 4 each have a spring activated ball therein with a conically tapered maw that is screw tensioned on the open side of each of the containers 4. Further, the containers are situated so that the ball protrudes out the narrow open end of each container 4 each towards one opposite annular protrusions 14.

Passing near or integral with the arm 45 on a side of the frame 44 each container has its ball impact one of two actuation surfaces each one integrally formed from one of the annular protrusions 14. Thus, the first ball from a container 4 impacts an actuation surface having various circular depressions 13 or holes formed therein in a curved disposition across the surface so that the first hole or depression is formed offset from the next in a curved orientation. Similarly, the second ball does the same across the other actuation surface opposite the first one.

FIG. 28A presents a top view of a slidable and rotating mirror accessory in an alternative embodiment taught herein where the mirror and base have been translated outwards and locked into its initial position of deployment using a sliding system. FIG. 28B presents a slidable and rotating mirror accessory in an alternative embodiment taught herein where the mirror and base have been translated inwards and locked into its position of nonuse using a sliding system. Here are located two stops 20A, one integrally located on a protrusion 14 disposed downwards to block motion of arm 45 and another one integrally located on arm 45 upwards to block motion of protrusion 14 or vice versa.

FIG. 29A presents a front side view of a slidable mirror and base extended outwards and locked into its position of use in an alternative embodiment taught herein. FIG. 29B presents a front side view of a slidable mirror and base extended inwards and locked into its position of nonuse in an alternative embodiment taught herein. FIG. 29C presents a back side view of a slidable mirror and base extended outwards and locked into its position of use in an alternative embodiment taught herein. FIG. D presents a back side view of a slideable mirror housing with the mirror and base extended inwards and locked into its position of nonuse Here four containers 4 integrally associated with the back or the upper and lower edges of the housing 44 are disposed in pairs opposite one another having spring activated balls therein; a first pair is used to engage a raised stop at the end of the back portion of the mirror. And the other two are used to engage a raised section. Here, another stop at an opposite back side of the mirror is similarly engaged by the opposite pair than that of FIG. 29C. Two small cutouts in the housing 44 permit the stops to sit beyond the spring loaded containers 4. other much simpler mirror locking solutions are being considered as well such as a simple raised section bump or tiny knob located on each end of the outer edge or perimeter of the mirror base that would simply pop or lock into indents with a compressible entry portion inside the mirror tracts along with many other modes or solutions have and are being considered FIG. 30A present a top view of a slidable and rotatable mirror and base in an alternative embodiment herein showing spring loaded ball actuation transverse to the motion of the mirror and base. FIG. 30B present a top view of a slidable and rotatable mirror and base in an alternative embodiment herein showing spring loaded ball actuation transverse to the motion of the mirror and base stepped backwards along the actuation surface. Into an alternate angle adjustment of most common use these various actuation points are mainly used for reference points for quick easy mirror adjustment when time is critical These spring loaded balls pop mirror assembly into and out of positions of most common use. as well as pop or lock the mirror assembly into its position of non-deployment parallel to the weapons rail FIG. 3131A presents a front view of a rotational sleeve, bearing and rail mount having attachment points for a mirror base and slidable mirror assembly as taught herein in an alternative embodiment. Stop 20A extend from the arms 45 inwards. FIG. 3131B presents a side view of a disc or plate 19 loaded on a spring this disc or plate is simply there to insure even spring pressure and may be deemed as unnecessary and may or may not incorporated into in the final design. FIG. 31C presents a side view of a knob 3 for adjustable tension or friction adjustment when threaded to housing 12. FIG. 31D presents a bottom view showing an inner cylindrical portion integrally formed from the inner top surface; this inner cylindrical portion houses a spring and pad 19 abutting against it and the inner top surface thereof. FIG. 31E presents a top view of a friction pad 17 having depressions therein for splined surfaces internal to housing 12.

FIG. 3131F presents a side view of an axle 18 having a top disk portion and an oblong hole in a splined portion thereof. FIG. 31G presents a top view of a friction pad 17 having a hole therein having depressions thereon along its outer edge for splined portions of the housing 12. FIG. 3131H presents a top view of a housing 12 having an inner perimeter shaped to accept friction pad 17 solidly locking same in place within housing 12 such that its depressions match corresponding splined ridges 16 within housing 12. FIG. 31I presents a sliding mirror assembly as taught in an alternative embodiment herein. FIG. 31J presents a side view of a spring activated ball device. FIG. 31K presents a side view of a threaded screw member for tension adjusting the spring activated ball device.

Another Embodiment of Invention Seen in FIGS. 32 Through 44

In another embodiment, a device for use with a target viewing device is provided that solves the above described problems. A device for attaching in front of and behind a target viewing device of a firearm. In this embodiment, the device comprises a collet comprising at least a central opening defined by a first part and a second part. The second part is rotatably coupled to the first part such that the second part rotates relative to the first part. A friction tensioning device is provided, the threaded housing of which, being an integral part of the second part, housing a spring tensioning friction disc or brake pad that creates adjustable friction or drag between the first and second part. At least one attaching member is configured to fixedly couple the first part of the collet to or proximate to the target viewing device such that the opening does not obstruct an image provided to and from the target viewing device. At least two extending armatures are rotatably coupled to the second part so that extending armatures pop in and out of positions of 90 degrees, perpendicular to first and second members so that the mirror may be rotatably coupled to the opposite end of the extending armatures, integral to the outboard portion of this armature, a tension adjustable friction device is provided that adjusts friction or drag to mirror assembly to maintain mirror in its adjusted position.

On the inboard side of armature, components are provided to pop mirror in and out of positions or angles of most common use for quick, easy mirror angle adjustment to position the mirror relative to the target viewing device to provide a reflection of an image provided by the target viewing device to the user when the device is positioned behind or on the rearward end of target viewing device and to provide a reflection of the target to the viewing device when the device is positioned in front or on the forward end of the target viewing device. The mirror is taken out of service by rotating extending armatures and mirror assembly popping it out of position of 90 degrees relative to first and second members, around to either side or over the top of target viewing device it is working in conjunction with and popping mirror assembly into position of non-use with reflective side of mirror rotated inward beside target viewing device it is working in conjunction with as not to reflect unwanted glare.

FIG. 32 presents a side view of a rail mounted sighting device having an alternative embodiment of the accessory attached thereto. A red dot sight 20 has an accessory attached thereto. The accessory bearing 6A has a narrow neck and a conically expanding portion; the narrow neck serves as an attachment point for a sleeve SA having a diameter approximately the size of the diameter of the neck of the bearing so as to facilitate rotation thereon. Depending upon the materials and degree of tightness between the two parts, the diameter of the sleeve SA is either smaller than, equal to or slightly larger than the neck 6B of the bearing 6A.

FIG. 32 in this embodiment of this accessory is made as an integral component of a red dot or reflex type sight all embodiments of this invention would be made and implemented in three different modes the first being in a weapons rail mountable configuration the second be in a configuration mechanically fasten able to the housing a bought the forward or rearward viewing window or lens of a target viewing device or as manufactured as an integral part of a target viewing device A mirror base 15 has a mirror 1 attached thereto freely rotating on a dual armature 44 each having two oppositely disposed holes therein and each also attached to a narrow side of the mirror base 15. The portion of the accessory closest to the viewing device is attachable according to the teachings of FIG. 40-41 and the furthest portion of the accessory is attachable according to the teachings of FIG. 42-43 for example. This permits rotation on the armatures as described herein.

FIG. 33 presents an alternative embodiment showing how the accessory is attachable to and removable from existing viewing devices that are themselves rail mounted on a firearm. The portion of the accessory closest to the viewing device is attachable according to the teachings of FIG. 40-41 and the furthest portion of the accessory is attachable according to the teachings of FIG. 42-43 for example. This permits rotation on the armatures as described herein.

FIG. 34 presents an alternative embodiment herein disclosed showing the red dot sight of FIG. 33A having rotated the sleeve SA upon the bearing in an embodiment taught herein. The portion of the accessory closest to the viewing device is attachable according to the teachings of FIG. 40-41 and the furthest portion of the accessory is attachable according to the teachings of FIG. 42-43 for example. This permits rotation on the armatures as described herein.

FIG. 35 presents an alternative embodiment herein disclosed showing the red dot sight of FIG. 33A having rotated the armatures backwards and popped into positions of non-use so that the mirror 1 and mirror base 15 may be stowed parallel to the red dot sight in a position of non-use in an embodiment taught herein.

Figure 41:
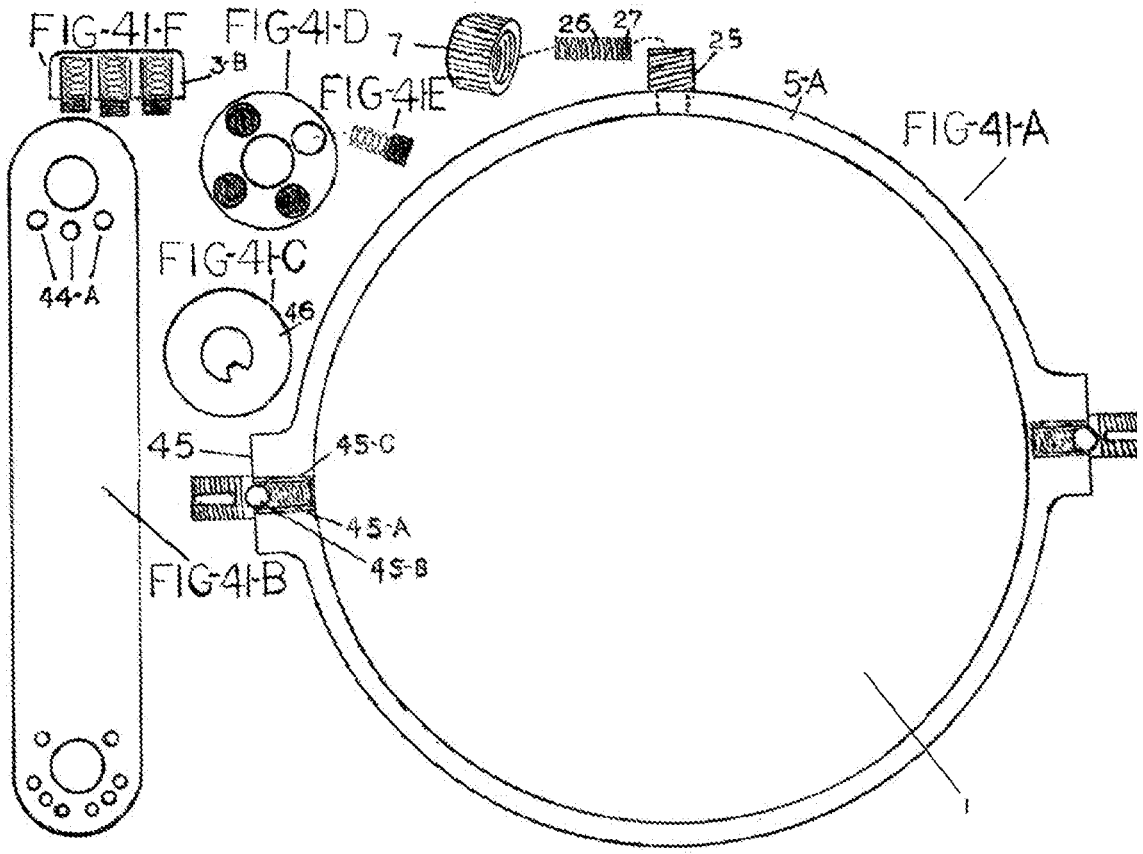

Both mirrors attachment joints as well as the armature attachment joints at the rotating collet 5 lock or pop into these particular angles that maintain the mirror into its position of nonuse beside or over the target viewing device its working in conjunction with the mirror rotated with the reflective side of mirror portion facing inward this along with the rest of the internal workings of this embodiment of the invention will be understood according to the teachings of FIG. 40-41 and the teachings of FIG. 42-43 for example.

FIG. 36 presents an accessory mounted on a weapons rail in an alternative embodiment taught herein. A sleeve SA is mounted upon a bearing 6A having a circular depression or operating surface therein running the circumference thereof. Another integral portion 8 of the bearing 6A expands backwards, downwards and to either side of rail so as to effect attachment thereto. A thumbscrew 10 facilitates attachment to the rail in a conventional manner. A threaded knob 7 attachable to a threaded housing in the sleeve SA containing a spring and friction pad so as to apply adjustable friction control the rotation of sleeve SA upon bearing 6A.

FIG. 37 presents an accessory mounted on a weapons rail in an alternative embodiment taught herein with the mirror turned at an angle upon forward armature mounts. The portion of the accessory closest to the viewing device is attachable according to the teachings of FIG. 40-41 and the furthest portion of the accessory is attachable according to the teachings of FIG. 42-43 for example. This permits rotation on the armatures as described herein.

FIG. 38 presents an accessory mounted on a weapons rail in an alternative embodiment taught herein with the mirror folded back as far as possible using the armature 44 and knobs 3A closest to the bearing 6A and sleeve SA presenting a mirror stored position. The portion of the accessory closest to the viewing device is attachable according to the teachings of FIG. 40-41 and the furthest portion of the accessory is attachable according to the teachings of FIG. 42-43 for example. This permits rotation on the armatures as described herein.

FIG. 39 present an accessory mounted on a weapons rail such that accessory is locked into an alternative stored position. Here the sleeve SA has been rotated on the bearing 6A and the mirror placed horizontally with the reflective side of mirror rotated downwards over weapons rail and locked in place into one of its alternative stored positions of non-deployment with the armatures 44 and the mirror assembly 1 and 15 locked into positions of 45 degrees. The portion of the accessory closest to the viewing device is attachable according to the teachings of FIG. 40-41 and the furthest portion of the accessory is attachable according to the teachings of FIG. 42-43 for example. This permits rotation on the armatures as described herein.

FIG. 40 presents a view with various items in cross section view in an alternative embodiment of a connection assembly whereby a mirror and mirror base can be attached to sleeve SA using dual armatures as taught herein; the discussion in this paragraph applies to both armatures connection points and assemblies as applied to both sleeve SA sides and associated dual armatures 44. Each armature 44 is attached at a rear portion thereof to sleeve SA and is digitally manipulable using a spring 45B activated ball 45A housed in a cavity 45C under both side connection points of sleeve SA; the armatures 44 armatures have depressions or indents that are engaged by the spring 45B activated ball 45A such that the armatures click between each of these so as to provide selective positioning of the armatures and thus to the mirror 1.

These connection points are flat surfaces extending outwards from the sleeve SA and have a central integral threaded column for mounting the armatures 44 each on opposite sides of sleeve SA. A rigid friction disc 46 is also placed upon this central column for applying friction to the connection point assembly. Atop the friction disc 46 and the armature 44 is placed a knob 3B containing spring loaded compression plates housed in 3 or more chord cavities housed in the inner body of the knob this tensioning knob also contains a threaded cavity in the inside central portion there in so that the central threaded column integral to rotating collet 5 A being the connection point the threaded cavity of knob 3B thereby engaging the knob 3Bs internal threads there in with the external thread of the central column of the central column outer thread. Thus, turning knob 3B threads to column 48 so that as tensioning knob 3B is rotated this action increases pressure to plate 46 which acts like a tiny clutch plate and thus friction or drag armature 44.

FIG. 41 presents various components of the connection assembly of FIG. 40 including armatures 44. FIG. 41A presents a front view of a sleeve SA having two raised attachment points opposite each other forming two attachment surfaces 45; a central column 48 rises out of the center of each and directed to opposing directions and has a cutout along its length. FIG. 41B presents an armatures 44 having a hole there in 44B that mounts onto the central column 48; various depressions or indents 44A engage spring 45B activated ball 45A housed in a cavity to aside of column 48 inside circular raised section with ball 45B partially extending out of the attachment surface 45. to engage indents 44A on the inside surface of armatures 44 this action provides angular positioning of mirror armature's in relation to rotating collet SA so that armatures' pop or lock both into positions of 90 degrees being the position of deployment of accessory and the other two indents being to lock or pop armatures and mirror assembly 1 and 15 into their positions non-deployment or storage positions FIG. 41C presents a rigid pressure plate 46 having a central hole and inner disposed ridge within that hole for insertion into cutout of column 48. Maintaining discs point of rotation stationary or the same as that of column 48 this would be accomplished with 1 or more ridges and cutouts in friction disc or clutch plate 46 and column 48.

FIG. 41D presents a knob 3B having four chord cavities with three of them filled and one empty of spring 47A loaded pads 47B and a central threaded cavity for rotational mounting to a central column 48 on the attachment surface 45. FIG. 41E presents a view of a spring 47A thin ridged plate 47B attached on this plate this plate is simply for even pressure to friction disc 46 and may or may not be incorporated if deemed of insufficient need. FIG. 41F presents a side cross section view of knob 3B showing internal chord cavities having spring 47A activated plates 47B attached to end of springs. The other attachment point and attachment surface 45 on the opposite side of the sleeve. SA is similarly equipped as the first attachment surface 45.

FIG. 42 presents a close-up view of an alternative embodiment of a connection assembly of a forward portion of a mirror base mounted on forward points of dual armatures showing the knobs whereby a mirror 1 and mirror base 15 can be attached to sleeve SA using dual armatures as taught herein. Each side of the mirror 1 and mirror base 15 is similarly equipped so that repetition of the details of the other side is unnecessary.

A raised attachment point has a spring 45C activated ball 45A within a cavity 45C housed inside raised surface of mirror base with ball 45*a* extending just beyond of the surface of attachment surfaces of mirror armatures' 44 These are used to engage appropriate indents or depressions on a side of armature 44 mounted upon a central column integrally associated with the attachment surface 45; this provides selective localization of the armature 44 with respect to the mirror 1 and mirror base 15 and vice versa. For selection of mirror angles of most common use can be selected. On an opposite side of the armature 44 is a raised circular threaded housing 44D for attachment of knob 3B with internal threads therein.

FIG. 43 presents various components of the connection assembly of FIG. 42 including armatures 44; the various parts herein disclosed are duplicated with regards to the other side of the mirror and repetition is not deemed necessary. FIG. 43A presents a mirror 1 and mirror base 15 having two raised attachment points including two attachment surfaces 45 opposite one another. Each attachment surface has a spring 45B activated ball 45A housed there in located in a cavity 45C within the surface 45. These actuate depressions or indents 44A on one wide side of armature 44 for digital manipulation of the mirror motion; a central hole 44C on the armature facilitates its placement about column 48A.

This central circular column 48A is located in the central portion of the attachment surface; similarly, there is a second square central column 48B coaxially and integrally located just above the first section of column; 48A this central column 48B has a central threaded hole for attachment of a screw thereon. FIG. 43B presents a side view of armature 44 showing how a threaded housing 44D is on an opposite side of indents or depressions 44A.

FIG. 43C presents a bottom view of knob 3C showing four chord cavities within it such that three of them have spring 47A activated pads 47B within them; these are formed from a central column the inner round surface of which forms a space with the inner surface of the knob 3C proper; this space permits the attachment to housing 44D which external threads there on threads to internal threads of the internal surface of the knob 3C itself opposite the surface of central column.

FIG. 43D presents spring 47A activated plate 47B connected to an end of spring 47A FIG. 43E presents a disk having a square inner hole for mounting upon square column 48B. FIG. 43F presents a machine screw placed within the central hole of disk of FIG. 43E and on into hole in central column 48B. FIG. 43G presents a wide side of armature 44 for digital manipulation of the mirror motion; a central hole 44C on the armature facilitates its placement about column 48A whilst depressions or holes are engaged by spring 45B activated ball 45A.

FIG. 43H presents a second friction disc like a tiny clutch plate having a splined outer perimeter that engages interlocking splines located on the inside outer perimeter of housing 44D for rotationally stationary position for placement inside 44D underneath spring activated pads 47B for assisting in knob friction control of the mirror. FIG. 43I presents a view of a wide side of the armature underneath the opening of the housing 44D showing friction disc or plate having hole therein and splined sides; the hole is for mounting onto column 48A FIG. 44 presents a closeup backside view of non-reflective side view of the mirror assembly and mirror arms of an alternative embodiment of FIG. 42-43 of a back portion of a mirror base 15 mounted on forward points of dual armatures showing the outer threads on friction disc housings 44D knobs. 3Bs The Following FIGS. 45 Through 48 Show Various Applications of this Invention FIG. 45 is drawings showing the invention being used by law enforcement personnel or military combatants to surveil the environs for targets of potential danger such as advancing enemy combatants, from behind a wall or building from a relatively safe, secure position with the firearm accessory in use, mounted in front of the target viewing device, with the user viewing the reflected image of the target and surrounding area provided by the accessory through the sight or scope that is being used in conjunction with the accessory and being used by the three law enforcement personnel or military combatants in the various embodiments of the invention.

FIG. 46 is drawings showing the invention being used by law enforcement personnel or military combatants to engage targets such as advancing enemy combatants, from behind a wall or building from a relatively safe, secure position without having to expose himself as a target while doing so, with the firearm accessory behind the target viewing device in use and supplying the target image provided by the scope to the user. These accessories are either mounted behind the target viewing device on the weapons rail, or mechanically fastened to or made as an integral part of the target viewing device it is working in conjunction with. The other accessories mounted on the front or forward part of the target viewing devices are folded back with the mirror portion thereof folded back and locked into its position of nonuse, leaving an unobstructed view through the scope with the user viewing the reflected image of the target and surrounding area provided by the accessory through the scope that is being used in conjunction with the accessory and being used by the three law enforcement personnel or military combatants in the various embodiments of the invention.

FIG. 47 is drawings showing the invention in its various embodiments being used by military combatants to surveil the environs, such as for advancing enemy combatants, from behind a wall or building from a relatively safe, secure position without having to expose themselves as targets while doing so, with the target viewing accessory mounted to, or made as an integral part of, the front part of a night viewing device that is mounted to the forward mount of a military helmet.

FIG. 48 is drawings showing the invention in its various embodiments with their mirrored portions thereof locked into their positions of nonuse providing a totally unobstructed view through the night vision device they are mounted to as not to hinder the normal function of the viewing device in any way thereof when not in use.

The above-described embodiments are merely exemplary illustrations of implementations set forth for a clear understanding of the principles of the invention. Many variations, combinations, modifications or equivalents may be substituted for elements thereof without departing from the scope of the invention. Therefore, it is intended that the invention not be limited to the particular embodiments disclosed as the best mode contemplated for carrying out this invention, but that the invention will include all the embodiments falling within the scope of the appended claims.

I claim:

1. A rotationally deployable firearm accessory for a firearm having a sight and a rail, the accessory comprising: a mirror base having a mirror attached thereto such that the mirror base is rotationally disposed upon an axle such that the axle is associated with a sleeve rotationally disposed upon a bearing, wherein the bearing is capable of being positioned on the rail of the firearm at a distance from the sight of the firearm.

2. The rotationally deployable firearm accessory of claim 1, further comprising: a first tightening knob assembly where a portion thereof is fixedly attached to the sleeve and wherein the first tightening knob assembly houses a portion of the axle.

3. The rotationally deployable firearm accessory of claim 2, further comprising: a second tightening knob assembly where a portion thereof is fixedly attached to the sleeve and on an opposite side of the sleeve as to the first tightening knob assembly and wherein the second tightening knob assembly houses another portion of the axle.

4. The rotationally deployable firearm accessory of claim 1, further comprising: a friction pad assembly integrally disposed upon on edge of the mirror base and in contact with the sleeve.

5. The rotationally deployable firearm accessory of claim 1, further comprising: a clutch assembly integrally disposed upon on edge of the mirror base and in contact with the sleeve.

6. The rotationally deployable firearm accessory of claim 1, further comprising: a first annular protrusion extending outwards from an edge of the sleeve.

7. The rotationally deployable firearm accessory of claim 6, further comprising: a second annular protrusion extending outwards from an edge of the sleeve at a position opposite to the first annular protrusion and in coaxial orientation thereto.

8. The rotationally deployable firearm accessory of claim 1, further comprising: a first friction component housing integrally attached to a side of the mirror base.

9. The rotationally deployable firearm accessory of claim 8, further comprising: a second friction component housing integrally attached to a side of the mirror base.

10. The rotationally deployable firearm accessory of claim 8, wherein the axle further comprises a first axle portion such that the first axle portion is placed through a hole in the first friction component housing and on into a first annular protrusion extending outwards from an edge of the sleeve.

11. The rotationally deployable firearm accessory of claim 10, wherein the axle further comprises a second axle portion such that the second axle portion is placed through a hole in a second friction housing component and on into a second annular protrusion extending outwards from an edge of the sleeve.

12. A weapons reflector device comprising: a rotational bearing having a sleeve mounted thereon; an axle associated with the rotational bearing and to a mirror base having a mirror attached thereto such that the mirror base is rotationally associated with the axle; wherein the rotational bearing is capable of being positioned on a rail of a firearm at a distance from a sight of the firearm.

13. The weapons reflector device of claim 12, wherein the rotational bearing further comprises: an actuation surface having actuation positions.

14. The weapons reflector device of claim 12, wherein the mirror base further comprises: a first actuation surface having first actuation positions.

15. The weapons reflector device of claim 14, wherein the rotational bearing further comprises: a second actuation surface having second actuation positions a lock attached to the mirror base such that the lock actuates first and second lock actuations positions.

16. The weapons reflector device of claim 14, wherein the axle further comprises: frictional members associated therewith and controlled by a manual knob.

17. The weapons reflector device of claim 12, wherein the mirror and base further comprise: a slidable mirror base system.

18. A weapon mountable assembly, for a weapon having a sight and a rail, the assembly comprising: a bearing having a sleeve mounted thereon upon a narrow portion of the bearing wherein the sleeve is rotationally associated with the bearing; a reflector attached to the sleeve through a first armature, and wherein the bearing is capable of being positioned on the rail of the weapon at a distance from the sight of the weapon.

19. The weapon mountable assembly of claim 18, further comprising: a second armature attached to the reflector at an opposite side of the reflector than the first armature is attached thereto wherein the second armature is also attached to the sleeve at an opposite portion of the sleeve that the first armature is attached thereto.

20. The weapon mountable assembly of claim 18, further comprising: a friction engaging knob associated with the first armature.

* * * * *